US010799002B2

(12) United States Patent
Bradley

(10) Patent No.: US 10,799,002 B2
(45) Date of Patent: Oct. 13, 2020

(54) DROP-STITCH INFLATABLE COOLER

(71) Applicant: SWELL INDUSTRIES LLC, Honolulu, HI (US)

(72) Inventor: Todd Bradley, Honolulu, HI (US)

(73) Assignee: SWELL INDUSTRIES LLC, Honolulu, HI (US)

( * ) Notice: Subject to any disclaimer, the term of this patent is extended or adjusted under 35 U.S.C. 154(b) by 578 days.

(21) Appl. No.: 15/401,933

(22) Filed: Jan. 9, 2017

(65) Prior Publication Data

US 2017/0119116 A1 May 4, 2017

Related U.S. Application Data

(63) Continuation-in-part of application No. PCT/US2016/021851, filed on Mar. 10, 2016.

(60) Provisional application No. 62/131,623, filed on Mar. 11, 2015, provisional application No. 62/255,245, filed on Nov. 13, 2015.

(51) Int. Cl.

| | |
|---|---|
| ***A45C 7/00*** | (2006.01) |
| ***A45C 11/20*** | (2006.01) |
| ***A45C 13/00*** | (2006.01) |
| ***A45C 13/10*** | (2006.01) |
| ***A45C 13/26*** | (2006.01) |
| ***A45C 13/36*** | (2006.01) |
| ***B65D 81/38*** | (2006.01) |
| *F25D 3/08* | (2006.01) |

(52) U.S. Cl.

CPC ..... *A45C 7/004* (2013.01); *A45C 7/0081* (2013.01); *A45C 11/20* (2013.01); *A45C 13/008* (2013.01); *A45C 13/103* (2013.01); *A45C 13/26* (2013.01); *A45C 13/36* (2013.01); *B65D 81/3897* (2013.01); *F25D 3/08* (2013.01); *F25D 2323/062* (2013.01)

(58) Field of Classification Search

CPC ..... A45C 7/004; A45C 7/0081; A45C 11/20; A45C 13/008; A45C 13/103; A45C 13/26; A45C 13/36

USPC ..... 220/592.01

See application file for complete search history.

(56) References Cited

U.S. PATENT DOCUMENTS

| | | | | |
|---|---|---|---|---|
| 3,775,782 A | | 12/1973 | Rice et al. | |
| 4,044,867 A | * | 8/1977 | Fisher | A45C 7/004 190/107 |
| 4,085,785 A | | 4/1978 | Hoot | |
| 4,251,893 A | * | 2/1981 | McCrory | B63B 7/08 114/345 |

(Continued)

FOREIGN PATENT DOCUMENTS

WO 2009061245 A1 5/2009

OTHER PUBLICATIONS

ISA Korean Intellectual Property Office, International Search Report and Written Opinion Issued in Application No. PCT/US2016/021851, dated Jun. 15, 2016, WIPO, 15 pages.

*Primary Examiner* — Ernesto A Grano

(74) *Attorney, Agent, or Firm* — McCoy Russell LLP

(57) ABSTRACT

An article of manufacture, comprising an inflatable cooler having at least a portion with a drop-stitch construction is provided. The inflatable cooler may comprise a first inflatable drop-stitch chamber defining a bottom wall, a second inflatable drop-stitch chamber defining a plurality of side walls, and a third inflatable drop-stitch chamber defining a lid of the inflatable cooler.

9 Claims, 18 Drawing Sheets

(56) References Cited

U.S. PATENT DOCUMENTS 4,462,331 A * 7/1984 McCrory ..... B63B 7/08 114/345
4,612,781 A 9/1986 Swerdon
4,679,242 A * 7/1987 Brockhaus ..... A45C 3/04 190/1
4,809,352 A 2/1989 Walker
D333,592 S * 3/1993 Walker ..... D7/605
D402,809 S * 12/1998 Bauman ..... D3/276
6,345,744 B1 * 2/2002 Eldridge ..... A01M 31/00 220/560
6,442,962 B1 * 9/2002 Gaetke ..... A47F 10/06 62/457.6
6,513,974 B2 * 2/2003 Malone ..... B65D 81/052 206/522
D497,518 S * 10/2004 Bellofatto, Jr. ..... D7/607
D506,645 S * 6/2005 Bellofatto, Jr. ..... D7/607
7,195,132 B1 * 3/2007 Balam ..... A47G 23/02 220/560
8,046,845 B1 * 11/2011 Garcia ..... A42B 3/061 2/2.5
8,579,372 B2 * 11/2013 Wessman ..... B60N 2/2806 297/250.1
8,821,204 B1 9/2014 Hoge, Jr.
8,834,220 B2 9/2014 Haller et al.
9,227,707 B2 * 1/2016 Abeyta ..... B63C 9/18
9,854,886 B1 * 1/2018 Xia ..... B65D 81/38
2003/0153221 A1 * 8/2003 Weir ..... B63B 35/7913 441/66
2004/0091181 A1 5/2004 James
2007/0023439 A1 2/2007 Vaughn
2009/0049757 A1 * 2/2009 Potter ..... B63B 35/7913 52/2.23
2013/0000036 A1 1/2013 Wood Greeney et al.
2014/0242860 A1 * 8/2014 Hoge, Jr. ..... B63B 35/7913 441/66
2014/0245943 A1 9/2014 Swan
2016/0096591 A1 * 4/2016 Hoge, Jr. ..... B63B 7/08 114/345

* cited by examiner

DROP-STITCH INFLATABLE COOLER

CROSS-REFERENCE TO RELATED APPLICATIONS

The present application is a continuation-in-part of International Application No. PCT/US2016/21851 entitled "DROP-STITCH INFLATABLE COOLER", filed Mar. 10, 2016. International Application No. PCT/US2016/021851 claims priority to U.S. Provisional Patent Application No. 62/131,623 entitled "DROP-STITCH INFLATABLE COOLER", filed Mar. 11, 2015, and U.S. Provisional Patent Application No. 62/255,245 entitled "COLLAPSIBLE DROP-STITCH INFLATABLE COOLER", filed Nov. 13, 2015. The entire contents of the above-referenced applications are hereby incorporated by reference for all purposes.

FIELD OF INVENTION

The present description relates generally to inflatable storage devices, such as coolers.

BACKGROUND/SUMMARY

Insulated coolers may be used to maintain a temperature of objects, where the coolers may be constructed from a rigid material such as plastic. However, such coolers may present storage constraints when the cooler is not in use. Storage constraints may be addressed by using inflatable coolers that may be easily stored when deflated. However, inflatable materials may lack a certain amount of rigidity desired for a cooler, as coolers may often experience higher amounts of pressure due to water pushing against the cooler walls. Further, inflatable coolers have to be sufficiently sturdy in order to transport the stored contents when fully loaded with ice.

One example inflatable cooler includes external support structures with an inflatable cooler body, such as in Vaughn in U.S. 2007/0023439. Therein, an inflatable cooler includes a rigid plastic lid, a rigid upper frame, and a rigid base tray to provide structural support to inflatable cooler walls. When deflated, the lid and upper frame may collapse into the base tray allowing for a flat, deflated cooler to be more easily stored. Further, the walls of the cooler comprise a plurality of inflatable chambers with separate valves.

However, the inventors herein have identified potential issues with the above example system. As one example, each of the rigid plastic lids, rigid upper frame, and rigid base tray may restrict the compactness of the cooler in the deflated state. As another example, constructing the walls of the cooler from multiple inflatable chambers may increase the complexity and amount of work required to inflate and deflate the cooler. As yet another example, including a plastic lid, plastic handles, and a lower base tray that extends across the entire horizontal surface may increase the weight of the cooler. This increase in the weight of the cooler may be undesirable for active applications of the cooler such as in hunting or fishing.

In one example, these and other issues recognized by the inventor may be at least partially addressed by an inflatable cooler having a first pair of sides extending from a bottom portion, a plurality of foldable sections extending through a second pair of sides, the foldable sections enabling an angular position, with respect to the bottom portion, of each of the sides in the first pair of sides to be adjusted. The inflatable cooler also includes an inflation valve connected to an inflation chamber positioned between an interior storage compartment and an external layer, the inflation chamber positioned in one or more sides in the first pair of sides and the second pair of sides. The plurality of foldable section enable the first pair of sides to be arranged in an expanded configuration and a condensed configuration, in the expanded configuration distal ends of a first and second side in the first pair of sides are further away from the bottom portion when compared to distal ends of the first and second sides in the first pair of sides in the condensed configuration. In this way, the inflatable cooler can be compactly arranged when desired. The compact arrangement enables the inflatable cooler to be more easily stored and/or transported when compared to the expanded arrangement.

It should be understood that the summary above is provided to introduce in simplified form, a selection of concepts that are further described in the detailed description. It is not meant to identify key or essential features of the claimed subject matter, the scope of which is defined uniquely by the claims that follow the detailed description. Furthermore, the claimed subject matter is not limited to implementations or embodiments that solve any disadvantages noted above or in any part of this disclosure.

BRIEF DESCRIPTION OF THE FIGURES

FIGS. 2-16 and 18A-18D are drawn to scale, although other relative dimensions may be used.

DETAILED DESCRIPTION

Figure 1A:
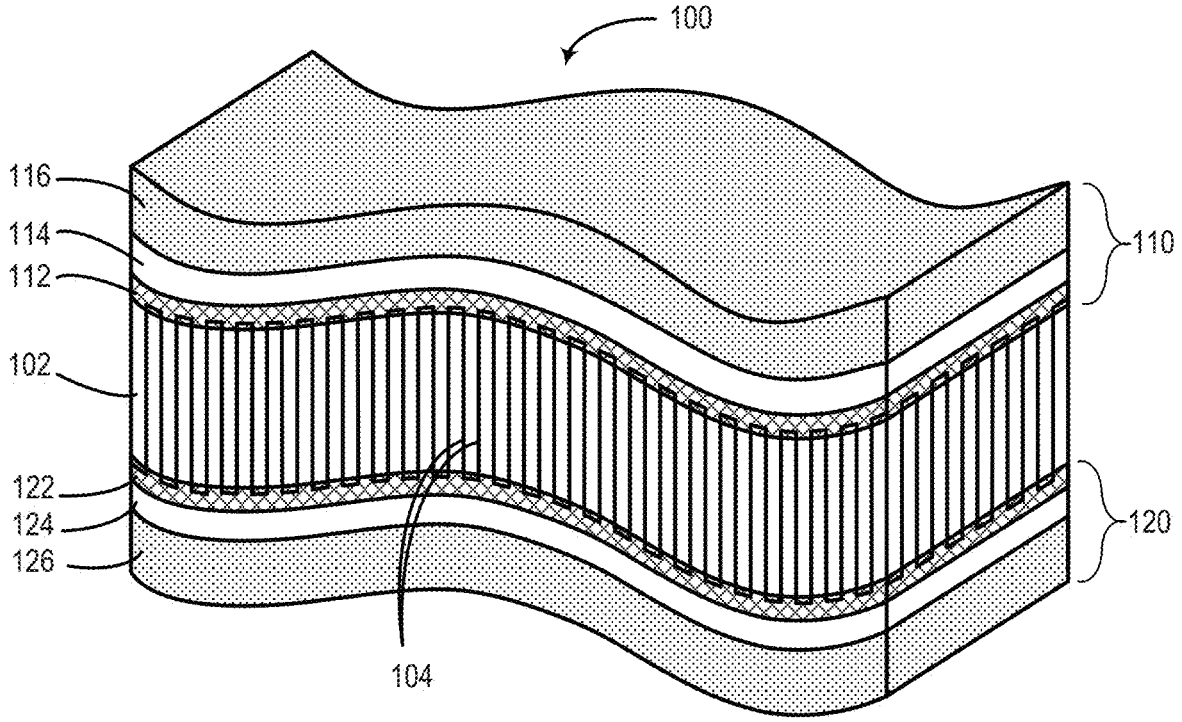
FIG. 1A shows a cross-section of a drop-stitch fabric.
Figure 1B:
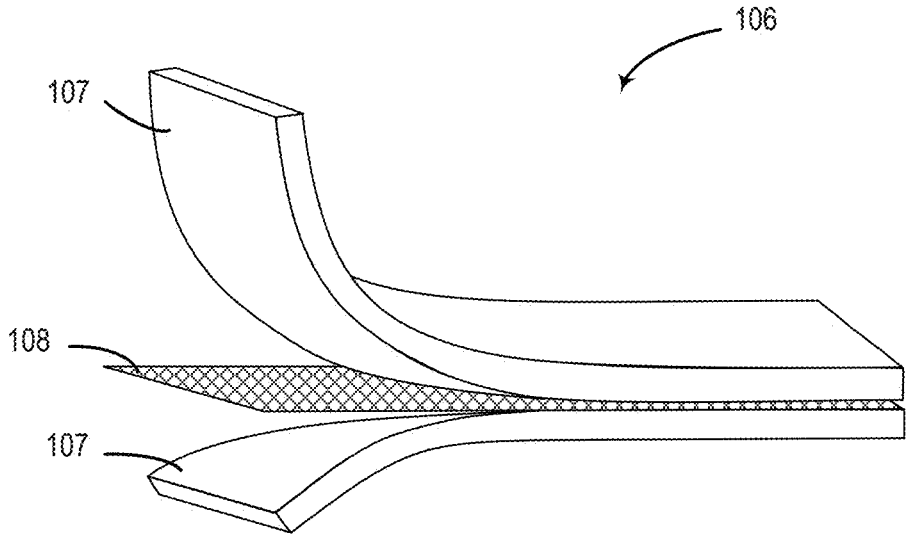
FIG. 1B shows a partially exploded view of a multi-component material used in the drop-stitch fabric of FIG. 1A.
Figure 2B:
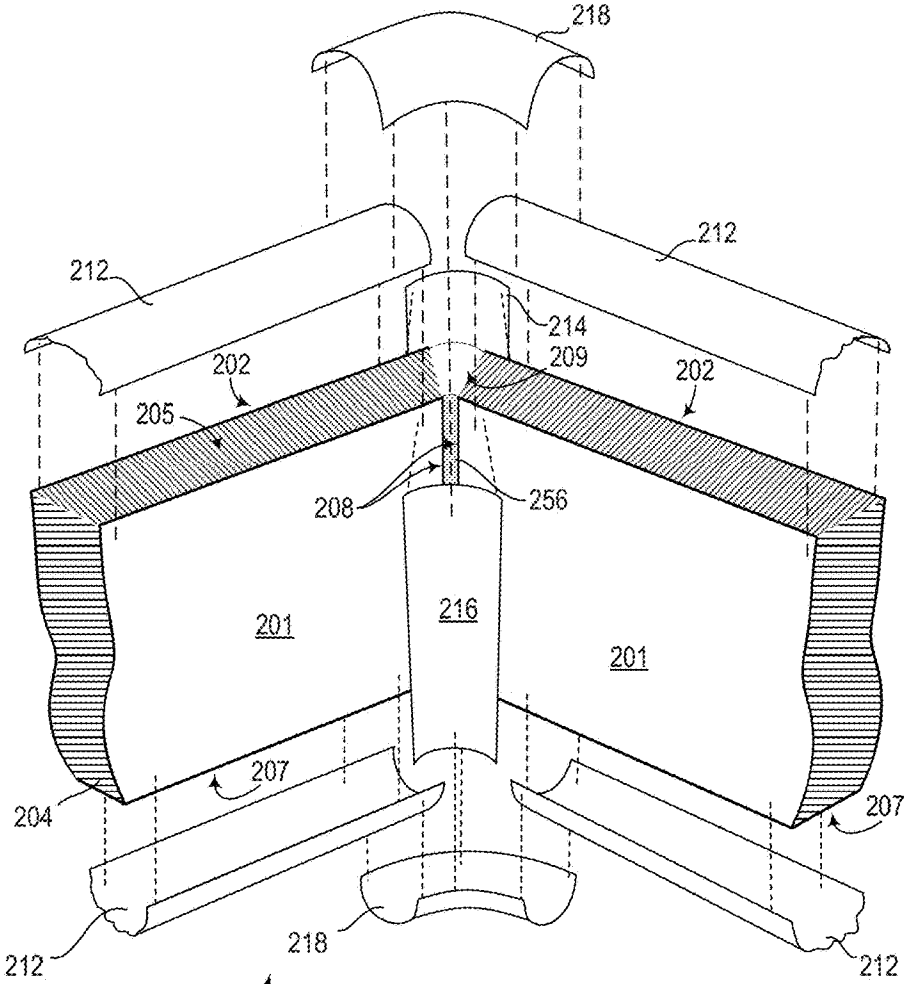
FIG. 2B shows a partially exploded view of a drop-stitch fabric scored and sealed via a second method for use as an inflatable cooler.
Figure 2A:
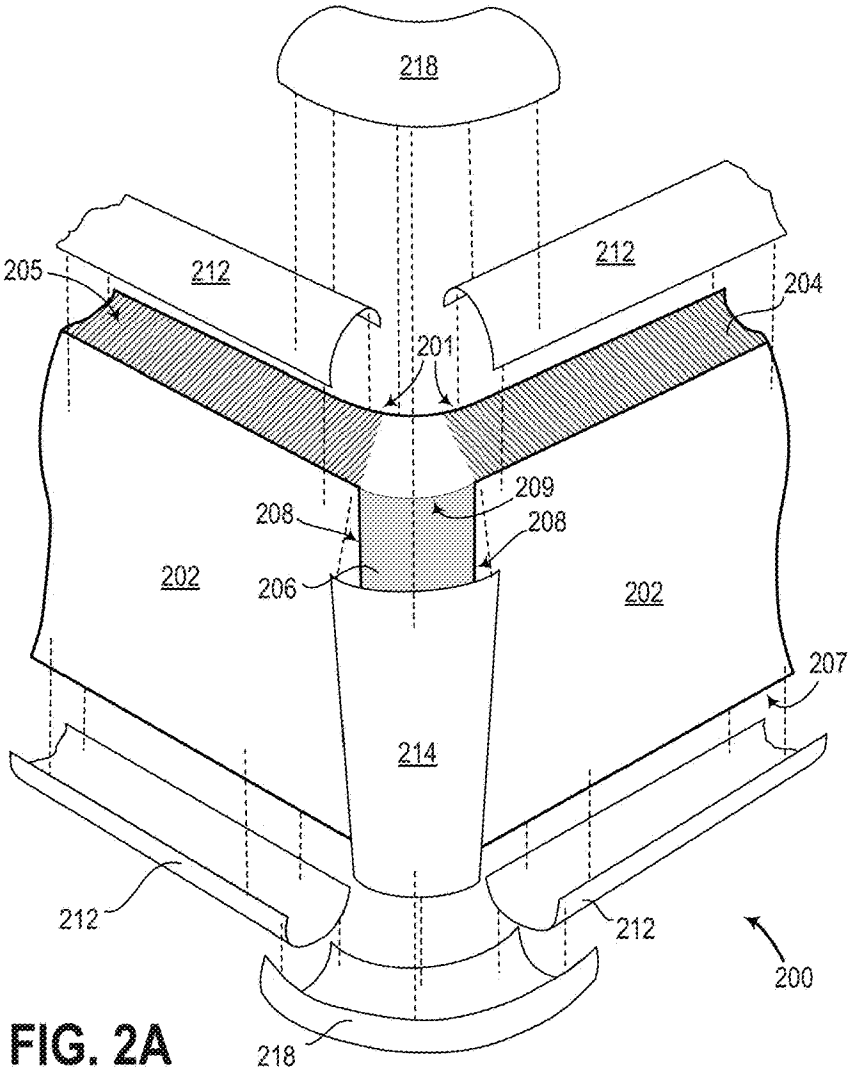
FIG. 2A shows a partially exploded view of a drop-stitch fabric scored and sealed via a first method for use as an inflatable cooler.
Figure 3A:
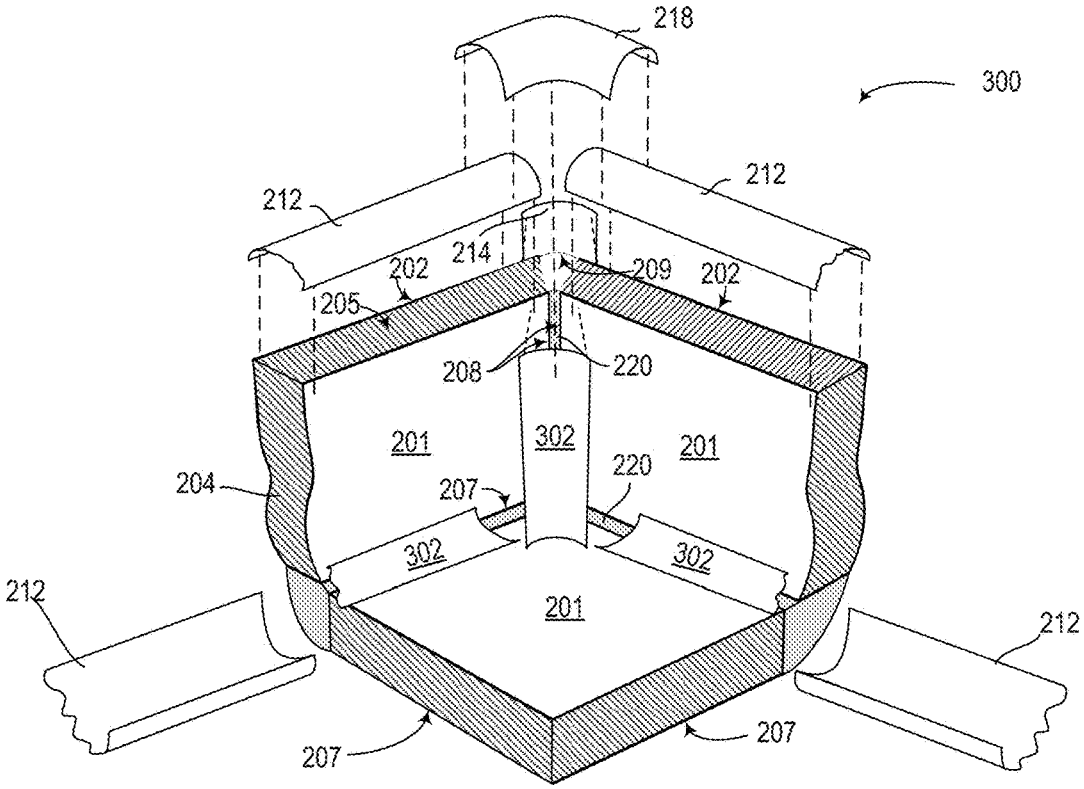
FIG. 3A shows a partially exploded view of a drop-stitch fabric scored and sealed via a third method for use as an inflatable cooler.
Figure 3B:
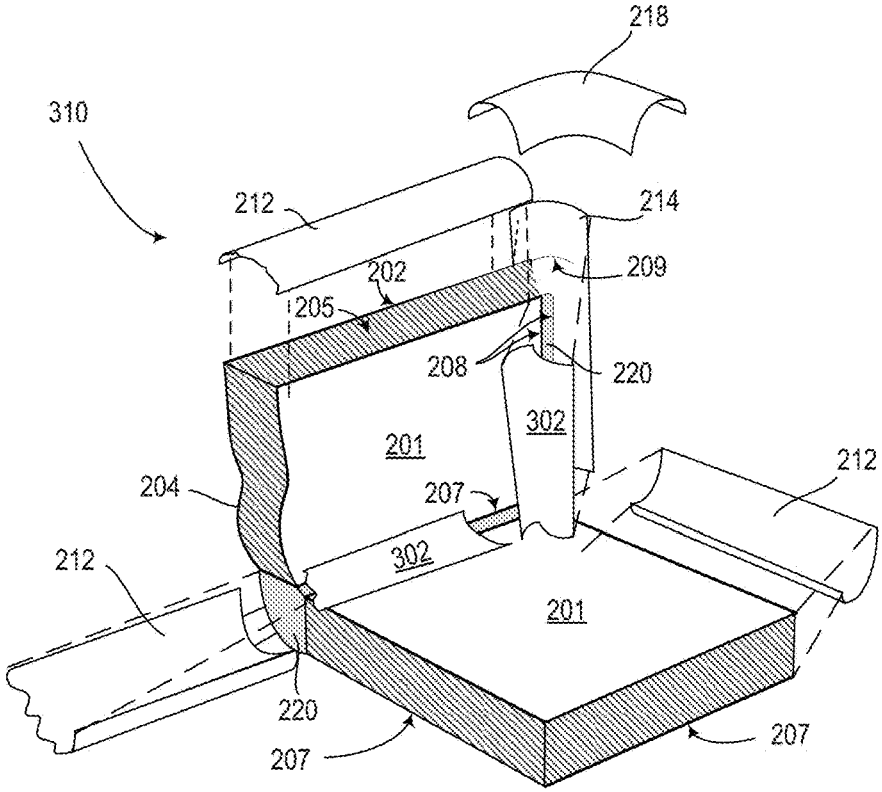
FIG. 3B shows a partially exploded view of a drop-stitch fabric scored and sealed via a fourth method for use as an inflatable cooler.
Figure 4:
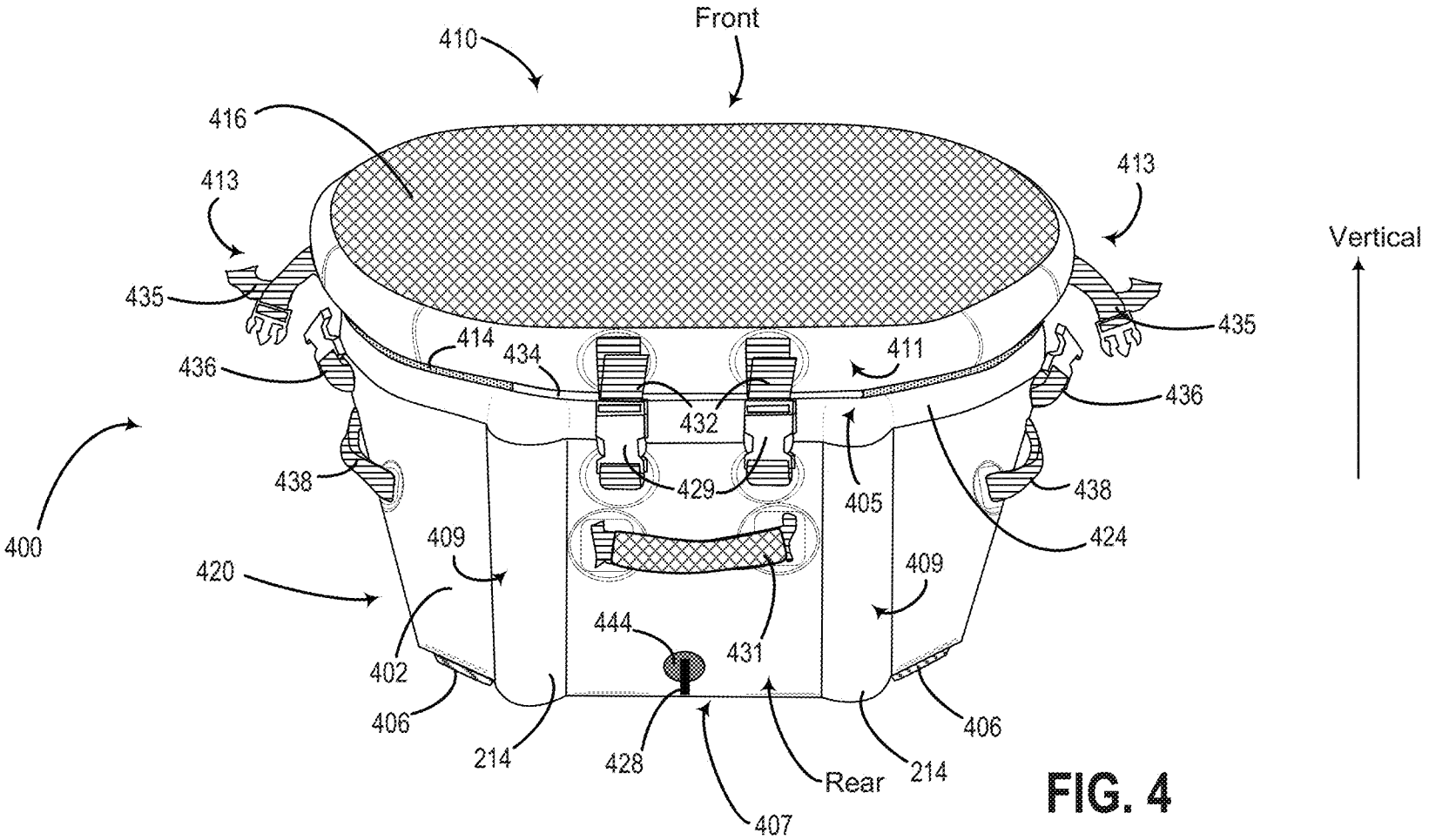
FIG. 4 shows a rear, closed view of a first embodiment of an inflatable cooler.
Figure 5:
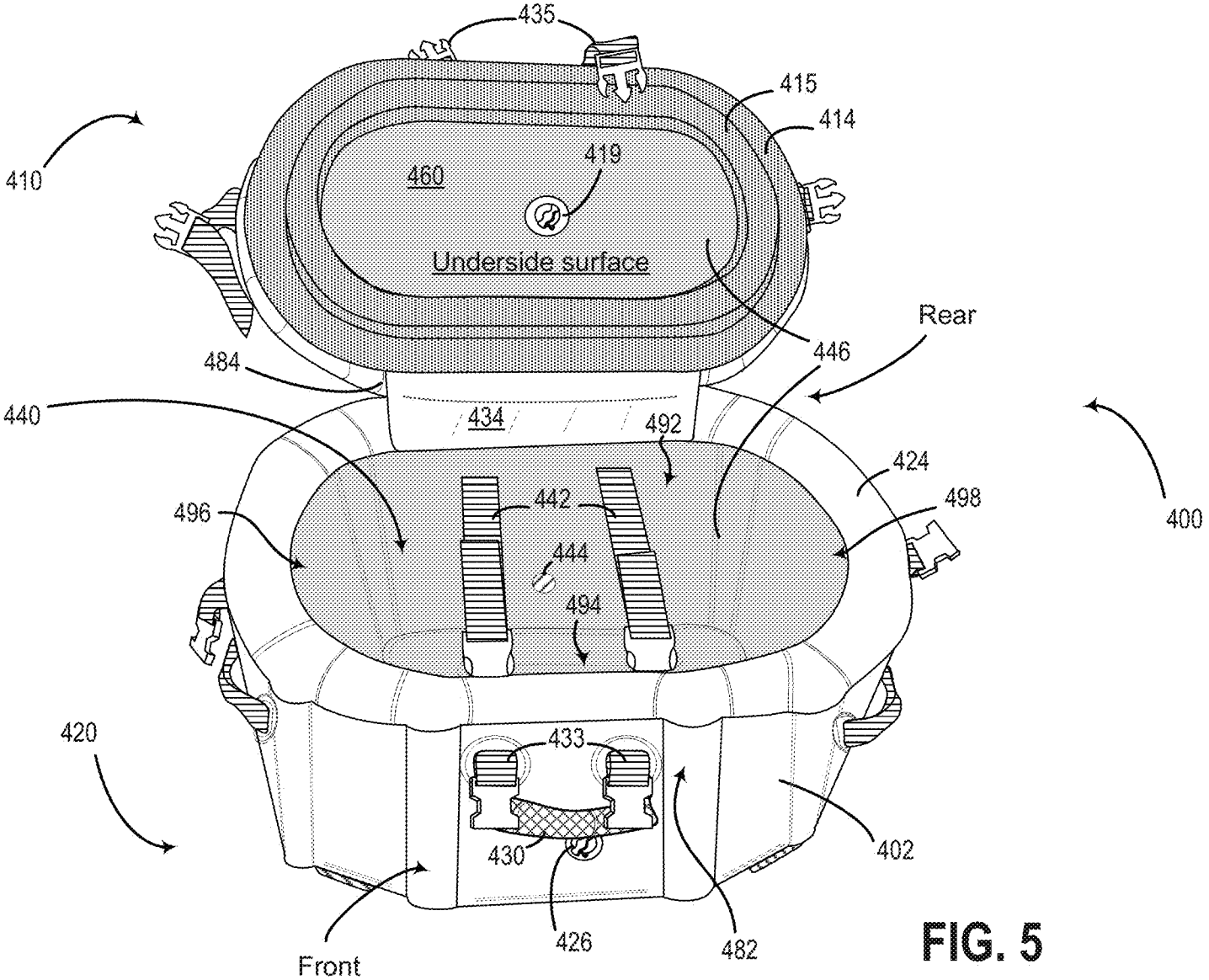
FIG. 5 shows a front, open view of the first embodiment of an inflatable cooler.
Figure 6:
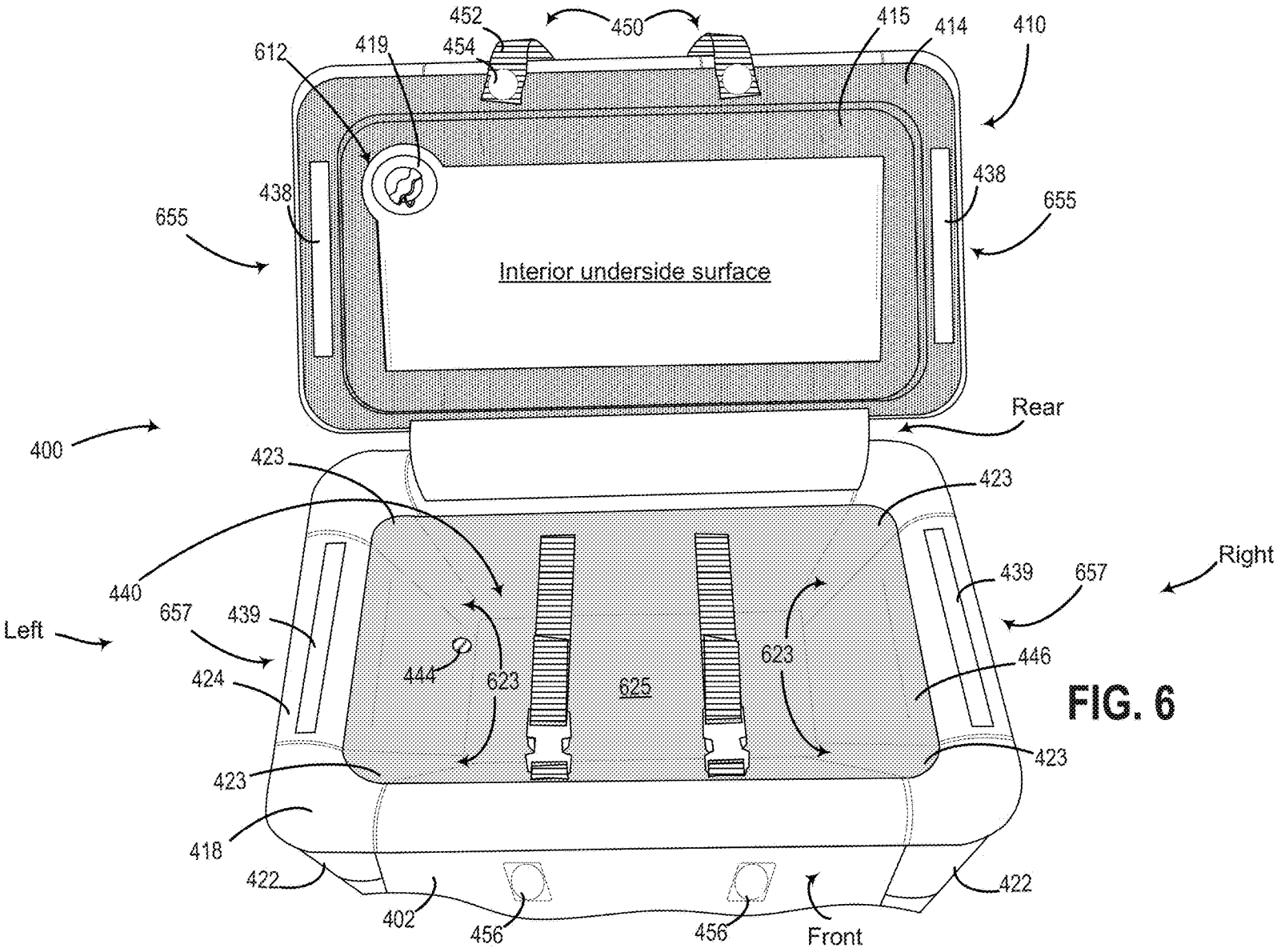
FIG. 6 shows a front, open view of the first embodiment of an inflatable cooler including example magnetized sealing mechanisms.
Figure 7:
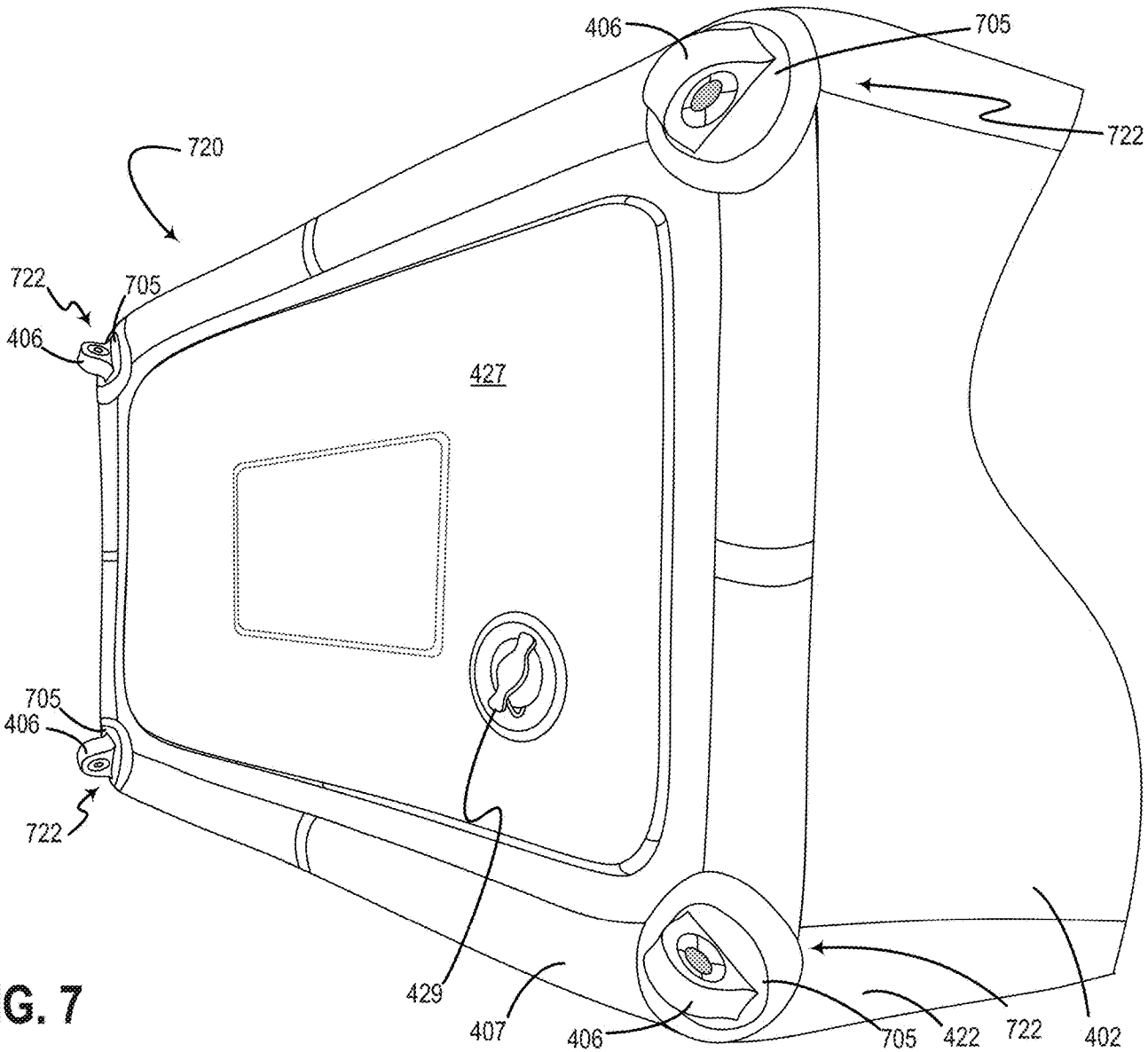
FIG. 7 shows a view of an example bottom of the first cooler embodiment.
Figure 8:
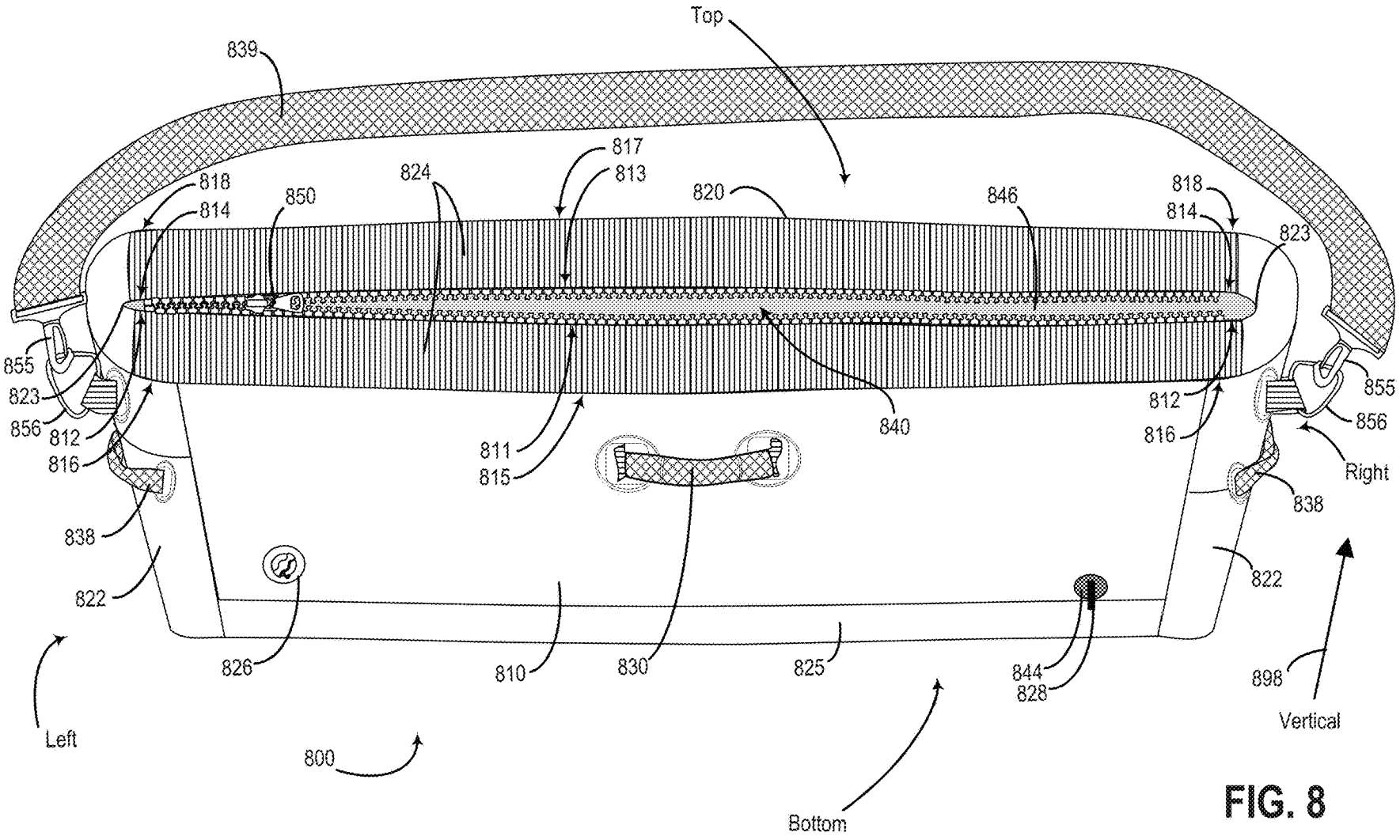
FIG. 8 shows a top-down view of a second example inflatable cooler embodiment.
Figure 9A:
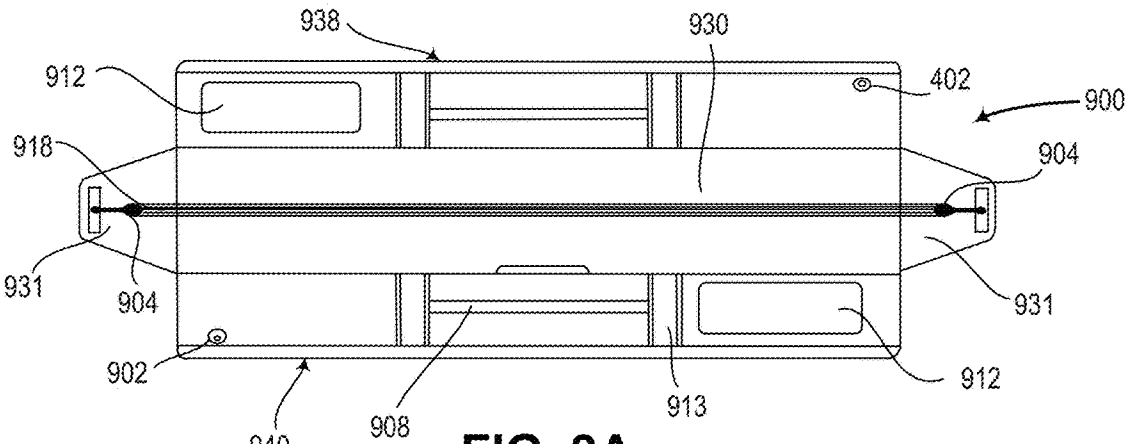
FIG. 9A shows a top-down view of a third example inflatable cooler embodiment.
Figure 9C:
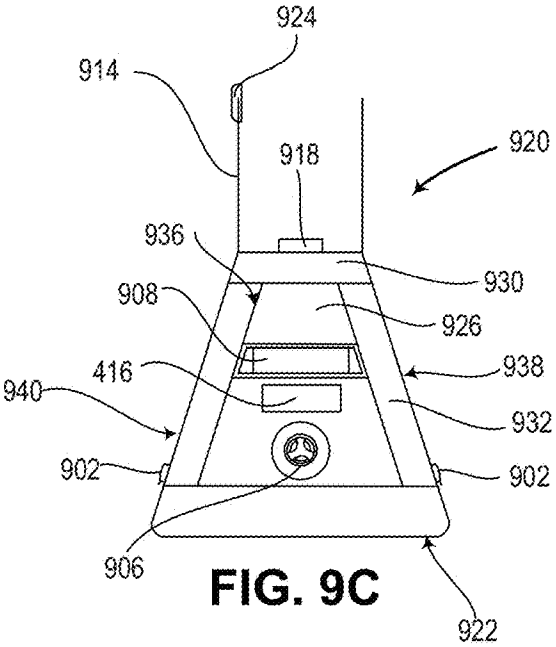
FIG. 9C shows a side profile view of a third inflatable cooler embodiment.
Figure 9B:
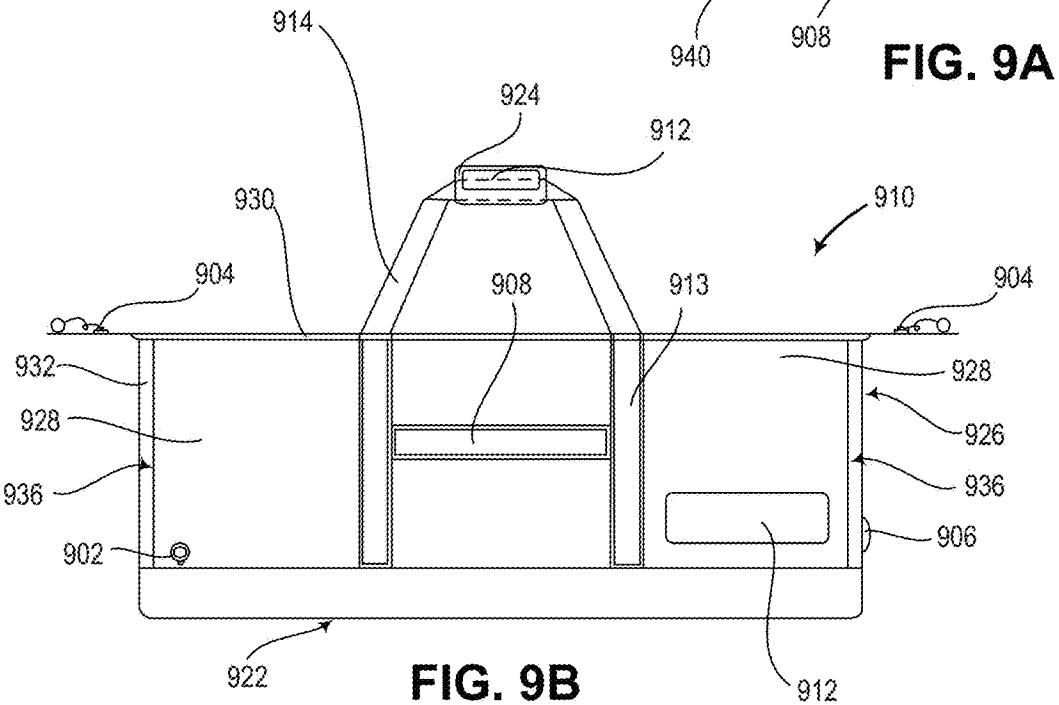
FIG. 9B shows a front profile view of a third example inflatable cooler embodiment.
Figure 10A:
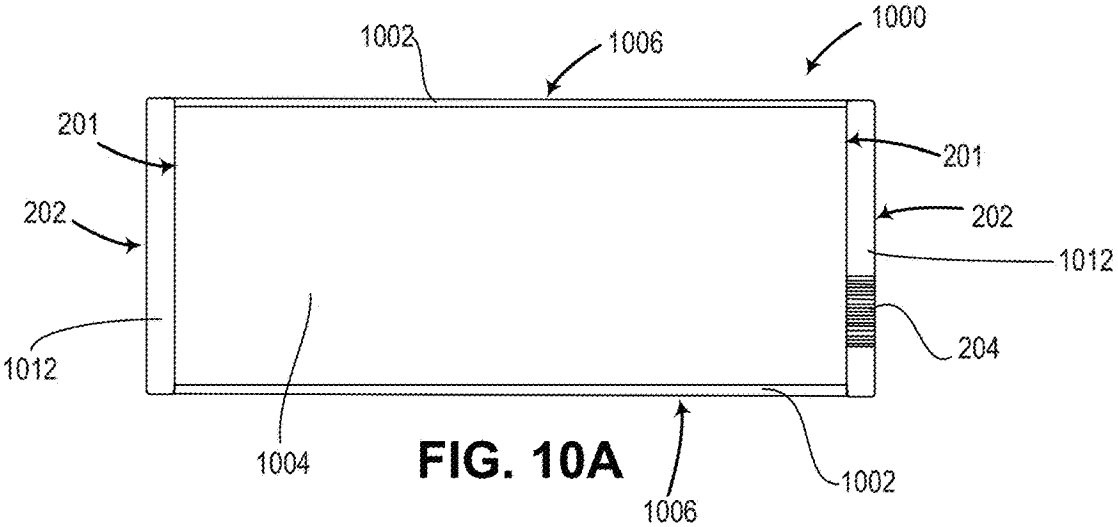
FIG. 10A shows a top-down view of a cutaway section of a third inflatable cooler embodiment.
Figure 10B:
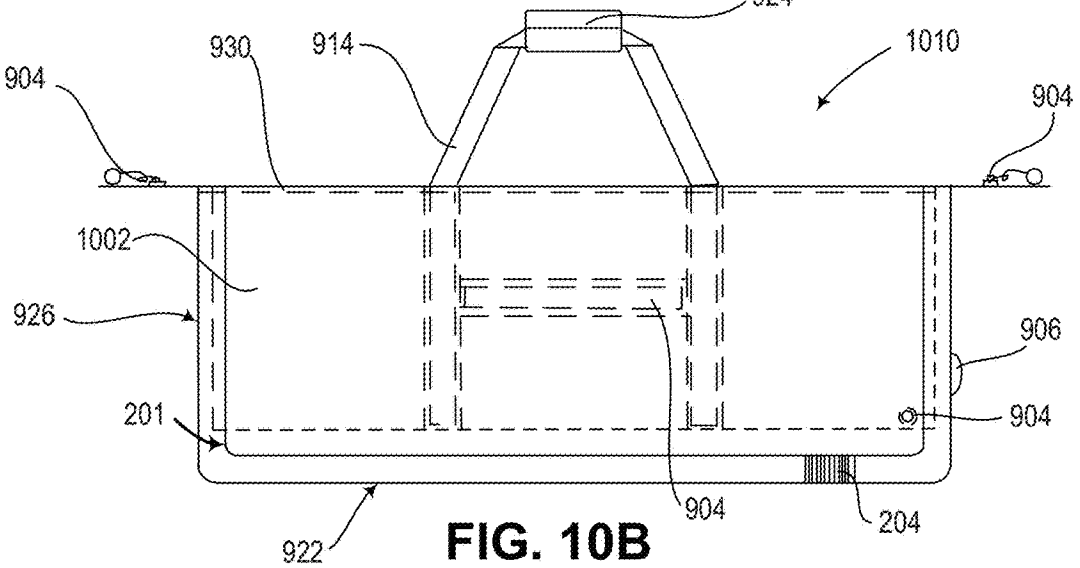
FIG. 10B shows a front profile view of a cutaway section of a third inflatable cooler embodiment.
Figure 10C:
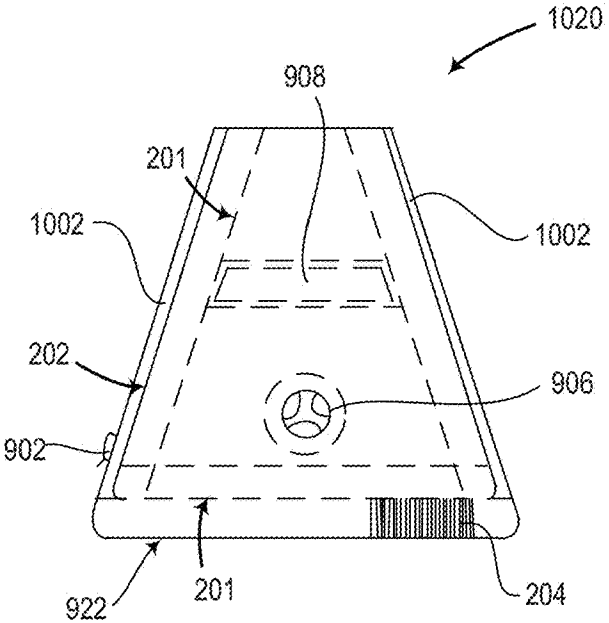
FIG. 10C shows a side profile view of a cutaway section of a third inflatable cooler embodiment.
Figure 17:
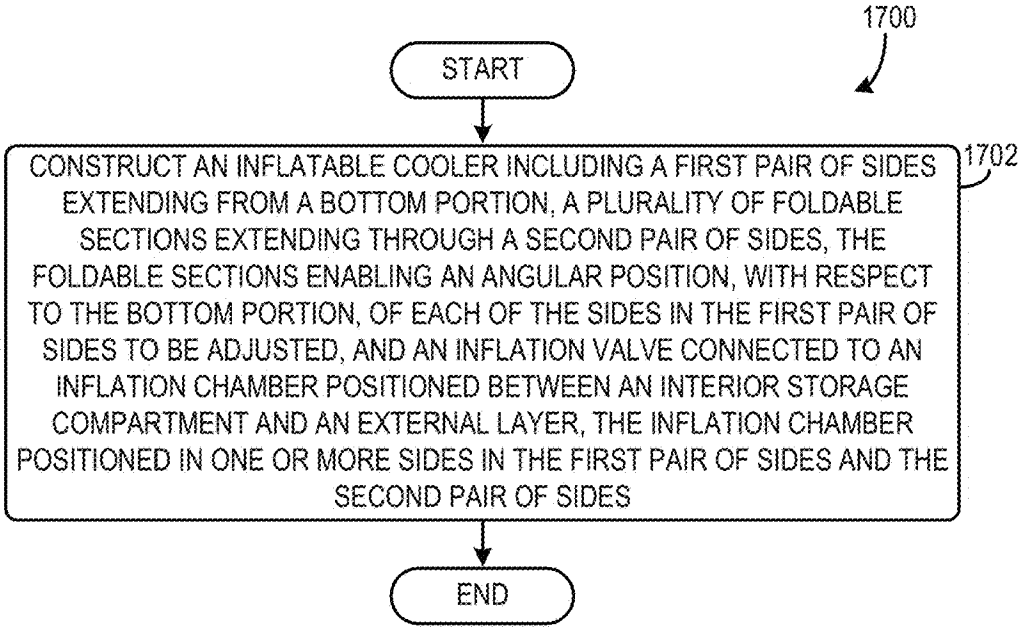
FIG. 17 shows a method for manufacturing an inflatable cooler.

The following description relates to systems and methods for an inflatable cooler constructed from a drop-stitch fabric. Throughout the description, the same reference characters are used to identify common elements across multiple images of each inflatable cooler embodiment. FIG. 1A shows details of an example drop-stitch fabric which includes a drop-stitching coupling a first and second surface at a desired separation distance. FIG. 1B shows a partially exploded view of a component of the first and second surfaces of the drop-stitch fabric shown in FIG. 1A. FIGS. 2A and 2B respectively show drop-stitch cooler walls constructed via first and second methods for scoring and sealing the drop-stitch fabric. FIGS. 3A and 3B respectively, show drop-stitch cooler walls constructed via third and fourth methods for scoring and sealing the drop-stitch fabric. FIG. 4 shows a rear view of a first embodiment of an inflatable cooler, wherein the cooler comprises each of a cooler body and a cooler lid. FIGS. 5-6 show front views of the first cooler embodiment, indicating features of the storage compartment and various sealing mechanisms that may be included to seal the storage compartment. FIG. 7 shows a bottom view of the first inflatable cooler embodiment, highlighting the interchangeable foot elements that may be included therein. FIG. 8 shows a top-down view of a second inflatable cooler embodiment, wherein the cooler comprises each of a first face and a second face defining a storage compartment therebetween, said faces nonreleasably coupled at three adjacent ends and releasably coupled at a fourth end. While multiple embodiments are shown of differing cooler configurations, it should be appreciated that the present application contemplates combinations of features across the different embodiments, as explicitly described below. FIGS. 9A-9C show a third example inflatable cooler embodiment. FIGS. 10A-C show cutaway section views of a third example inflatable cooler embodiment and FIGS. 11A-C and 12A-C display a fourth example inflatable cooler embodiment. FIGS. 13A-13C provide a plurality of views of a fifth inflatable cooler embodiment. Isometric views of a sixth inflatable cooler embodiment are provided in FIGS. 14A-C. FIGS. 15A-15D show a seventh inflatable cooler embodiment. FIG. 16 shows a cross-section of the seventh embodiment of the inflatable cooler. FIG. 17 shows a method for manufacturing an inflatable cooler. Finally, FIGS. 18A-18D show an eighth inflatable cooler embodiment.

Turning now FIG. 1A, it shows a cross section of a drop-stitch fabric 100, as the term is used herein. The drop-stitch fabric may be used to form at least a body of an inflatable cooler. It will be noted that the terms "inflatable cooler" and "cooler" may be used interchangeably to represent the inflatable cooler described in the present disclosure. The drop-stitch fabric of the cooler body may include a double-wall construction having a first surface 110 and a second surface 120. The first surface 110 may comprise a base cloth 112, an inner layer 114, and an outer layer 116, and the second surface 120 may comprise a base cloth 122, an inner layer 124, and an outer layer 126. It will be appreciated that drop-stitch fabric 100 may be used in the manufacturing of each cooler embodiment contemplated herein.

Base cloths 112 and 122 may be tethered via drop stitches 104 to provide a double-wall material of a specified thickness when inflated to a desired pressure. A space 102 may be located between base cloths 112 and 122. As one example, each of base cloths 112 and 122 may be constructed from a polyester material. However, it will be appreciated that in other examples, alternative suitable materials may be used. Drop stitches 104 may also be constructed from a polyester material, although the weight of the drop stitch material may differ from the weight of the material of the base cloths.

The drop stitching may extend through at least a portion of base cloth 112, along the space 102 and through at least a portion of base cloth 122. Drop stitches 104 may comprise a dense array of stitches, and these stitches may be in a linear, zigzag, or random pattern with a stitch density within a range of 6-45 stitches per square inch. The space 102 between the base fabrics 112 and 122 may comprise the drop-stitching thread 104 and air. The space between base fabrics 112 and 122 may be adjusted based on a degree of inflation of the walls of the cooler. As one example, the drop-stitch 104 may be in the range of 5-7 centimeters when the cooler is at the desired degree of inflation, the desired degree of inflation determined based on one or more of a desired rigidity of the cooler shape and the shear modulus of the drop-stitch fabric. In other words, the spacing between base layer 112 and base layer 122 may be in the range of 5-7 centimeters when the cooler is at the desired degree of inflation. In this way, a cooler constructed from a drop-stitch fabric may be flexible and compressible when in a deflated state, providing improved portability. Further, the cooler may form a rigid shape when in an inflated state to provide a reliable sturdiness, tensile strength, and the ability to store both fluids and solid objects within the walls of the cooler.

It will be noted that the drop-stitch 104 and the space 102 may be exposed when drop-stitch fabric 100 is constructed. Thus, the exposed edges of the drop-stitch fabric may be sealed before use as an inflatable chamber, as is described in further detail below with reference to FIGS. 2A-B.

Inner layers 114 and 124 may be colligated in face-sharing contact to respective base cloths 112 and 122 via the use of adhesives, heat fusion, and/or a combination thereof. Similarly, inner layers 114 and 124 may be colligated in face-sharing contact to respective outer layers 116 and 126 via adhesives, heat fusion, and/or a combination thereof. In one example, the inner layer 114 may be colligated to base cloth 112 via heat fusion. At the same time, the inner layer 114 may be colligated to the outer layer 116 via adhesives. Inner layers 114 and 124 may be constructed from a reinforced polyvinyl chloride (PVC) material, or alternatively may be constructed from one of polyurethane (e.g., a thermoplastic polyurethane TPU) or Hypalon. By colligating an inner layer 114 or 124 to a respective base stitching layer 112 or 122 of the drop-stitch fabric, durability of the stitching may be improved.

As described in further detail with reference to FIG. 1B, outer layers 116 and 126 may be manufactured from a multi-component fabric comprising an inner fabric sandwiched between two identical outer fabrics. When a drop-stitch fabric 100 is utilized to manufacture an inflatable cooler as described herein, outer layers 116 and 126 may comprise at least a portion of the exterior surfaces of the cooler. For this reason, the identical outer fabrics may be chosen to be a durable material such as PVC.

Turning now to FIG. 1B, it shows a partially exploded, cross-sectional view of a fabric 106, which in some examples may be used as the material for outer layers 116, 126 of drop-stitch fabric 100. Fabric 106 may include outer fabric 107, which may provide a cooler with improved durability against any abrasion, extreme conditions, or hazardous materials. As one non-limiting example, outer fabric 107 may be a PVC material. However, in other examples, outer fabric 107 may be formed from one of TPU, polyurethane, or Hypalon material. Fabric 106 may further include inner fabric 108. Inner fabric 108 may be a polyester material woven into a grid structure, and may provide fabric 106 with dimensional stability, tensile strength, and tear strength. Each face of inner fabric 108 may be colligated to a face of an outer fabric 107 via heat fusion, liquefaction of the outer fabric 107, adhesives, and/or a combination thereof. Thus, fabric 106 may comprise a dimensionally stable layer (e.g., inner fabric 108) sandwiched between two layers (e.g., outer fabric 107) of a material resistant to degradation. By including the multi-component fabric in the construction of an inflatable cooler, the durability and rigidity of the cooler may be improved.

One object of the present invention is to provide an inflatable cooler wall constructed from a drop-stitch fabric and comprising a single inflatable chamber. As used herein, the inflatable cooler wall refers to an entire perimeter of the cooler, and the inflatable cooler wall may comprise a plurality of cooler wall faces. A drop-stitch fabric may not be immediately suitable for use as a cooler wall at least for the reasons of the exposed drop stitching along the edges of the fabric and the rigidity provided by the outer layer of the drop-stitch fabric, as described above with reference to FIGS. 1A-B. Specifically, constructing a cooler wall from a single piece of drop-stitch fabric may include creating bends in the drop-stitch fabric along one directional extent of the fabric at a plurality of desired locations in order to construct a continuous perimeter of the cooler. Further, the drop-stitch fabric may require sealing of the exposed edges of the fabric in order to be used as an inflatable chamber. As such, it may be desirable to score the drop-stitch fabric along one directional extent at the plurality of desired bending locations, and may be further desirable to seal any exposed drop-stitching to form an inflatable chamber from the drop-stitch fabric. FIGS. 2A-B show two example cooler walls constructed from a drop-stitch fabric, showing details of the example scoring and sealing processes. It will be understood that the cooler walls of FIGS. 2A-B may be walls of any of the cooler embodiments contemplated herein.

Turning to FIG. 2A, it shows an exploded view of a portion of a cooler wall 200 comprising a drop-stitch fabric, such as drop-stitch fabric 100 of FIG. 1A, constructed via a first method of scoring. A first outer layer 202 of the drop-stitch fabric is shown, and it will be understood that a second outer layer 201 of the double-wall construction is on the reverse face of the wall. First outer layer 202 and second outer layer 201 are relatable to first outer layer 116 and second outer layer 126 respectively, or vice versa. Thus, first outer layer 202 may form an exterior surface of the inflatable cooler wall while second outer layer 201 may form an interior surface of the inflatable cooler wall. The drop-stitch fabric may be scored along the entirety of its lesser extent at a desired location of a bend 209 in the cooler wall. As one example, the lesser extent of the drop-stitch fabric is along the axis that runs along the surface of the cooler wall and is perpendicular to the extent of the cooler wall perimeter. In this first method, the drop-stitch fabric is scored on a convex face of the bend 209, and not on a concave face of the bend 209. In one example, the bend/corner may be free of drop stitches as illustrated in the figure. However, in other examples, the bend/corner may include drop stitches. Note that the figures may illustrate the location of drop stitches via the repeated lines, and the absence of drop stitches by the absence of such lines.

In another example, the first outer layer 202 of the drop-stitch fabric, composing the exterior face of the cooler wall, is scored and the second outer layer, composing an interior face of the wall, is not scored. By scoring the drop-stitch fabric along the exterior face of the cooler wall and not the interior face of the cooler wall, the compliancy of the drop-stitch fabric may be improved while maintaining a level of rigidity within the inside of the cooler, where the walls may be subject to greater stress when storing contents.

The drop-stitch fabric is shown with scored edges 208 and an exposed area 206 formed from the separation of scored edges 208. As one example, the scoring of the drop-stitch fabric may comprise creating an incision through only outer layer 202. In such an example, exposed area 206 may comprise the inner layer of the drop-stitch fabric (i.e., inner layers 114, 124 at FIG. 1A). As another example, the scoring of the drop-stitch fabric may comprise creating an incision through each of the outer layer and the inner layer, thereby exposing the base cloth (i.e., layers 112, 122 at FIG. 1A). In such an example, exposed area 206 may comprise the base cloth. As yet another example, the scoring of the drop-stitch fabric may comprise creating an incision through each of the outer layer, the inner layer, and the base cloth. In such an example, exposed area 206 may comprise drop-stitching 204 and air.

Drop-stitching 204 and exposed area 206 may be sealed by a plurality of sealing fabrics to form a sealed inflatable chamber. As one example, each sealing fabric may be a PVC material. The plurality of sealing fabrics may seal each exposed drop stitching area and each surface that may have been exposed as a result of the scoring process described above. Along any desired bends in the drop-stitch fabric, an additional piece of sealing fabric may be colligated to exposed faces adjacent to the scored edge, thereby providing further strength to the air seal. Each sealing fabric may be affixed to the first outer layer 202 and second outer layer 201 (e.g. an inner and an outer wall of the inflatable cooler) via adhesives, heat fusion, and/or a combination thereof. In the example of affixing the sealing fabrics to the first and second outer fabric layers via an adhesive, the adhesive may be applied only to those surfaces that will be in face-sharing contact. Dashed lines in FIG. 2A indicate example positions at which the plurality of sealing fabrics may be affixed to the first outer layer 202 and second outer layer 201 in an unexploded view of cooler wall 200. It will be understood that the sealing fabric may be continuously affixed to the first and second outer layers 202 and 201 respectively along the entire extents of face-sharing contact.

For instance, edge seals 212 may be affixed to first outer fabric layer 202 and second outer layer 201 via an adhesive, and may span from the second outer layer 201 of the interior surface of the wall to the first outer layer 202 forming the exterior surface of the wall along a direction substantially parallel to the drop-stitching (such as, along an axis normal to the surface of the cooler walls). Edge seals 212 may be positioned along the top edge 205 and bottom edge 207 of the cooler wall, terminating near any bend in the drop-stitch fabric. As shown in FIG. 2A, edge seals 212 are positioned along top edge 205 and bottom edge 207 until bend 209. Edge seals may not be used along bend 209. As used herein, the top and bottom edges of the cooler wall refer to the faces of the drop-stitch fabric that are not spanned by any of the base cloth, inner layer, or outer layer (e.g., elements 112/122,114/124, and 116/126 of FIG. 1A), and that extend along the entire perimeter of the cooler walls when the walls are constructed.

As indicated by the cut-out edges of each edge seal 212, edge seals 212 may extend along the cooler wall perimeter from a first bend in the cooler wall to a second bend in the cooler wall, the second bend separated from the first bend by a single substantially straight cooler wall perimeter section. In another example, a cooler wall 200 may comprise a first edge seal 212 extending along the entire perimeter of the top edge 205 of the cooler wall, and a second edge seal 212 extending along the entire perimeter of the bottom edge 207 of the cooler wall. Edge seals 212 may be provided to the drop stitch fabric of any inflatable chamber of a cooler embodiment, and not only to inflatable chambers including scored edges 208 as shown at FIGS. 2A-B.

Outer scoring seal 214 may span each exposed area 206 of the cooler wall. Outer seal 214 may be affixed to first outer layer 202, spanning the cooler wall perimeter for at least a distance beyond each scored edge 208 of a single incision. Outer scoring seal 214 may also span the entire vertical extent of the cooler wall, e.g. from top edge 205 to bottom edge 207, along the scored edge 208. An outer scoring seal 214 may be provided for each scored edge of the cooler wall 200.

Corner seals 218 may be affixed to each of the top edge 205 and bottom edge 207 of the cooler wall at each bend (e.g. bend 209) along the perimeter of the cooler wall. In some cooler embodiments, corner seals 218 may additionally be provided at an interface between two inflatable chambers, at the top and bottom edges of the interface, and spanning from the first inflatable chamber to the second inflatable chamber. As shown at FIG. 2A, and as indicated by the dashed lines therein, corner seals 218 may be affixed to each of two adjacent edge seals 212, outer scoring seal 214, and to the second outer layer 201 forming the interior surface of the cooler wall. In other examples, corner seals 218 may instead be affixed to one or more edge seals 212, to scoring seals 214, to one or more outer layers of each surface of the cooler wall, and/or to a combination thereof.

Corner seals 218 may be provided along each of the top edge 205 and bottom edge 207 of the cooler walls. Along each of the top edge 205 and the bottom edge 207, corner seals 218 may extend at least from an end of a first edge seal 212 to an adjacent end of a second edge seal 212, as indicated by dashed lines at FIG. 2A. Thus, corner seals 218 may overlap at least a section of each adjacent edge seal 212. In other examples, corner seals 218 may span at least the distance between two adjacent scored edges 208. In some examples, corner seals 218 may be affixed to each adjacent edge seal 212 via an adhesive, as indicated by the dashed lines beginning at the bottom surface of each corner seal and terminating at outer surfaces of adjacent edge seals. Furthermore, corner seals may span from the second outer layer 201 of the interior surface of the wall to the first outer layer 202 of the exterior surface of the wall along the direction of the drop-stitching 204 in a similar manner to edge seals 212. Specifically, corner seals 218 placed over top edge 205 may extend from second outer layer 201, over top edge 205, to first outer layer 207. Further, corner seals 218 arranged over bottom edge 207 may extend from second outer layer 201, over bottom edge 207, to first outer layer 202. In some examples, an inner surface of corner seal 218 may be affixed to an exterior surface of outer scoring seal 214, thereby providing further strength to the sealing of the exposed area 206. As such, corner seal may overlap at least a portion of outer scoring seal 214.

Turning now to FIG. 2B, it shows an exploded view of a cooler wall 210 comprising a drop-stitch fabric, constructed via a second method of scoring. Cooler wall 210 shares many features with cooler wall 200 and the same reference characters will be used to identify these common features. It will be understood that the details of the common features as described above with reference to FIG. 2A are applicable to the cooler wall 210 as constructed via the second method of scoring unless otherwise specified. According to the second method of scoring, the drop-stitch fabric may be scored along the entirety of its lesser extent (e.g. spanning top edge 205 to bottom edge 207) at the desired location of a bend 209 in the cooler wall. In this second method of scoring, the drop-stitch fabric is scored on each of the convex surface and the concave surface of the bend. Put another way, each of the first outer layers 202 and second outer layers 201 of the drop-stitch fabric are scored where a bend 209 is desired in the cooler wall perimeter. The scoring on each outer layer may be on opposite surfaces of the drop-stitch fabric at a common lesser extent of each outer layer. As one example, the lesser extent may be along an axis that runs along the surface of the cooler wall and that is perpendicular to the extent of the cooler wall perimeter. For example, the lesser extent may be the shortest distance between top edge 205 and bottom edge 207 of the cooler wall 210. By scoring the drop-stitch fabric along each of the outer and inner surfaces of the cooler wall, the compliancy of the drop-stitch fabric may be improved. Furthermore, the scoring of the drop-stitch fabric along each of the outer and inner surfaces of the cooler wall may increase the stability and rigidity of the cooler while providing additional strength to bends in the cooler wall shape.

Cooler wall 210, accordingly, includes four scored edges 208 per bend in the wall: two on the concave side of the bend 209 in the cooler wall (as shown in exploded view 210 of FIG. 2B), resultant from an incision along the vertical extent of the inner surface (e.g. second outer layer 201) of the cooler wall, and two on the convex side of the bend 209 in the cooler wall (as shown in exploded view 200 of FIG. 2A), resultant from an incision along the vertical extent of the outer surface (e.g. first outer layer 202) of the cooler wall. Similar to cooler wall 200, the scoring of cooler wall 210 may include creating incisions through one or more of the outer layers (such as 116 and 126 of FIG. 1A), the inner layers (e.g. 114 and 124 of FIG. 1A), and the base cloths (e.g. 112 and 122 of FIG. 1A) of each cooler wall surface. As such, exposed area 256 on the concave side of bend 209 may comprise one or more of air and drop stitching, the base cloth, and the inner layer of the double-wall drop-stitch construction.

Inner scoring seal 216 may span exposed area 256 along the concave surface of second outer layer 201 of cooler wall. Inner scoring seal 216 may be affixed to the second outer layers 201, spanning the cooler wall perimeter for at least the distance between each scored edge 208 of a single incision. To elaborate, inner scoring seal may substantially cover exposed area 256 of the concave side of bend 209 as well as extend beyond scored edges 208 on each side of exposed area 256. Inner scoring seal 216 may also span the entire vertical extent of the cooler wall e.g. from top edge 205 to bottom edge 207 of cooler wall. Outer scoring seal 214 may be provided for each scored edge of the cooler wall 200 on the convex surface of bend 209 as described above with reference to FIG. 2A.

Corner seals 218 may be provided along the top and bottom edges of the cooler wall 210, as described earlier for FIG. 2A. Along each of top edge 205 and bottom edge 207, corner seals 218 may extend at least from an end of a first edge seal 212 to an adjacent end of an adjacent second edge seal 212, as shown at FIG. 2B. Thus, corner seals 218 may overlap at least a portion of each edge seal 212. In other examples, corner seals 218 may span at least the distance between two adjacent scored edges 208. In some examples, corner seals 218 may be affixed to each adjacent edge seal 212 (e.g., via an adhesive), as indicated by dashed lines beginning at each corner seal and terminating at edge seals. Furthermore, corner seals 218 may span from the second outer layer 201 of the inner surface of the wall to the first outer layer 202 of the outer surface of the wall along the direction of the drop-stitching in a similar manner to edge seals 212. In some examples, the inner surface of corner seal 218 may be affixed to the exterior surfaces of each scoring seal 214, 216 to provide further strength to the sealing of the exposed area 206.

Thus, exploded view 200 of a cooler wall may include a plurality of sealing pieces such as edge seals 212, corner seals 218, and outer scoring seals 214. Further, exploded view 210 of a cooler wall formed using the second method of scoring may include an additional sealing piece for an inside concave surface of each bend in the cooler, e.g. inner scoring seals 216. Specifically, exploded view 210 of the cooler wall includes a plurality of sealing pieces comprising edge seals 212, corner seals 218, outer scoring seals 214, and inner scoring seals 216.

A first cooler embodiment disclosed herein may include a lower section and an upper section, each section optionally constructed from the drop-stitch fabric described with reference to FIGS. 1A and 1B. The lower section, also referred to herein as the cooler body, may comprise each of a bottom inflatable chamber and a side inflatable chamber. When inflated, the side inflatable chamber may form a continuous wall along an outer perimeter of the bottom chamber, and may extend outward from the surface normal of the bottom inflatable chamber. In other words, the side inflatable chamber may be arranged in a continuous manner along an exterior perimeter of the bottom inflatable chamber, and may also extend upwards (e.g. in a perpendicular direction relative to the bottom inflatable chamber) from the periphery of the bottom inflatable chamber. For example, the bottom inflatable chamber, when inflated, may lay in a horizontal direction, and the side inflatable chamber, when inflated, may rise vertically relative to the bottom inflatable chamber. The side inflatable chamber may form all sides of the cooler except for the top and the bottom of the cooler. Further, the side inflatable chamber may be formed from a single, contiguous sheet of drop-stitch fabric.

The bottom inflatable chamber may be one of a number of shapes, including but not limited to a rectangle or an oval. As one example, the shape of the bottom chamber may be created by cutting a sheet of drop stitch fabric to a desired shape, then sealing the edges of the drop-stitch fabric as described above with reference to FIGS. 2A-B.

In some examples, the side inflatable chamber may be shaped as a ring matching the shape of the bottom inflatable chamber. Bends in the wall formed by the side inflatable chamber may be achieved via one of the two scoring methods described above with reference to FIGS. 2A and 2B, thereby allowing the single sheet of drop-stitch fabric to conform to a desired shape of the cooler wall. By reducing the amount of interfacing material between separate components of drop-stitch fabric, the water-tightness and durability of the cooler body is improved. By constructing the cooler wall from a single inflatable chamber, ease and speed of inflating the cooler may be increased.

The upper and lower sections of a first inflatable cooler embodiment may each include an exterior fabric designed to accommodate various components of the cooler while protecting the drop-stitch fabric from excessive wear. For example, the exterior fabric may be PVC and may be affixed to the cooler body via adhesives, heat sealing, and/or combinations thereof. However, in other examples, at least a portion of the outer surfaces of the cooler may comprise the outer layer of the drop-stitch fabric (as described above with reference to FIGS. 1A-B). In some examples, one or more of the upper and lower sections may include an insulating layer of fabric extending along the interior surfaces which define the internal storage compartment of the cooler. As one example, the insulating layer may be constructed from one of Mylar, Melinex, etc.

The cooler body, also termed the lower section, may comprise a first and second inflatable chamber. As an example, the first inflatable chamber may be the bottom inflatable chamber as described above, and the second inflatable chamber may be the side inflatable chamber as described above. The first and second inflatable chambers may be integrated to form a contiguous cooler body. As one example, the bottom inflatable chamber may be positioned in face-sharing contact with the side inflatable chamber along the entire perimeter of the cooler walls, and may also be flush with a bottom portion of an inner surface of each cooler wall face. In this way, the inner surfaces of the cooler wall (or the side inflatable chamber) and the top surface of the bottom inflatable chamber may together form a storage compartment or storage compartment for storing contents.

The upper section may comprise a single inflatable chamber of a similar shape to the bottom inflatable chamber. Adhesives, heat sealing, interfacial sheets of fabric, and/or a combination thereof may be used to securely integrate the bottom inflatable chamber to the side inflatable chamber forming a single lower section comprising a first and second inflatable chamber. Said integration may be implemented on each of the exterior and interior surfaces of the cooler body. In this way, by securely integrating the bottom inflatable to the side inflatable chamber, stability and rigidity of the lower section may be increased when each inflatable chamber is inflated. Rigidity and stability may be desired in a cooler for accommodating sitting and/or standing on the cooler.

The lower section may be configured to store liquids and solid objects when the bottom chamber and the side chamber are inflated to form a storage compartment within the lower section. In such a configuration, an open region may be formed vertically above the bottom inflated chamber and within the perimeter of the inflated side chamber wall. This open region may act as the storage compartment provided by the lower section. The upper section may provide a cover for the open region of the storage compartment. Further, sealing mechanisms may be integrated into each of the upper and lower sections, as described in further detail below, to enable covering of the open region (or storage compartment). Herein, the upper section may be positioned atop the lower section to cover the storage compartment, and the sealing mechanisms may be actuated to seal the storage compartment. Thus, the upper section can also be referred to as the lid of the inflatable cooler. Further, the storage compartment may herein be referred to as an internal storage compartment, as it may comprise a space internal to the cooler structure when the compartment is covered.

As used herein, the terms "convex surface", "exterior surface", and "outer surface" are used to refer to examples of the surfaces of the cooler that are exposed to the surroundings and atmosphere when the inflated cooler is shut. Further, the terms "concave surface", "interior surface", and "inner surface" are used to refer to examples of the surfaces of the cooler that are concealed when the lid of the inflated cooler is shut and closed. For example, with reference to the double-wall drop-stitch construction of the cooler, when the cooler is configured to store liquids, the outer surfaces of the cooler include an exterior surface of the bottom of the cooler (e.g., an exterior bottom surface of the bottom chamber), a first outer layer of the side inflatable chamber wall (e.g., outer layer 202 at FIG. 2A), and the exterior surface or top surface of the lid. Also in this example, the inner surfaces of the cooler include the top wall (or an interior surface) of the bottom inflatable chamber, a second outer layer of the side inflatable chamber wall (e.g., outer layer 201 at FIG. 2A), and the bottom or inside surface of the lid. As such, the inner surfaces of the cooler will be in direct contact with the stored liquid within the cooler whereas the outer surfaces will not be in direct contact with the stored liquid inside the cooler.

It will be appreciated that when the inflated cooler is shut after inflating, the lid of the cooler (also termed, upper section) rests atop the cooler body (also termed, lower section) closing the storage compartment formed within the cooler body when inflated. As such, the storage compartment in the cooler body may be isolated from the surroundings (including air) when the lid of the cooler is closed and the cooler is shut.

In some examples of the first cooler embodiment, the lid may be coupled via one or more hinges to the cooler body along a longer edge of the cooler body, so that the lid may rotate or swivel about a stationary horizontal axis extending parallel to the longer edge of the side inflatable chamber. For example a sheet of PVC may couple the rear inner wall of the cooler body to the rear outer edge of the bottom surface of the lid, and the lid may pivot about this connecting sheet of PVC. One or more hinges may be configured to connect the lid and cooler body along adjacent longer edges of each component. With such examples, the vertical face of the cooler which includes the hinge is herein referred to as the rear side of the cooler and the vertical face opposite the rear is referred to as the front side of the cooler, in reference to the fact that the cooler is typically opened from the end opposite the hinged end of the cooler.

Turning now to FIG. 3A, it shows a partially exploded view of a cooler wall 300 comprising a drop-stitch fabric 204, constructed via a third method of scoring as described above with reference to FIG. 2. Cooler wall embodiment 300 may share many common features with cooler wall embodiment 200 and the same reference characters will be used to identify these common features throughout the figures and the specification. It will be appreciated that the details of the common features as described above, with reference to FIG. 2 may be applicable to cooler wall 300 as constructed via the method of scoring as mentioned above unless otherwise specified. According to the third method of scoring, the drop-stitch fabric may be scored along the entirety of its lesser extent (i.e. spanning from top edge 205 to bottom edge 207) at the desired location of a bend 209 in the cooler wall. In this third method of scoring, the drop-stitch fabric 204 may be scored on each of the convex surfaces and along the concave surface of the bend 209. Specifically, each of the first outer layers 202 and the first inner layers 201 of the drop-stitch fabric may be scored where a bend 209 is desired in the cooler wall perimeter. The scoring on each outer layer may be on opposite surfaces of the drop-stitch fabric at a common lesser extent of each layer. As one example, the lesser extent may be along an axis running along the surface of the cooler wall and may be perpendicular to the extent of the cooler wall 300 perimeter. For example, the lesser extent may be the shortest distance between top edge 205 and bottom edge 207 of the cooler wall 300. By scoring the drop-stitch fabric along each of the outer and inner surfaces of the cooler wall, the compliancy of the drop-stitch fabric may be improved. Furthermore, the scoring of the drop-stitch fabric along each of the outer and inner surfaces of the cooler wall may increase the stability and rigidity of the cooler while potentially providing additional strength to the bends 209 in the cooler wall shape.

Accordingly, cooler wall 300 may include four scored edges 208 per bend in the cooler wall: two on the concave side of the bend 209 in the cooler wall, resultant from an incision along the vertical extent of the inner surface (e.g. first inner layer 201) of the cooler wall, and two on the convex side of the bend 209 in the cooler wall, resultant from an incision along the vertical extent of the outer surface (first outer layer 202) of the cooler wall. Similar to cooler wall 200, the scoring of cooler wall 300 may include creating incisions through one or more of the outer layers (such as 116 and 126 of FIG. 1A) of each cooler wall surface. As such, exposed area 220 on the concave side of bend 209 may comprise one or more of air and drop-stitching, the base cloth, and the inner layer of the double-wall drop-stitch construction.

Inner scoring seal 302 may span exposed area 220 along the concave surface of first inner layer 201 of the cooler wall. Inner scoring seal 302 may be affixed to the first inner layers 201, spanning the cooler wall perimeter for at least the distance between each scored edge 208 of a single incision. To elaborate, inner scoring seal may substantially cover exposed area 220 of the concave side of bend 209 as well as extend beyond scored edges 208 on each side of exposed area 220. Inner scoring seal 302 may also span the entire vertical extent of the cooler wall e.g. from top edge 205, to bottom edge 207 of a cooler wall. Outer scoring seals 214 may be provided for each scored edge of the cooler wall 300 as described above with reference to FIGS. 2A and 2B.

Corner seals 218 may be provided along the top and bottom edges of the cooler wall 300 as described earlier with reference to FIG. 2. Along each top edge 205 and bottom edge 207, corner seals 218 may extend at least from an end of a first edge seal 212 to an adjacent end of an adjacent second edge seal 212, as shown in FIG. 3A. Thus, corner seals 218 may overlap at least a portion of each edge seal 212. In other examples, corner seals 218 may span at least the distance between two adjacent scored edges 208. In some examples, corner seals 218 may be affixed to each adjacent edge seal 212 (e.g. via an adhesive), as indicated by dashed lines beginning at each corner seal and terminating at edge seals. Furthermore, corner seals 218 may span from the first inner layer 201 of the inner surface of the wall to the first outer layer 202 of the outer surface of the wall along the direction of the drop-stitching in a manner similar to edge seals 212. In some examples, the inner surface of corner seal 218 may be affixed to the exterior surfaces of each scoring seal 214, 302 to provide further strength to the sealing of the exposed area 206.

Thus, exploded views 200, 210, 300, and 310 of a cooler wall may include a plurality of sealing pieces such as edge seals 212, corner seals 218, and outer scoring seals 214. Further exploded views 300 and 310 of a cooler wall formed via a third and fourth method of scoring may include an additional sealing piece in order to seal an interior concave surface of each bend in the cooler body. Specifically, exploded views 300 and 310 of the cooler wall may include a plurality of sealing pieces comprising edge seals 212, corner seals 218, outer scoring seals 214, and inner scoring seals 302.

Similarly to FIG. 3A, FIG. 3B shows a partially exploded view of a cooler wall 310 comprised of a drop-stitch fabric, constructed via a fourth method of scoring and sealing for uses as an inflatable chamber of a cooler. Inflatable chamber embodiment 310 may share many common features with cooler wall embodiments 200, 210, and 300 and the same reference characters will be used herein to identify the common features throughout the figures. According to this method of scoring and sealing, the drop-stitch fabric may be scored along the entirety of its lesser extent at the desired location of a bend 209 in the cooler wall. The drop-stitch fabric 204 may be scored on each of the convex surfaces and along the concave surfaces of the bend 209. As one example of this method of scoring and sealing, cooler wall embodiment 310 may include two opposite side surfaces and a bottom surface, forming a single, continuous inflatable chamber. The side surfaces of the cooler body may comprise the drop-stitch fabric 204 and both of the first outer layer 202 and first inner layer 201 of the drop-stitch construction. Once scored and sealed the inner layers 201 of each section of the cooler body may be coupled via inner scoring seals 302 and may become effectively coupled, providing a single inflatable chamber which may comprise two sides and a bottom surface.

Inner scoring seal 302 of cooler wall 310 may span the interior surface of the cooler wall and may be in direct contact with a first inner layer 201 of the cooler body and may extend across the exposed area 220, reaching the outer scoring seal 214 such that the inner scoring seal 302 and the outer scoring seal 214 may be in direct contact with one another. Edge seals 212 may extend from a bottom edge 207 of the cooler body up to the first outer layer of a portion of the drop-stitch fabric 204 that is placed perpendicular relative to the bottom edge 207 of cooler body 310. A method of sealing scored edges that may not be paired to other sections of drop-stitch fabric is also provided in FIG. 3B.

Edge seals 212 may be placed over exposed edges of the drop-stitch fabric such that the seals may lie in direct contact with the bottom edge 207 of the inflatable chamber and may extend upward, relative to the bottom edge, to be in direct contact with the first inner layer 201 of the cooler body. It will be appreciated that when sealing an exposed side of the drop-stitch fabric, an edge seal 212 may be placed under inner scoring seals 302 and outer scoring seals 214 such that the scoring seals 302 and 214 sandwich the edge seal 212, effectively sealing the exposed edges and exposed area 220. It will be understood that the embodiment provided herein may also employ corner seals 218 similarly to FIG. 3A, wherein the corner seals 218 may sandwich the upper edge seals 212 used to seal the top edge 205 of the cooler body walls, the inner scoring seals 302, and the outer scoring seals 214. It will be appreciated that the cooler embodiments provided herein may employ one or more of the methods for scoring and sealing described above and may include any combinations thereof.

As provided in FIGS. 1A-3B, the drop stitch fabric may be configured to form a plurality of different shapes depending on the method of scoring and sealing used to construct the inflatable chamber defining the cooler body. In some example embodiments, the drop stitch fabric 100 may be fully inflated in at least one section such that the stitches 104 are fully extended and the space 102 between the first surface 110 and the second surface 120 may be substantially rigid when inflated.

For example, when fully inflated, the cooler body, as defined by the drop stitch fabric walls, may be substantially expanded by the force of introduced air such that the drop stitches 104 within the space 102 of the drop stitch fabric 100 are fully extended. In this way, a first surface 110 and a second surface may be substantially supported by the drop stitches 104 and air within the space 102 of the fabric 100.

As shown in FIGS. 3A and 3B, some embodiments may comprise one or more side wall surfaces including one or more pieces of drop stitch fabric. In such embodiments, there may be an exposed area 220 present in the bends of the cooler's perimeter that may be substantially devoid of drop stitches 104 of a drop stitch fabric 204 that defines the cooler body. It will be appreciated that in some cases, a bend may comprise a space filled with air while the space may not additionally comprise fully extended drop stitches or the drop stitches that are present may be cut such that they do not fully extend between a first surface and a second surface of the drop stitch fabric.

In at least one embodiment provided herein, the drop stitch fabric 100 may be configured to form the outer perimeter of the cooler body wherein the perimeter of the cooler as defined by the side walls that are substantially perpendicular to a ground surface.

In such examples, the drop stitch fabric may be configured to include bends. In some examples, the bends of a cooler wall may comprise a single drop stitch fabric portion that may be scored along an interior edge of the fabric such that the exterior edge of the fabric may provide an exterior surface of the cooler body. Once the interior edge(s) has/have been scored, inner scoring seals 302 may be applied to the scored area of the drop stitch fabric as shown in FIGS. 3A and 3B.

In a further exemplary embodiment, the inflatable chamber of the drop stitch cooler may comprise at least two portions of drop stitch fabric coupled together via a method of scoring and sealing as described above with reference to FIGS. 2A-3B. As an example, a singular piece of drop stitch fabric may comprise the vertical side walls of a cooler body. The sidewalls of the cooler may then be coupled to a bottom planar surface of the cooler also comprising a drop stitch fabric construction. In at least one embodiment, the sidewalls of the cooler body may be scored along in interior edge such that a first outer layer 202 may be continuous along the entire periphery of the vertical sidewalls of the cooler body.

Specifically, in such an embodiment, a portion of drop stitch fabric may be bent in 4 places such that the bends form a substantially square or rectangular shape when viewed from the top down. Once the drop stitch portion has been bent into the desired configuration, the fabric may be sliced along the angle of the bend. In at least one embodiment, the slicing or scoring of the bend angles may traverse only a portion of the drop stitch fabric. In this way, a singular and unitary cooler body profile may be achieved.

It will be appreciated that at bend 209 locations, the scoring may substantially traverse at least a portion of the drop stitching 104 of the drop stitch fabric 204. In such an embodiment, the drop stitches 104 may not be fully extended so as to fully support a first surface 110 and a second surface 120 in a parallel arrangement. Further, an area of drop stitching located at the bend 209 location(s) may be cut such that the stitching may be limber and may not fully extend in a substantially linear manner.

In some embodiments, the bends of the cooler wall may comprise an interface at which the interior sections of the drop stitch fabric may be in direct face-sharing contact with each other. For example, in some embodiments, when the cooler is inflated, the bends may comprise an area at the bend angle edge in which the drop stitching may not be fully extended and may be compressed between a first surface and a second surface of the drop stitch fabric. In this way, air may still fill the entirety of the inflatable chamber while providing a desired shape of the chamber.

In other examples, drop stitch fabric portions may be cut into individual pieces that correspond to each vertical side wall of the cooler body and a bottom planar surface of the cooler body. Once portions of the cooler body are cut and configured to the correct shape, each portion may then be coupled to each corresponding piece via a method of scoring and sealing. FIG. 3B illustrates an example method for scoring and sealing drop stitch fabric according to an embodiment comprising individual cooler body sections. For instance, in one embodiment, the bends 209 may comprise an exposed area 220 that may be substantially devoid of drop stitching. In this way, the stresses of air filling the inflatable chamber defined by the drop stitch fabric walls may be reduced.

It will be appreciated that when in a deflated state, the drop stitch fabric defining the cooler body may comprise a substantially thin profile wherein the drop stitch fabric and the drop stitches within the fabric may not be fully extended and may not be supported by air within the chamber. Specifically, when deflated, in one embodiment, the first surface of the drop stitch fabric may be in direct face-sharing contact with the second surface. In this way, the cooler may be more easily stored and/or transported.

Turning now to FIG. 4, a first inflatable cooler embodiment 400, constructed at least partially from a drop-stitch fabric and comprising an upper section 410 and a lower section 420 is shown. The first inflatable cooler embodiment 400 is a view from a rear perspective of the cooler. In the depicted example, the cooler is shown having a prismatic oval shape. However, it will be appreciated that the features of the first embodiment discussed herein may be applied to coolers of various shapes such as a rectangular prismatic cooler.

As described earlier, wall 402 of cooler 400 may comprise an inflated side chamber with a drop-stitch construction. In some examples, an additional layer of fabric may be tightly wrapped around the convex surface of the drop-stitch fabric of the cooler walls (e.g., around a first outer layer 202 of the cooler wall). In some examples, the same additional layer of fabric may also be wrapped around a bottom surface of the cooler, or alternatively a second additional layer of fabric may be wrapped around the bottom of the cooler. Though not specifically shown, cooler 400 may also include a bottom inflatable chamber integrated with the inflated side chamber in order to form a lower section 420. A plurality of outer scoring seals 214 are shown on an exterior surface of cooler 400. In one example of an oval-shaped cooler, five outer scoring seals may be distributed across each arched section of the oval walls (one along each arc is shown in FIG. 4). In another example, a rectangular shaped cooler may have four outer scoring seals affixed at each of the four bends in the cooler. The plurality of outer scoring seals may differ in number based on a selected design and shape of the cooler.

In at least one embodiment, the bends in the cooler may surround an area formed by scoring at least one surface of a drop stitch fabric along an interior surface such that the drop stitching 104 may not be fully supported between a first surface 110 and a second surface 120 of the drop stitch fabric. For example, the outer surface of one or more bends 409 may enclose a space occupied by air wherein the drop stitching may not be fully extended between a first surface and second surface of the drop stitch fabric. Additionally, the outer scoring seals may comprise a material that is not drop stitch fabric.

A plurality of interchangeable foot elements 406 may further be located on an exterior bottom surface of the inflatable cooler. In some examples, the interchangeable foot elements 406 may protect the exterior bottom surface of the cooler 400 from degradation (e.g., degradation via skidding, scratching, etc.) and may improve the friction between cooler 400 and a ground surface. Interchangeable foot elements 406 are described in further detail with reference to FIG. 7. By providing interchangeable foot elements to the inflatable cooler, the cooler may be used in a wider set of conditions and may be placed on a variety of different surfaces. As an example, a user may select one of higher friction foot elements, lower friction foot elements, suction foot elements, or rolling foot elements when using the cooler under varying conditions.

Cooler 400 may include a coupling sheet 434 coupling the upper section 410 to the lower section 420, as further described below with reference to FIG. 5. Rear webbing straps 432 may be provided along the rear outer edge of the cooler in order to improve the strength of the seal between upper section 410 and lower section 420. Rear webbing straps 432 may include webbing clips 429 and are shown secured to each of the upper and lower sections 410, 420, respectively of cooler 400. In one example, the rear webbing straps 432 may be sewn into the outer fabric layers of the cooler wall 402 and lid 410, and circular patches of PVC may be glued over the sewing. Rear webbing straps 432 may be secured to the lower section 420 towards an upper position (e.g., towards top edge 405) of the outer (e.g. exterior) cooler wall 402 above a rear handle 431. Further, rear webbing straps 432 may also be secured to the upper section 410 at a position above coupling sheet 434 along the outer longer edge 411 of the lid 410. A tension within rear webbing straps 432 may be adjusted to provide a desired seal strength between the lid 410 and the cooler body 420 along a rear outer edge of the cooler. Rear handle 431 may be located below rear webbing straps 432, and may be secured at each end of the handle via stitching and two circular patches on the exterior of the cooler wall 402. Rear handle 431 may comprise a tubular webbing strap with a soft foam core in order to improve user comfort. However, in other examples, rear handle 431 may comprise a nylon webbing strap surrounded by a neoprene collar to improve the grip of the handle in wet or low grip conditions. By constructing handles from webbing straps, the weight of the cooler may be reduced and compactness and flexibility of the deflated cooler may be increased.

A drain valve 444 may further be provided on one or more embodiments of the inflatable cooler. The drain valve 444 may be located on a rear exterior face of cooler wall 402 and may include a spigot 428. Drain valve 444 may couple the storage compartment of the cooler (not shown) on the inside of cooler 400 to the outside of the cooler 400 when the drain valve is open, and together with spigot 428, the drain valve may provide a way for a controlled draining of liquids from within the cooler. By positioning the drain valve and spigot at the rear of the cooler, any draining of the cooler may be performed with a lower risk of other cooler contents falling out of the cooler.

Along the shorter edges 413 of cooler 400, side webbing straps 435, 436 may be provided to improve the security of the lid closure. A first end of each side webbing strap 435 may be integrated into an outer edge of lid 410 at a center of each shorter edge 413 of cooler 400, in a similar manner as the rear webbing straps. A second end of each side webbing strap 435 may be configured to buckle a first end of a corresponding side webbing strap 436 via a webbing clip. A second end of webbing strap 436 may be integrated into an exterior fabric layer of the cooler wall 402 in a manner similar to the rear webbing straps. The second end of webbing strap 436 may also be attached along shorter edge 413 of cooler 400. The tension between side webbing straps 435, 436, may be adjusted to provide a desired force between lid 410 and cooler body 420. Furthermore, side handles 438 may be provided on each shorter edge 413 of the cooler wall, vertically below side webbing straps 436, with the side handles secured at each end via each of stitching and circular patches on the outer fabric layer of the cooler wall. Side handles 438 may comprise a nylon webbing strap and may further include a neoprene collar. In some examples, the nylon webbing straps of side handles 438 may be tubular and may include a foam rubber core.

In some example cooler embodiments, a foam surface 416 may extend across a top exterior surface of lid 410. The foam surface may be secured to the lid 410 via an adhesive. In one example, foam surface 416 may be constructed from ethylene-vinyl acetate (EVA) or EVA derived materials or a similar material. The foam surface 416 may provide a flat surface with improved friction as compared to the drop-stitch fabric of lid 410. Additionally, the use of foam allows for the top surface of the cooler to provide an amount of friction even during wet conditions, which may serve to improve the utility of the cooler as a working surface across a wide range of conditions. The lid 410 may also include a seal 414 providing an amount of separation between the upper section 410 and lower section 420 of cooler 400 when the cooler lid 410 is closed. Seal 414 may be manufactured from a foam rubber material such as ethylene-vinyl acetate (EVA), EVA derived materials, or other suitable materials and is discussed further below with reference to FIGS. 5 and 6.

Turning now to FIG. 5, this figure shows the first inflatable cooler embodiment 400 of FIG. 4 in an open position exposing the storage compartment 440 formed within cooler 400 when the cooler is inflated. Thus, interior surfaces of lid 410 and cooler body 420 are detailed in FIG. 5. Further, FIG. 5 shows a front view of the cooler 400. It will be noted that features and details described earlier in reference to FIG. 4 may not be re-introduced with reference to FIG. 5.

Interior surfaces of each of the upper section 410 and the lower section 420 may be lined with an insulating material 446 in order to improve insulation of the storage compartment 440. As an example, the insulating material may be Mylar. As another example, the insulating material may be a thermal foil layer with a PVC backing. An additional example of an insulating material may comprise an aluminum foil bubble material disposed between PVC layers on long edges of the cooler. Still, a further example insulating material may comprise a fabric including a reflective metalized polyester film coupled in a face-adjacent manner to a non-woven substrate via a plurality of hollow polyester fibers needle punched through each of the polyester film and the non-woven substrate. In this further example, the insulating material may be installed such that the reflective metalized polyester film may be exposed to the storage compartment, and the non-woven substrate may be colligated to the interior surfaces of the inflatable cooler. In this way, the reflective metalized polyester film may reflect radiant energy toward the source of radiation, thereby insulating the storage compartment from the external ambient atmosphere.

In at least one embodiment, the underside surface 460 of the upper section may not comprise a drop stitch fabric construction. Additionally, inner webbing straps 442 may be constructed from a material other than drop stitch fabric.

Inner webbing straps 442 may be located within storage compartment 440 and may span a width (e.g. a shorter horizontal axis of the cooler). For example, inner webbing straps 442 may extend from a rear end 492 of the storage compartment to a front end 494 of the storage compartment 440. In this way, the inner webbing straps, when buckled, may restrain the mobility of any contents within the storage compartment. In an alternate example, inner webbing straps 442 may span the longer horizontal axis of the storage compartment 440. For example, inner webbing straps 442 may extend from a first side 496 to a second side 498 of storage compartment 440 along an axis that is perpendicular to the width (e.g. from rear 492 to front 494) of storage compartment 440. Inner webbing straps 442 may include webbing clips and the tension within the straps may be adjusted to desired amounts. For example, the tension in the inner webbing straps may be based on an amount of contents stored within the storage compartment of the cooler. Valve 444 is shown in FIG. 5 embedded into a rear interior surface of the storage compartment 440 and may provide a coupling of the storage compartment to the outside of the cooler to allow for draining of the cooler via a spigot (e.g., 428 in FIG. 4).

Front webbing straps 433 are shown mounted to cooler wall 402 at a position above a front handle 430 in a lower section 420 of cooler 400. A corresponding set of front webbing straps 435 are shown attached to lid 410 towards a front end of the top surface of lid 410. Front webbing straps 433 and 435 may be configured to buckle together along a front face 482 of the cooler via webbing clips to provide a more secure closure. The tension within the webbing straps may be adjusted to enhance a sealing of storage compartment 440.

Coupling sheet 434 is shown attached towards the rear of the cooler along the inner surface of cooler body rim 424 and along a base 484 of lid 410. When coupling sheet 434 is taut, it may constrain the angular motion of lid 410 about the horizontal axis extending along the rear longer edge of the cooler. In this way, coupling sheet 434 may provide a non-releasable coupling mechanism between the lid and the cooler body. It will be appreciated, however, that the first cooler embodiment 400 may not include a coupling sheet.

It will be appreciated that cooler body rim 424 may comprise a plurality of edge seals and corner seals spanning an otherwise-exposed drop stitching of the cooler wall, as described above with reference to FIG. 2.

Inflation valve 426 is shown on a front surface of wall 402 of cooler body 420. When open, inflation valve 426 couples the side inflatable chamber of the cooler to the atmosphere and allows for the inflation of the cooler wall. Specifically, space 102 within the drop-stitch fabric 100 forming wall 402 of cooler 400 may be filled with air. Because the drop-stitch fabric of wall 402 comprises a single inflatable chamber, only a single valve is needed to inflate the cooler wall. Inflation valve 426 may be configured to be inflated by a hand pump, for example a hand pump capable of pumping first and second volumes of air. By locating the inflation valve on the outside of the cooler, the ease and speed of inflating and deflating the cooler is improved. By locating inflation valve 426 on the cooler wall opposite the draining valve 444, the rigidity of the cooler walls is increased. It will be appreciated that inflation valve 426 may be located at a cooler wall face other than the front face without departing from the scope of this disclosure. For example, inflation valve 426 may be located on a side face of the cooler wall.

Continuing with FIG. 5, lid 410 is shown with seal 414. Seal 414 may comprise a ring-shaped piece of water-resistant "foam rubber" material such as ethylene-vinyl acetate. It will be appreciated that seal 414 and foam surface 416 (shown in FIG. 4) may be manufactured from the same material, but the density of material used for each component may be different. The shape of seal 414 may be a ring in the same shape as the bottom of lid 410 (as shown, an oval ring). Further, seal 414 may extend along the entire perimeter of the bottom of the lid. Seal 414 may include a lip 415 which extends radially outward from the inner perimeter of the seal to the point along the radial extent of the seal that aligns with the inner perimeter of the cooler wall. In this way, lip 415 may be configured to fit flush within an inner perimeter of cooler body rim 424 when the cooler lid is closed to cover the storage compartment 440. Further, when the lid 410 is closed, lip 415 may extend downward into the storage compartment.

By constructing the seal 414 from a soft foam material, seal 414 with lip 415 may provide a secure, water-tight seal between storage compartment 440 and the surrounding. By positioning the seal on the interior surface of the lid 410 instead of on the cooler body 420, degradation of the foam material may be reduced when loading and unloading contents of the inflatable cooler. Additionally, seal 414 may reduce wear on an underside surface of lid 410 by protecting the drop-stitch fabric from contact with lower rim 424 when opening and closing the lid. The underside surface may be an interior surface of the lid exposed to the storage compartment 440.

Inflation valve 419 is depicted in FIG. 5 positioned at a center of the interior surface of lid 410. Inflation valve 419 may couple the upper inflation chamber to the atmosphere, and may allow for the inflating and deflating of the lid 410. Specifically, space 102 within the drop-stitch fabric 100 of upper section 410 may be in fluidic communication with the atmosphere via inflation valve 419. Inflation valve 419 may be configured to be inflated by a hand pump, for example a hand pump capable of pumping first and second volumes of air. By locating inflation valve 419 on the inside of the cooler, a more uniform surface may be achieved on the outer (e.g. exterior top) surface of lid 410 (e.g., foam surface 316 at FIG. 3) to improve the utility of the cooler when shut. Additionally, by locating inflation valve 419 on the inside of the cooler, degradation of the inflation valve via inadvertent contact with the inflation valve may be reduced.

Alternate examples of the first cooler embodiment may also include one or more sealing mechanisms comprising magnetic components embedded into each of the upper and lower sections of the cooler. FIG. 6 depicts an example first cooler embodiment, including example magnetic components as sealing mechanism. Further, FIG. 6 shows the example cooler with the lid held open such that storage compartment 440 is visible. The example cooler 400 of FIG. 6 further shows a cooler wall 402 as constructed by the second example method of scoring described above, with reference to cooler wall 210 at FIG. 2. It will be appreciated that FIG. 6 shows an example of draining valve 444 located on a side wall rather than on the rear wall as illustrated at FIG. 5.

Cooler 400 may include cooler lid 410 shown herein with several example features. It will be noted that some example coolers 400 may not include an insulating fabric on the interior underside surface of lid 410. Seal 414 is shown lining the entire perimeter of the interior underside surface of lid 410, and may include lip 415 along the inner perimeter of the seal. Seal 414, in one example, may be made from a material such as EVA. Alternative materials may also be used for seal 414 without departing from the scope of this disclosure. Lip 415 may be configured to align flush with the inner perimeter of the cooler body rim 424 of lower section 420. In this way, seal 414 may rest directly on lower rim 424 when the lid 410 of inflatable cooler 400 is closed to isolate storage compartment 440 from the surrounding atmosphere. Additionally, lip 415 may provide improved insulation to the storage compartment of the cooler body when the inflatable cooler lid is shut and closed.

Upper magnetic components 438 are shown embedded within seal 414 of upper section 410. Specifically, upper magnetic components 438 may be located outside the perimeter of lip 415. Each upper magnetic component 438 may be embedded within the seal along shorter sides 655 (e.g. widths) of the seal perimeter such that a length of the magnetic component extends along the front-rear axis of the cooler. In alternative examples, upper magnetic components may be included along longer sides of the seal perimeter (e.g. lengths) extending from the front to rear of seal 414 (and cooler 400), such that the upper magnetic components may extend along a left-right axis of the cooler. As a non-limiting example, upper magnetic components 438 may be rubber magnets glued into recesses within seal 414 that are cut to the dimensions of the magnet. As another example, magnetic components may be integrated into the upper section of the cooler via adhesive, heat fusion, sewing, and/or a combination thereof.

Lower magnetic components 439 are shown embedded within lower rim 424. In one example, lower magnetic components 439 may be glued to the drop-stitch fabric of the cooler body, and an outer fabric layer (e.g., PVC) may be fit tightly over the drop-stitch fabric to secure the magnetic components 438, 439 in place. As another example, magnetic components may be integrated into the upper section of the cooler via adhesive, heat fusion, sewing, and/or a combination thereof. Each lower magnetic component 439 is embedded within the lower rim on the shorter sides 657 of the rectangular perimeter of the lower section 420. The length of the lower magnetic components 439 may extend in a direction substantially parallel to a front-rear axis of the cooler. Lower magnetic components 439 may be configured to couple with upper magnetic components 438 embedded within the seal 414 on cooler lid 410 when the cooler lid is closed. By using magnetic components for sealing the lid to the cooler body a more secure closure may be provided to the storage compartment even if the cooler is in motion or at an attitude.

Upper magnetic components 438 are configured to couple with lower magnetic components 439 embedded within cooler body rim 424 when the cooler is shut, and may thereby provide a strong seal to the storage compartment. By incorporating a magnetic seal into the inflatable cooler, the strength of the seal is improved relative to that of a traditional webbing clip seal while still maintaining the light weight and compact packing advantages of an inflatable cooler constructed from a drop-stitch fabric. A further advantage of a magnetic seal is that the sealing is automatic upon closing the cooler, as compared to additional buckling and fastening required in the example of traditional webbing clips. Thus, magnetic sealing components may enable an easier and more efficient sealing mechanism.

In some examples, cooler 400 may include a sealing mechanism which comprises a plurality of magnetized clips 450. An example cooler 400 may include magnetized clips 450 additionally or alternatively to magnetic components 438 and 439. Magnetized clips 450 may comprise a webbing strap 452 and a magnetized component 454. Each webbing strap may be sewn to lid 410 and further secured via a heat-sealed PVC patch. In some examples the webbing strap 452 may be hollow and may securely house the magnetized component 454. As an alternate example, magnetized component 454 may be secured to the exterior of webbing strap 452 via an adhesive. Each magnetized component 454 may be configured to magnetically couple to a corresponding magnetized component 456 when the cooler lid is resting atop the cooler body. Magnetized components 456 may be integrated into the exterior of cooler wall 402. As one example, magnetized component 456 may be secured to cooler wall 402 via an adhesive, a heat-sealed patch, and/or a combination thereof. As illustrated in FIG. 6, magnetized clips 450 may be positioned along the front face of the cooler, however it will be appreciated that additional magnetized clips 450 may be included at a plurality of locations along the cooler perimeter, including but not limited to the front face, the side faces, and the rear face. Further, as shown in FIG. 6, magnetized clips 450 may be arranged on a lid 410 of cooler 400 while corresponding magnetized components 456 are positioned on the cooler body 420. In an alternative example, magnetized clips 450 may be arranged on cooler body 420 of cooler 400 while corresponding magnetized components 456 are positioned on the lid 410.

Inflation valve 419 is shown on the interior underside surface of cooler lid 410, adjacent to a corner 612 of the inner perimeter of lip 415. When in an open state, inflation valve 419 couples the upper section inflation chamber to the atmosphere and allows for the inflation and deflation of the cooler lid. Specifically, inflation valve 419 may fluidically couple space 102 of the drop-stitch fabric 100 that forms the lid 410 when the inflation valve is open. Inflation valve 419 may include a cover to protect the valve components when neither inflation nor deflation of the cooler lid is occurring. The cover may protect the valve components from the contents of the storage compartment when the cooler is shut and the lid is closed to cover the storage compartment. By locating inflation valve 419 on the underside interior surface of the cooler lid, and not on the top, exterior surface of the lid 410, the valve may be protected from possible degradation to elements, for example due to heavy use, exposure to environment, and weather.

Storage compartment 440 of FIG. 6 may include inner scoring seals 423 at each inner corner 623 of the cooler wall, extending from the base 625 of the storage compartment to the cooler body rim 424. The inner scoring seals 423 may be included in addition to outer scoring seals 422. The outer scoring seals 422 may be affixed on the exterior corners of the cooler body while the inner scoring seals 423 are attached to the interior corners of the cooler body in the storage compartment 440. It will be appreciated that the inner scoring seals, which were described earlier with reference to FIG. 2, may be integrated beneath a corner seal 418 of the cooler body rim (e.g., a corner seal similar to corner seal 218 of FIG. 2). Inner scoring seals 423 may provide additional structural support to the shape of the cooler body while maintaining the compact storage advantages of an inflatable cooler constructed from a drop-stitch fabric. Inner scoring seals 423 may also improve the air seal of the side inflatable chambers forming cooler wall 402. Inner scoring seals 423 are aligned with outer scoring seals 422 located on the outer surface of the cooler wall 402. Together, the inner and outer scoring seals may provide an airtight seal to the side inflatable chamber of cooler 400, while improving the rigidity of the desired cooler body shape.

Turning now to FIG. 7, a bottom exterior surface 720 of the first inflatable cooler embodiment 400 is shown. The bottom exterior surface 720 of the cooler may comprise the bottom edge 407 of the side inflatable chamber and a region 427 enclosed within the perimeter of the bottom edge 407. The bottom edge 407 may also be termed a peripheral ring 407 and/or a bottom edge seal 407, the latter term reflecting the example wherein the bottom edge is sealed via an edge seal (e.g., sealed via an edge seal similar to 212 of FIG. 2). The peripheral ring 407 may include a basal edge of cooler wall 402 (e.g. a bottom edge and bottom edge seal of the side inflatable chamber), and region 427 may comprise the bottom, exterior surface of the bottom inflatable chamber.

A plurality of base elements 705 may be integrated into the bottom surface of the cooler. Specifically, the plurality of base elements 705 may be coupled to peripheral ring 407 and at least partially to region 427. As one example, the base elements may be integrated onto the outer layer of the drop-stitch fabric forming the peripheral ring 407 and region 427 via an adhesive. Alternative joining methods may also be used without departing from the scope of this disclosure. As shown at FIG. 7, a base element 705 may be provided at each of the four corners 722 of the bottom surface of the cooler, adhered to each of outer scoring seal 422 and bottom edge seal 407. However, it will be appreciated that in other examples, different configurations of the base elements 705 may be implemented. For example, the plurality of base elements 705 may be positioned in different regions of the bottom exterior surface of the cooler.

Each base element may include an accessory port (not shown) configured to accept an interchangeable foot element 406. The accessory port may include a coupling mechanism (not shown) for securely coupling each foot element. The interchangeable foot elements 406 may then be securely coupled to the cooler via coupling mechanisms of the base elements 405. It will be understood that interchangeability of foot elements 406 refers to the possibility of coupling any one of a variety of foot elements to each of base elements 705. As one example, a different variety of foot element 406 may be coupled to each base element 705. In a different example, no foot elements 406 may be coupled to each base element 705 during the use or storage of the cooler. By incorporating foot elements onto the bottom exterior surface of the cooler, degradation of the cooler (e.g., degradation via skidding, scratching, etc.) and cooler weight may be reduced. By providing removable foot elements, compact storage of the deflated cooler may be achieved.

A technical advantage of providing interchangeable foot elements is to allow the user to select a foot element based on the desired application of the cooler. For example, as shown at FIG. 7, the user may desire a foot element configured to accept a fastening mechanism such as a rope so that the bottom of the cooler may be anchored to an exterior object away from and distinct from the cooler. A foot element configured to accept a fastening mechanism may be desired when the cooler is located in a bed of a truck and subject to sudden accelerations and decelerations. In another example, the user may desire a foot element including one of a fixed or swiveling wheel for use in applications in which the cooler may be moved often. In a further example, the user may desire a foot element with a high coefficient of friction (e.g., a soft rubber foot element) for use in wet environments such as on a boat. In a still further example, the user may desire a hard plastic foot element that is resistant to abrasions and allows the cooler to easily slide on a smooth surface.

Region 427 of bottom exterior surface 720 of the first cooler embodiment 400 may also include a bottom inflation valve 445 coupling the bottom inflatable chamber to the atmosphere when the inflation valve is opened. Inflation valve 445 may be configured to be inflated by a hand pump, for example a hand pump capable of pumping first and second volumes of air. Inflation valve 445 may be at least partially recessed within the bottom exterior surface to reduce degradation of the valve. By coupling the entire bottom of the cooler body to a single inflation valve, the complexity of inflating and deflating the cooler is reduced. By including inflation valve 445 on the bottom exterior surface 720 of the cooler, degradation from cooler contents such as water may be reduced. A further advantage of including inflation valve 445 on the exterior of the cooler is to allow for easier inflating and deflating of the cooler when contents are still within the storage compartment.

Between inflation valve 426 described above with reference to FIG. 5 and bottom inflation valve 445, the first inflatable cooler embodiment 400 may be inflated or deflated. Specifically, inflation valve 426 may inflate or deflate wall 402 while bottom inflation valve 445 may inflate or deflate the bottom inflatable chamber of the cooler body 420. Thus, cooler 400 may include a first valve (e.g. inflation valve 445) for inflating or deflating the bottom inflatable chamber and a second valve (e.g. inflation valve 426) for inflating the side walls of the cooler body.

In an alternate representation, an inflatable cooler may comprise a first inflatable drop-stitch chamber defining a bottom wall (or a base), a second inflatable drop-stitch chamber defining a plurality of side walls, and a third inflatable chamber defining a lid. The inflatable chambers may be defined by two opposing surfaces of a drop-stitch fabric. The first and second inflatable drop-stitch chambers of the cooler may each be constructed from a single sheet of drop-stitch fabric. Further, the bottom wall and the plurality of side walls of the cooler may define a cooler body, and the cooler body may be releasably attached to the lid via a magnetic seal. The inflatable cooler may further comprise a plurality of flexible seals non-releasably integrated into the cooler body, said flexible seals spanning the vertical extent of the side walls. The cooler may further comprise a plurality of interchangeable plastic elements integrated into a bottom (exterior) surface of the bottom wall. The bottom wall and side walls of the cooler may define a cooler body, and the cooler body is releasably attached to the lid via a plurality of webbing clips.

A second cooler embodiment contemplated herein may comprise only a contiguous cooler wall. In a first example, the cooler wall may comprise a single inflatable chamber constructed form a drop-stitch fabric, and said drop-stitch fabric may be scored and sealed to conform to an envelope shape. It will be appreciated that the drop-stitch fabric of the first example may be scored according to one of the first and second scoring methods described above with reference to FIG. 2. In a second example, the cooler wall may comprise each of a first and second inflatable chamber constructed from a drop-stitch fabric, said first and second chambers coupled via a plurality of sealing elements to conform to an envelope shape. In each example, the cooler wall of the second cooler embodiment may comprise first and second adjacent faces which may be non-releasably attached at three ends and releasably attached at a fourth end.

Turning now to FIG. 8, it shows a top-down view of an example second cooler embodiment 800. It will be understood that a top-down view refers to a viewer looking downward on cooler 800 from above. Arrow 898 is provided to indicate a vertical direction. Specifically, arrow 898 represents a direction that is normal to a flat ground upon which cooler 800 may be resting. Accordingly, the "top" end of the cooler is the end positioned at the vertical apex of the cooler, and the "bottom" end of the cooler is located at the end opposite the top end. The "bottom" end may also be termed a "base" of the cooler 800. Top edges 824 are depicted without their seals to expose the drop-stitching of the inflatable chamber(s) forming the body of cooler 800. Though not shown, top edges 824 may be covered and sealed via air-tight edge seals across the top edges 824. These air-tight seals on top edges 824 may span the entire extent of top edges 824 as described earlier with reference to FIG. 2. Similarly, it will be appreciated that the lateral ends of the cooler are the ends adjacent to each of the top and bottom ends of the cooler that extend both vertically and substantially into the plane of the page. It will be understood that extending into the plane of the page refers to extending along the axis that is perpendicular to each of vertical 898 and the plane of the page. The lateral ends of the cooler may include the "left" and "right" ends as indicated at FIG. 8.

Cooler 800 includes a first face 810 and a second face 820. Second face 820 may be substantially parallel to first face 810. When first face 810 and second face 820 are substantially parallel to each other, respective lateral ends 812 and 814 may be referred to herein as "adjacent lateral ends", and respective lateral ends 816 and 818 may be referred to herein as "opposite lateral ends". Each lateral end extends from a top end of a cooler face to a bottom end of a cooler face. Similarly, respective top ends 811 and 813 may be referred to herein as "adjacent top ends", and respective top ends 815 and 817 may be referred to herein as "opposite top ends". Each top end extends from a first lateral end of a cooler face to a second lateral end of a cooler face. First face 810 and second face 820 may be attached to each other via a plurality of elements (e.g., at least elements 822, 823, and 825) to form a storage compartment 840. Thus first face 810 and second face 820 may enclose storage compartment 840.

Second cooler embodiment 800 may be configured in one of a first example configuration or a second example configuration. In the first example configuration, the cooler body may comprise a single inflatable chamber, and each face 810, 820 may be formed from a common sheet of drop-stitch fabric. A plurality of sealing elements may be provided to form an air-tight inflatable chamber from the common sheet of drop-stitch fabric. The plurality of sealing elements forming the air-tight inflatable chamber may further act as water-tight seals for a storage compartment formed between adjacent surfaces of first face 810 and second face 820. In the second example configuration, the cooler body may comprise a first and second inflatable chamber. Specifically, first face 810 may comprise a first inflatable chamber, and second face 820 may comprise a second inflatable chamber. Each inflatable chamber may be coupled via a plurality of sealing elements to provide a water-tight seal for a storage compartment formed between adjacent surfaces of first face 810 and second face 820. It will be understood that the air-tight seals of the second configuration are unique to either the first face 810 or the second face 820, and are not achieved by any sealing elements that couple the two faces.

In the first example configuration of the second cooler embodiment, each of first face 810 and second face 820 may be constructed from a common sheet of drop-stitch fabric. Accordingly, cooler 800 may comprise a single, common and un-divided inflatable chamber. The drop-stitch fabric may be scored along the bottom edge of the cooler according to one of the first and second scoring methods described above with reference to FIG. 2. The drop-stitch fabric may be folded at the scoring to form an envelope shape with first face 810 and second faces 820 forming the body of the envelope. At least exterior bottom seal 825 may be provided to seal exterior scoring (via first scoring method) at the base of the envelope, and an interior bottom seal (not shown) may be included on an inside of the envelope at the base in examples using the second scoring method. Herein, the drop-stitch fabric is scored along each wall of its double-wall construction. As shown, exterior bottom seals may span the entire lateral extent of the bottom edge of cooler 800 from the left end of the cooler to the right end of the cooler.

First face 810 and second face 820 of the drop stitch fabric may be nonreleasably coupled along adjacent lateral ends 812 and 814 via inner seals 823. Further, first face 810 and second face 820 may be nonreleasably coupled along opposite lateral ends 816 and 818 via outer seals 822. As shown, seals 822 and 823 may span the entire vertical extent of the lateral ends of cooler 800. Specifically each of seals 822 and 823 may extend from the top of second cooler embodiment 800 (e.g. from top edges 824) to the base (or bottom) of second cooler embodiment 800. In this way, the single inflatable chamber first configuration of the second cooler embodiment includes the spaces between outer seals 822 and inner seals 823. Thus the single inflatable chamber of the first configuration may extend outward from an inner perimeter comprising adjacent surfaces of the respective first and second cooler faces 810, 820 and inner seals 823, toward an outer perimeter comprising opposite surfaces of the respective first and second cooler faces 810, 820 and outer seals 822. The single inflatable chamber of the first configuration may further extend from a bottom end of the cooler to a top end of the cooler. It will be understood that at least a portion of the single inflatable chamber may be spanned by drop stitching as indicated by the vertical-line fill of first face 810 and second face 820, however other portions of the single inflatable chamber may not be spanned by drop stitching.

First face 810 and second face 820 may not be coupled along the adjacent top ends 811 and 813 of each face in order to provide access to a storage compartment 840 that is formed from the coupling of the bottom, left, and right edges. First face 810 and second face 820 may further be sealed at each top edge 824 of the drop-stitch fabric via a plurality of top edge seals. It will be understood that the top edge 824 differs from any top end 811, 813, 815, 817 in that the surface normal vector of top edge 824 points vertically upward (that is to say, the top edge surface normal vector is parallel to vertical 898) while the surface normal vectors of the top ends 811, 813, 815, and 817 point either into or out of the plane of the page (that is to say, the top end surface normal vectors are perpendicular to each of vertical 498 and the lateral extent of the cooler). The top edge seals may extend along the entire perimeter of the top edge 824, thereby providing an air-tight seal for the drop-stitch fabric. In this way, cooler 800 may comprise a single inflatable chamber.

In the first example configuration of the second cooler embodiment, inflation valve 826 may be provided on an exterior surface of the cooler 800 to inflate (or deflate) the entire cooler wall. Inflation valve 826 may be configured to be inflated by a hand pump, for example a hand pump capable of pumping first and second volumes of air. By locating the inflation valve on the exterior surface of the cooler, the ease and speed of inflating and deflating the cooler is improved. Inflation valve 826 may be similar to the inflation valves described earlier with reference to the first cooler embodiment.

In a second example configuration of the second cooler embodiment, first face 810 and second face 820 may comprise separate and distinct drop-stitch fabrics. As such, first face 810 and second face 820 may comprise separate and distinct inflatable chambers. Conversely, the first face 810 and second 820 in the first example configuration of the second cooler embodiment described earlier may be formed from a single drop-stitch fabric. It will be understood that in the second configuration of the second cooler embodiment, the spaces between outer and inner seals 822, 823 are not part of any inflatable chamber.

Returning to the second example configuration of the second cooler embodiment, each inflatable chamber may be sealed by a plurality of edge and corner seals as described above with reference to FIG. 2. For example, first face 810 and second face 820 may be attached to each other via a plurality of edge and corner seals. As an example, the first face 810 may be affixed to second face 820 with a first edge seal (without scoring) along a bottom edge, a second edge seal along a first lateral edge, and a third edge seal along a second lateral edge. One or more corner seals may be additionally included to cap at least four corners formed by joining the first face 810 and second face 820. It will thus be appreciated that the drop-stitch fabric of cooler 800 is not scored in the second example configuration. Specifically, neither the first scoring method nor the second scoring method may be used to form the second example configuration of the second cooler embodiment.

Referring still to the second example configuration, a horizontal cross section of each inflatable chamber is shown by the vertical-line fill. The first and second cooler faces 810, 820 may be coupled along their adjacent lateral ends via inner seal 823, and along the opposite lateral ends via outer seal 822. Specifically, inner seal 823 may be affixed on an interior surface while outer seal 822 may be affixed on an exterior surface. As shown, outer seals 822 and inner seals 823 may span the entire vertical extent of each cooler face. To elaborate, each of outer seals 822 and inner seals 823 may extend from the top end of the cooler to the base of the cooler. It will be appreciated that in the second example configuration of the second cooler embodiment, the space between outer seals 822 and inner seals 823 is not an inflatable chamber. However, the space may provide a water-tight seal between storage compartment 840 and the outside of the cooler (e.g. surroundings).

Further, the adjacent bottom edges of each cooler face may be coupled via an interior bottom seal (not shown) on the interior of storage compartment 840, while the exterior bottom edges of each face may be coupled via exterior bottom seal 825. Exterior bottom seal 825 may span the entire lateral extent of each cooler face. As an example, exterior bottom seal 825 may span the first cooler face 810 from a left opposite lateral end 816 to a right opposite lateral end 816, and may span the second cooler face 820 from a left opposite lateral end 818 to a right opposite lateral end 818. Similarly, the interior bottom seal may extend along the first cooler face 810 from a left adjacent lateral end 416 to a right adjacent lateral end 416, and along the second cooler face 820 from a left adjacent lateral end 818 to a right adjacent lateral end 818. In this way, a water tight storage compartment 840 may be formed between cooler faces 810, 820.

In the second example configuration of the second cooler embodiment, a first inflation valve 826 may be provided on the exterior of the first face 810 to inflate the first cooler face. Additionally, a second inflation valve (not shown) may be provided at the exterior of the second cooler face 820 to inflate the second cooler face. Thus the second example configuration of the second cooler embodiment may thus include a separate inflation (and deflation) valve for each face. On the other hand, the first example configuration of the second cooler embodiment may include a single inflation valve to inflate or deflate the entire cooler embodiment.

Each inflation valve on the first face 810 and second face 820 of the second example configuration of the second cooler embodiment may be configured to be inflated by a hand pump, for example a hand pump capable of pumping first and second volumes of air. By locating each inflation valve on the outside of the cooler, the ease and speed of inflating and deflating the cooler is improved. Each inflation valve may be similar to the inflation valves described above with reference to the first cooler embodiment.

The interior surfaces of cooler 800 may be lined with an insulating material 846 to improve insulation of the storage compartment. Specifically, storage compartment 840 may be lined with the insulating material 846. As an example, the insulating material may be formed of Mylar. As another example, the insulating material may be a thermal foil layer with a PVC backing. In this way, the storage compartment 840 of cooler 800 may provide a thermally insulated compartment for storing contents at a desired temperature.

Sealing mechanism 850 may be provided along the adjacent top ends 824 of first face 810 and second face 820. In the depicted example, sealing mechanism 850 is a zipper extending from a first lateral end of the cooler to a second lateral end of the cooler (e.g., from the left end to the right end as indicated at FIG. 8). Other example sealing mechanisms may include webbing clips, magnetized webbing clips, and/or magnetized strips embedded within adjacent top ends of cooler faces including first face 810 and second face 820. In some examples, the sealing mechanism may be configured to be water-tight to prevent the leaking of water from storage compartment 840. In this way, the sealing mechanism 850 enables quick access to the storage compartment while maintaining a reliable water-tight seal.

Handle 830 may be provided on the first face 810, and a corresponding second handle (not shown) may be provided on the second face 820. Handle 830 may comprise a nylon webbing strap and may further include a neoprene collar. In some examples, the nylon webbing straps of handles 830 may be tubular and may include a foam rubber core. Handle 830 may provide the user with a device for adjusting the exposure of storage compartment 840, and further may provide a holder for transporting cooler 800.

Lateral handles 838 may be provided on each lateral end of the cooler, vertically below shoulder strap 839, with the lateral handles 838 secured at each lateral end via a combination of stitching and circular patches on the outer fabric layer of the cooler wall. As one example, a first end of each lateral handle 838 may be secured to the first face 810 of cooler 800, and a second end of each lateral handle 838 may be secured to the second face 820 of cooler 800. Lateral handles 838 may comprise a nylon webbing strap and may further include a neoprene collar. In some examples, the nylon webbing straps of handles 838 may be tubular and may include a foam rubber core. Lateral handles 838 may provide the user with a device for adjusting the exposure of storage compartment 840, and further may provide a device for transporting cooler 800.

Shoulder strap 839 is shown attached to each lateral end of cooler 800. Shoulder strap 839 may include two hooks 855 which releasably couple shoulder strap 839 to two plastic loops 856, and each plastic loop may be secured to a lateral end via webbing that is stitched into the cooler wall. It will be appreciated shoulder strap 839 may include a securing mechanism other than the clips and loops described herein. It will be further appreciated that the securing mechanism may be at positions along the cooler wall other than the lateral ends. Shoulder strap 839 may provide the user with additional options for transporting cooler 800.

Thus, a first method is contemplated herein for constructing an inflatable cooler, comprising constructing each of a first and second face of an inflatable cooler body from a single sheet of drop-stitch fabric. The method may further include defining a bottom end of the cooler body via a scoring of the outer surface of the drop-stitch fabric, and defining first and second lateral ends of the cooler via each of a first interior seal, a first exterior seal, a second interior seal, and a second exterior seal. The cooler constructed via the first method may comprise a single inflatable chamber. A second method for constructing an inflatable cooler is contemplated herein comprises constructing a first face of an inflatable cooler body from a first sheet of drop-stitch fabric, and constructing a second face of the inflatable cooler body from a second sheet of drop-stitch fabric. The second method may further comprise defining a bottom end of the cooler body via each of an interior and exterior bottom seal, and may further comprise defining a first and second. The cooler constructed via the second method may comprise two inflatable chambers.

A third embodiment of an inflatable cooler may include an inflatable cooler body comprising a single inflatable chamber, said chamber constructed from a single piece of drop-stitch fabric. The cooler body may include a first inflation valve located on the bottom surface of the cooler or alternately located on a front cooler wall. The cooler body may include handles on the outer surface of each cooler wall. The cooler body may include a draining valve integrated into the bottom of the rear cooler wall to allow for the draining of liquids from the storage compartment defined by the cooler body. The bottom of the cooler body may include interchangeable plastic foot elements with base elements integrated into the bottom surface of the cooler. In some embodiments, the third inflatable cooler embodiment may further include an inflatable lid constructed with drop-stitch fabric. The inflatable lid may include one or more of a seal along the perimeter of the bottom surface, an insulating material different than the drop-stitch fabric lining the entire bottom surface, and an inflation valve integrated into the drop-stitch fabric at a corner of the bottom surface. The lid may further include magnetic components along the perimeter of the bottom surface and the magnetic components may be embedded within a seal of the lid. As one example, magnetic components may be integrated along the shorter sides of the bottom surface of the inflatable lid. Magnetic components may be correspondingly integrated into the upper rim of the cooler body along shorter sides of the cooler body, and may be configured to couple to the magnetic components of the inflatable lid. In some further embodiments, the cooler may also include magnetic components along the front and rear sides of the cooler lid configured to couple to corresponding magnetic components on the rim of the cooler body. In some examples, these magnetic components may be in addition to webbing clips releasably coupling the cooler body to the cooler lid at the front and rear walls of the cooler. The storage compartment may include webbing clips spanning a horizontal axis of the storage compartment to secure the contents of the cooler.

A third example cooler embodiment provided may be a "bag style" cooler in which the cooler may resemble a tote bag for instance, and where the cooler may be held and/or transported by straps that may be placed onto the exterior surface of the cooler. Further, this bag style cooler may be constructed of a unique, three-sided drop-stitch inflatable chamber which may define the body of the cooler, having a substantially rectangular profile shape when viewed from the front or rear faces. The three sides of the inflatable chamber may include a bottom surface, and the two least substantial side walls with respect to length. The remaining two sides of the cooler's rectangular profile may be constructed from flexible high density foam, and the entirety of the cooler embodiment may further be disposed within an external layer. In this way, the cooler may form a rigid support structure on the walls constructed from the drop-stitch fabric that may allow for the cooler to support itself while affording the possibility of "over packing" the storage chamber such that the sides of the cooler constructed from high density foam may expand beyond the primarily rectangular profile shape of the example embodiment. The external layer of the inflatable bag style cooler may comprise a waterproof fabric such as PVC, HYPLON, or urethane. This external layer may provide additional support when carrying and/or transporting the cooler as well as potentially increasing its longevity.

Another example cooler embodiment disclosed herein may include an inflatable chamber section, also referred to herein as the cooler body and may be constructed at least partially of a drop-stitch fabric described with reference to FIGS. 1A and 1B. The cooler body may include an outer section that may encapsulate the cooler body and may be optionally constructed of a durable waterproof fabric such as PVC. The cooler body comprised of the inflatable drop-stitch chamber may comprise each of a bottom inflatable chamber and side inflatable chambers in a manner allowing for a single, continuous inflatable drop-stitch chamber that may comprise the interior portion of the cooler and may serve as a rigid body structure when in an inflated state. The body of the cooler may include a plurality of sides attached to the bottom inflatable chamber allowing for embodiments of various shapes and dimensions. The body of the cooler, as defined by the inflatable drop-stitch chamber, may at least partially form all sides of the cooler body except for the top of the cooler. In some examples, the body of the cooler may include only the lesser extents of the cooler's shape connected to the bottom inflatable chamber, which may form a substantially trapezoidal side profile as shown in FIGS. 9C and 10C. The inflatable chamber of the cooler may be one of a number of shapes including, but not limited to, trapezoidal, rectangular, and triangular shapes. As one example, the shape of the chamber may be created by cutting a sheet of drop stitch fabric to a desired shape, then proceeding to score and fold as needed and sealing the edges of the drop-stitch fabric as described above.

In some examples, the inflatable chamber may be shaped as a trapezoid with respect to its vertical cross section. Bends in the walls of the inflatable chamber may be achieved via one of the methods of scoring as described above with reference to FIGS. 2 and 3, thereby allowing the single sheet of drop-stitch fabric to conform to a desired shape of the cooler wall. In this way, the amount of interfacing material between separate components of the cooler's drop-stitch fabric construction, the durability and water impermeability of the cooler body may be improved. The construction of the cooler wall from a single inflatable chamber may also allow for speed and ease when inflating the cooler for use. In this example cooler embodiment, the inflatable drop-stitch chamber that defines the cooler body may be inflated to around 15 psi. By doing this, the cooler body may form a substantially rigid interior frame for the overall cooler embodiment. In this way, the example cooler embodiment may be able to stand upright on its own when placed on its bottom exterior surface without the assistance of any external support. Thus, the example cooler embodiment may retain its shape when in use. In other words, the shape of the cooler embodiment may remain unchanged when the cooler is being filled or emptied as well as when it is in transit or when set down, so long as the inflatable chamber is filled.

In one example embodiment, the top layer 930 of the cooler may be constructed of a material that is not drop stitch fabric. Additionally, upper front and rear 928 faces of the cooler may be constructed from a material other than drop stitch fabric. In this way, a single, unitary inflatable chamber construction may be achieved while allowing for some degree of flexibility to the cooler's body. Further, as described above, the exterior surfaces of the inflatable cooler may be constructed of a material such as PVC such that the exterior layer fully surrounds the cooler body as defined by the inflatable chamber. For example, logo area 912 may be located on the exterior layer defining the cooler's exterior surface.

The bottom and sides may include an exterior waterproof fabric designated to accommodate various components of the cooler while providing a protective layer for the drop-stitch fabric comprising the inflatable chamber positioned underneath. The exterior fabric surrounding the drop-stitch construction may serve as a protectant from excessive wear resultant from active use of the cooler. For instance, the exterior fabric may be a waterproof fabric such as PVC and may be affixed to the cooler body via adhesives, heat sealing, and/or combinations thereof. However, in other examples, at least a portion of the outer surfaces of the cooler may comprise the outer layer of the drop-stitch fabric. In some examples, one or more of the sides of the cooler body may include an insulating layer of foam sandwiched between a layer of PVC extending along the exterior surface of the cooler wall chamber, defining the internal storage compartment, and the interior surfaces of the exterior fabric layer. That is, the inflatable cooler may include a layer of high density foam sandwiched between layers of exterior-facing drop-stitch fabric (comprising the cooler's inflatable chamber) and PVC.

In some examples of the present embodiment, the cooler body may be comprised of a single, continuous, inflatable chamber that may include a bottom portion of the chamber coupled to the two lesser extents of a substantially rectangular front profile. The two greater extents of a substantially rectangular profile may include an insulating layer of foam. The foam lined sides of the cooler may be joined at their outermost longitudinal ends. In this way, when the cooler is closed via a zipper or other mechanism atop the cooler body, the interior compartment of the cooler may be isolated from the surroundings, including air, when the cooler is closed.

In one example inflatable cooler embodiment, the top exterior section 930 and the top exterior flaps 931 are not comprised of any portion of a drop-stitch fabric. The exterior layer, inclusive of the top layer 930, a front exterior face 940, a rear exterior face 938, corner sections 932, and upper front and rear faces 928 of the cooler's exterior are constructed from a fabric other than the drop-stitch fabric described above with reference to FIG. 1. In this way, the cooler's exterior may be more flexible relative to the cooler body, which may allow for increased portability. In this example, the cooler body, as defined by the inflatable drop-stitch fabric may be substantially rigid when in a fully inflated state and thus, may retain its shape when set down. In other words, the cooler body may stand upright on its own, without any type of bracing or external supports when fully inflated. In maintaining its shape, the ease of use of the cooler, with respect to loading and unloading, may be improved. It should be noted that the example embodiment of an inflatable cooler may be able to retain its form and shape while still maintaining a certain degree of flexibility that may be desirable for a cooler body.

One example embodiment provided in FIGS. 9A-C and FIGS. 10A-C may include a lower double-layered bottom section 922 which may surround each of a bottom and at least a portion of two sides of an inflatable chamber, referred to herein as the cooler body. The double-layered bottom section 922 may form at least a portion of an exterior section of the cooler that may surround the inflatable cooler body. The cooler body of FIGS. 9A-C may be encapsulated in an exterior fabric that may be constructed from a material such as PVC as a way to provide additional strength and support to the cooler embodiment. The outer encasement layer may form the double-layered bottom section 922 as described above, and may include each of front 940 and rear 938 exterior surfaces, upper front and rear exterior surfaces 926, corner sections 932, a top section 930 and side exterior faces 926. The exterior layer, also referred to as the encasement layer, may serve as the layer on which to affix some of the exterior components of the cooler embodiments provided. For example, the zipper assembly 918 and thusly, the zipper pulls 904 may be affixed to the top exterior section 930 of the cooler, the top exterior section having two flaps 931 on either side of the top section that extend outward beyond edges of the sides and are bendable to bend downward when zipped closed, but enabling improved opening of the linear flexible opening at the top when unzipped so that improved access to the interior is available if desired by bending out the long sides of the opening. The zipper pulls 904 may further include t-shaped handles which may provide improved functionality with respect to opening and closing the storage space of the cooler. The top exterior section does not comprise any inflatable drop-stitch portions. Other exterior components such as the loop strap may be affixed to the front 940 and rear 938 exterior sections of the cooler by way of a double-stitched extension 913 of the strap and the front and rear exterior sections may also include components such as a padded web handle 908 and areas for logos/decals 912. It will be understood that the components listed above may be in direct contact with the cooler's exterior layer and may not traverse the cooler body completely. For example, the loop strap, 914 may be affixed to the front or rear of the cooler via a double stitched strap extension 913, but the stitching of the extension may only breach the surface of the exterior fabric such as PVC and may not fully traverse the foam lining of the front and rear surfaces. In this way, the insulation of the cooler within the storage space may be improved or maintained.

Components such as the drain plugs 902 however, may fully traverse a foam lined layer 1002 of the cooler's exterior layer so as to be fully functional as a drain. The foam lining around the drain plug may help to reduce the potential loss of insulation resulting from the drain plugs being placed into the cooler. Further, components such as the air valve 906 used to inflate and deflate the cooler body may be affixed to the exterior surface of the cooler in a way so as to fully traverse the exterior fabric layer and at least partially traverse the first outer layer of the inflatable chamber that defines the cooler body. In other words, the air valve 906 may be affixed to the cooler such that the inflatable chamber may only be punctured on the outer layer 201 of the cooler body. In this way, air may not leak into the storage cavity, and the structural integrity of the inflated, rigid cooler body may be maintained.

Turning now to FIG. 9A specifically, this figure shows a top-down view 900 of an example embodiment of a collapsible drop-stitch cooler wherein the cooler may form a substantially rectangular profile when viewed from above. The exterior of the cooler may comprise a top layer 930, a front exterior face 940, a rear exterior face 938, corner sections 932, upper front and rear face sections 928, and a zipper assembly 918 that may be affixed to the top layer 930 of the cooler. The example cooler illustrated in FIG. 9A and following figures may use various elements of the cooler illustrated in FIGS. 1-8, including corner construction, etc. Similar goes for the additional example coolers of FIGS. 11, 13, 14, etc.

It will be understood that the exterior layer of the cooler, also referred to as the outer lining and the outer section, as used herein, does not comprise any inflatable drop-stitch components and may be affixed to the exterior faces of a cooler body as defined by an inflatable drop-stitch chamber via adhesives, heat fusion, and/or a combination thereof. Further, the exterior layer or at least a portion of the exterior layer may be constructed of a durable and waterproof fabric such as PVC or nylon or a combination thereof.

A loop strap 914 may be affixed to each of the exterior front 940 and exterior rear 938 surfaces of the outer lining of the cooler embodiment. Further, the loop strap 914 may extend from the middle third of the top section 930 of the cooler's exterior and may form a loop for carrying the cooler above the middle of the cooler. The loop strap 914, may be secured to the cooler exterior layer via a double stitched strap extension 913 that may be affixed to the cooler exterior in a way that visually divides the exterior section of the cooler into thirds. The middle third section of the exterior layer of the cooler may be defined by the strap extension 913 and may feature a padded web handle 908 within the two sides of the strap extension. Further, the strap extension may begin at the top of the double layered bottom 922 of the cooler exterior and may extend upward to the top layer 930. When the cooler is to be transported, the loop straps of the front 940 and rear 938 exterior faces may be joined together via a padded Velcro handle 924. The loop strap and the exterior surfaces forming the front 940 and rear 938 faces as well as the top layer 930 of the cooler embodiment may be constructed at least partially from a material such as nylon or PVC an combinations thereof or other suitable and durable material that may provide added protection. The top section 930 of the cooler's exterior may form a fabric surface onto which may be attached a zipper assembly 918. The zipper assembly described may be comprised of two sides of corresponding teeth and zipper pulls 904. The zipper assembly 918 may include two zipper pulls 904 which may include t-shaped handles in order to allow for opening the cooler from either end. The zipper pulls 904 affixed to the top section 930 of the cooler exterior may be used to open and close the storage space defined by the walls of the inflatable chamber that comprise the cooler body. It will be appreciated that the cooler body may, in an inflated state, form a rigid body defining at least two sides of the cooler and a bottom section of the cooler in a single and continuous inflatable chamber that may be comprised at least partially of a drop-stitch fabric described above with reference to FIGS. 1A and 1B.

The front exterior surface 940 and rear exterior surface 938 of the example embodiment of inflatable cooler may be joined to one another on their topmost faces via the top layer 930 and may be opened and closed via the zipper assembly 918. It will be understood that the material of construction for the top layer 930 and the front and rear exterior surfaces, 940 and 938 respectively, may be common. For example, if the top layer 930 of the cooler's exterior surface is constructed at least partially from a material such as PVC, then the same may be true of both the rear 938 and front 940 exterior surfaces of the cooler. When opened, the top layer 930 may at least partially expose the storage space defined by the cooler body. The exterior surfaces of the cooler may include features or components that supplement the usefulness of the cooler such as straps and handles. For example, the exterior front 940 and rear 938 surfaces may include a double stitched extension of the looped strap 913 to secure the loop strap 914 to the exterior surface of the cooler embodiment. The double stitched extension 913 described may be inclusive of a padded web handle 908 extending from the innermost edges of the strap extension 913 and the padded web handle 908 may be used to carry or transport the cooler. Each of the front exterior 940 and the rear exterior 938 sections of the outermost surface of the cooler body may be inclusive of drains 902 that may be positioned on opposite diagonal ends of the cooler body, and may also include a space for logos 912 on the remaining two opposing diagonal corners of the cooler. The drains 902 that may be affixed to the exterior surfaces of the cooler body may be positioned in a manner that does not interfere with the cooler body (i.e. the inflatable chamber that defines the cooler body). In this way, a drain may be positioned above the bottom section of the cooler body's inflatable chamber, and within the space defined by the at least two outer walls of the cooler's drop-stitch chamber. By including drains on each of the most longitudinal sides of the cooler liquids may be drained from the storage space while still maintaining the rigidity of the cooler when in an inflated state. The drains 902 may further be positioned in a manner in which they extend from the bottom of the upper front and rear faces 928 of the cooler through a foam lined layer 1002 of the exterior surface that may not be at least partially constructed of a drop-stitch inflatable chamber.

Turning to FIG. 9B specifically, this figure shows a front profile view of an example embodiment of a collapsible inflatable drop-stitch cooler as partially described above with reference to FIG. 9A. As shown in this figure, a loop strap 914 may extend downward in a manner that may allow for double stitching of the loop strap 914 to secure it to the exterior faces 940 and 938 of the cooler. The loop strap 914 may be used to carry and transport the cooler between activities and may include a padded Velcro handle 924 positioned at the top center of one of the loop straps such that the handle may be used as a single point of contact when transporting the cooler via carrying the cooler by the loop straps 914. The inclusion of Velcro on the padded handle 924 may allow for the two straps, positioned on either front 940 or rear 938 faces of the cooler, to be coupled together which may provide for further ease of transport of the cooler. It will be noted that the loop strap may be inclusive of a brand logo 912 or other distinguishing mark to distinctly identify the inflatable cooler. The front 940 and rear exterior 938 faces may further comprise a junction 936 at which side exterior faces 926 join upper front and rear exterior faces 928 via a corner section 932 of the exterior fabric encasement layer. The corner section 932 of the cooler's exterior section may be constructed at least partially of a durable fabric such as PVC. Further, the corner section 932 may be visible from either of the sides 926 and either of the rear 938 and front 940 surfaces of the cooler and the corner section may join the aforementioned sections of the cooler exterior forming a single exterior encasement layer.

It will be noted that the corner section 932 may be constructed at least partially from a durable material such as PVC or other suitable material such that the exterior sides 926 and both rear 938 and front 940 sections of the cooler embodiment provided may be a common material although other materials may be used in further example embodiments. The upper front and rear faces 928 may be the exterior faces of the cooler that may include drains 902 and logos 912 as described above with reference to FIG. 9A. The drains and logos placed onto an upper front/rear face 926 may be positioned near the bottom of the fabric section above the double layered bottom 922 such that the components do not interfere with the reinforced cooler bottom. A side exterior face 926 of the cooler may feature an air valve 906 which may be used for inflating and deflating the chamber comprising the cooler body and may be positioned above the double layered bottom portion 922 of the cooler embodiment. The air valve 906 may be positioned on one of the sides of the cooler that includes a side of the cooler body's inflatable chamber such that the continuous chamber may be inflated and deflated from a single valve. In other words, an air valve 906 may be affixed onto a surface of the cooler that includes a wall of the inflatable chamber so that the chamber may be inflated and deflated. It will be understood that only a single air valve 906 may be necessary for inflating the chamber that defines the cooler body's two sides and a bottom. In this way, the ease of inflation and deflation of the cooler body may be increased because there is no need for multiple chambers, each having their own air valve. Further, a single continuous chamber forming the body of the cooler may reduce the time and effort needed to inflate or deflate the cooler while allowing for a variable rigidity throughout the cooler body.

When closed and secured via the zipper assembly 918, the storage space defined by the cooler body's side profile of the present embodiment may form a substantially trapezoidal shape wherein the bottom edge 922 of the cooler body may comprise the longer of the two parallel sides of the trapezoidal profile. In this way, the cooler may form a rectangular shape when opened fully and the profile shape may be variable depending on the level of inflation of the cooler body and whether or not the cooler is in an open or closed state with regard to the zipper assembly 918 being opened or closed. When viewed in a side profile view as shown in FIG. 9C, the side exterior features may be visible. The side exterior features may include an air valve 906, spaced for labels 916, and a padded web handle 908. A padded web handle 908 similar to that in FIG. 9B, may be disposed along and within the junctions 936 joining the side exterior faces 926 and the front 940 and rear 938 faces of the cooler exterior. The handle may be smaller than the handle affixed to the front and rear sides of the cooler and may be placed higher on the exterior surface of the cooler relative to the bottom section 922. A padded web handle 908 affixed to the side exterior faces 926 may allow for carrying and transporting the cooler in a manner in which the loop strap 914 may not be the primary handle. In this way, the cooler may be lifted in a horizontal fashion relative to the individual carrying or transporting the cooler. It will be understood that the term "cooler exterior" as used herein, refers to the outermost layer of the cooler body inclusive of the top section 930, front 940 and rear 938 surface faces, the bottom section 922, upper front and rear faces 928, side faces 926, and corner sections 932 also inclusive of the various components and features disposed onto the exterior surfaces mentioned and described above.

The cooler exterior may fully encapsulate the inflatable chamber of the cooler body within an outer layer that may be constructed of PVC or another suitable durable material. The cooler's exterior may also include other spaces for labels 916 that may contain warnings or brief instructions regarding safe handling of the cooler embodiment. The spaces for labels 916 may be placed onto the cooler exterior so as to not interfere with operation of the cooler and not to block or obstruct any of the features or components affixed to the cooler exterior. For example, labels 916 may be placed above the air valve 906 in some example embodiments of the inflatable drop-stitch cooler and below the padded web handle 908 with orientations and placements not limited to these. Further, the padded handle 908 of the example cooler embodiment may lie equidistant from the top and bottom sections of the foam lined 1002 front 940 and rear 938 faces of the exterior cooler surface.

It will be understood that the placement of exterior components that do not traverse the interior and exterior of the cooler may vary more widely than the placement of exterior components that do traverse the interior and exterior of the cooler due to the possibility of interference with the cooler body's inflatable chamber. For this reason, the components that traverse the interior and exterior of the cooler such as air valve 906 and drains 902 may be strategically placed such that they may perform their desired function while not restricting various aspects of the cooler embodiment design. For example, the air valve 906 may be placed elsewhere along the cooler so long as the valve may effectively inflate and deflate the cooler body's inflatable chamber and the chamber may stay inflated when the valve is closed. Similarly, the drains 902 of the cooler may be placed elsewhere along the foam lined layer 1002 of the front and rear exterior sections 940, 938 such that the drains 902 may not be directly coupled to or contact the inflatable chamber that defines the cooler body. In this way, an inflatable drop-stitch cooler may be inflated independently of the storage space defined by the cooler body being filled or emptied. View 920 shows the loop straps 914 affixed to each of the front 940 and rear 938 exterior faces of the cooler. In this view, the coupling of the two loop straps via the padded Velcro handle 924 may be inferred.

Turning now to FIGS. 10A-C, these figures show cutout views of an example embodiment of a drop-stitch inflatable cooler as described above with reference to FIGS. 9A-C. FIG. 10A specifically, shows a top-down view of a first embodiment of a drop-stitch inflatable cooler that is sliced horizontally across, parallel to the bottom edge 207 of the cooler body. The bottom edge 207 of the cooler body may form the reverse face of the interior bottom section 1004 of the drop-stitch inflatable chamber that defines the cooler body. In other words, the bottom section 1004 of the cooler body's interior cavity, also referred to herein as the storage space, may form the top edge of the bottom portion of the drop-stitch fabric used to at least partially construct the cooler body. The bottom edge 207 (per FIGS. 2-3) may be in face sharing contact with the reverse face of the cooler's exterior layer. In other words, the cooler body, defined by the inflatable drop-stitch chamber may have an outer edge 207, forming the reverse face of the interior cooler bottom surface 1004, which may be affixed to the exterior layer constructed of PVC or a similar waterproof material. In this view 1000, it may be more clearly apparent that the cooler body comprising a single inflatable chamber may comprise each of the two lesser extents of the rectangular profile and a bottom section 1004 of an example inflatable drop-stitch cooler embodiment. In the embodiment depicted in FIG. 10A, the two most longitudinal sides 1006 of the cooler body may include a layer of foam 1002 which may provide further insulation for the cooler. It will be appreciated that the most longitudinal sides 1006 of the cooler may not comprise a drop stitch fabric construction. The sides of the cooler 1006 that may not provide walls of the inflatable chamber may allow for a lesser degree of rigidity on front and rear surfaces when the cooler is in a fully inflated state. In this way, the cooler may be able to store a greater amount of contents due to an increased compliancy of the cooler sides 1006. In other words, the foam 1002 lined most longitudinal sides 1006 of the cooler may allow for "overfilling" the cooler with respect to a normal content load in which the cooler may fully maintain its shape due to the rigidity of the fully inflated cooler body.

The side walls of the cooler body (i.e. the lesser extents of the rectangular profile) of this embodiment, may comprise the drop-stitch fabric 204 wherein the first inner layer 201 of the drop-stitch fabric may form the interior of the cooler body and wherein a first outer layer 202 is coupled to an exterior fabric such as PVC that encapsulates the cooler body and the foam lined sides 1006. The first inner layer 201 may be coupled to the interior bottom section 1004 of the cooler body by any one of a method of scoring and sealing as described above with reference to FIGS. 2A, 2B, 3A, and 3B. A first outer layer 202 of the drop-stitch fabric may be affixed to the exterior layer of the cooler and may be secured using adhesives, heat fusion, and/or a combination thereof.

FIG. 10B shows a cutout view of FIG. 9B also in a manner that further illustrates the nature of the single continuous drop-stitch inflatable chamber that may comprise the cooler body disposed within an exterior layer. As discussed above, the cooler may have sides lined with foam 1002 and the foam lined sides of the cooler may form at least a portion of one or more sides of the cooler exterior. The foam lined 1002 front face 940 of the present embodiment is shown using a dashed line and may extend from one side exterior face 926 to the other. The foam lined sides may further be disposed between the top layer 930 of the external layer of the cooler body and the double-layered bottom portion 922 of the cooler such that it forms the upper front and rear faces 926 of the cooler's exterior fabric layer. It will be understood that the features of the present embodiment of a collapsible drop-stitch inflatable cooler that may be affixed to the exterior PVC or other waterproof fabric layer of the cooler are denoted via dashed line segments. The exterior layer may form all or a portion of the exterior of an example cooler embodiment and may provide additional reinforcement and strength to the overall design of an inflatable drop-stitch cooler.

In embodiments including flexible front and rear edges, the flexible edges may be comprised of a material other than drop stitch fabric. For example, the bottom interior section 1004 of the cooler body may be coupled to the side walls 1012 via a method of scoring and sealing as described above. Since the bottom interior surface and the two least longitudinal ends of the cooler body may be coupled forming a single inflatable chamber, the cooler body may define a substantially u-shaped profile when viewed from the front or rear. The two most longitudinal ends of the cooler body however may not be constructed from a drop stitch fabric such that when fully inflated, the cooler may still retain a level of flexibility while exhibiting a substantially rigid body.

The exterior features of the cooler embodiment may be positioned in a manner either traversing the interior and exterior of the cooler such as the drains 902 placed on the front and rear surfaces or may be placed such that they may be affixed solely to the exterior surfaces such as the double stitched extension of the loop strap 913 and the padded handle 908 on the front and rear exterior faces of the cooler illustrated with a dashed line.

View 1010 shows how the cooler body, defined by the drop-stitch inflatable chamber, may form a substantially u-shaped storage space when in a fully inflated state. The entirety of the cooler body as defined by the inflatable chamber may be constructed at least partially from drop-stitch fabric 204 and may include an exposed area along the corners formed at bends within in the chamber construction that may not include drop-stitching. In this way, it may be possible to construct the chamber illustrated by FIG. 10B using one or more pieces of drop-stitch fabric via one of the methods of scoring and sealing discussed above with reference to FIGS. 2 and 3. It will be understood that upon inflating the cooler to various levels of inflation and thereby varying the rigidity of the cooler body, the shape of the cooler may be slightly variable. In other words, the shape of the inflatable chamber may be adjusted based on the contents of the storage cavity and the chamber's level of inflation.

Similarly to FIG. 10B, FIG. 10C shows a cutout view of FIG. 9C such that the continuous nature of the single inflatable chamber is further exemplified. It will be understood that the figures provided may display the example embodiments of an inflatable cooler in a fully inflated state, thereby showing well-defined profile shapes. Other shapes or variations of similar shapes may also form the shape of the cooler body dependent upon the level of inflation as well as the storage load within the cooler as previously discussed.

A first outer layer 202 of a drop-stitch fabric 204 forming the outer portion of the inflatable cooler body may be secured to a rear face of the insulation foam layer 1002 such that the two layers are in direct contact with one another. The first outer layer 202 may be coupled to the bottom interior section 1004 of the cooler such that the two layers are in direct face-sharing contact with each other forming a continuous layer of a first inner layer 201 of a drop-stitch fabric. This continuous layer may extend along each edge of the substantially trapezoidal profile shape provided by this example embodiment other than the top. In other words, the inflatable drop-stitch chamber of the embodiment discussed above may form a single continuous chamber spanning both of the non-parallel legs and including the longer of the two parallel bases of the trapezoid shape. The single chamber may then be disposed into an exterior layer comprising the double-layered bottom section 922 of the cooler's surface and the exterior layer comprising the top section 930, side exterior faces 926, and the front and rear exterior faces 940,938. The double layered bottom section 922 of the cooler may be constructed at least partially from materials such as PVC or Nylon, inclusive of combinations thereof. In this way, the bottom of the cooler may be further reinforced so as to address potential issues with degradation of the construction materials resultant from prolonged or heavy usage of the cooler.

An additional embodiment of a collapsible inflatable drop-stitch cooler provided herein may include an inflatable cooler body comprising a single inflatable chamber, constructed from a single piece of drop-stitch fabric similar to the embodiments discussed and described above. This example embodiment may form a slightly less trapezoidal profile shape when viewed on its side profile, relative to the example embodiment shown in FIGS. 9 and 10. The cooler body may also include a first inflation air valve 906 that may be located near the bottom surface of the cooler and may be in direct contact with one of the side exterior faces 926. The cooler's exterior surface may include handles 908 on the exterior surface of each wall and may be comprised of a fabric such as nylon or other durable material. The cooler body may include drain valves 902 integrated into the bottom of the cooler walls in order to allow for draining of liquid from the storage compartment defined by the cooler body. Similarly to the previously described embodiments of an inflatable drop-stitch cooler, when viewed from above or in a direct front profile view, the cooler may form a substantially rectangular shape wherein the body of the cooler may be a u-shape formed by joining a bottom section of an inflatable chamber with two side sections to provide a single continuous inflatable chamber. As discussed above, the inflatable chamber may define the cooler body and may provide rigid structural support for the cooler when in an inflated state. In other words, when inflated the example cooler body may provide the structural basis from which the cooler depends in order to form a rigid or semi-rigid frame essentially.

Figure 11A:
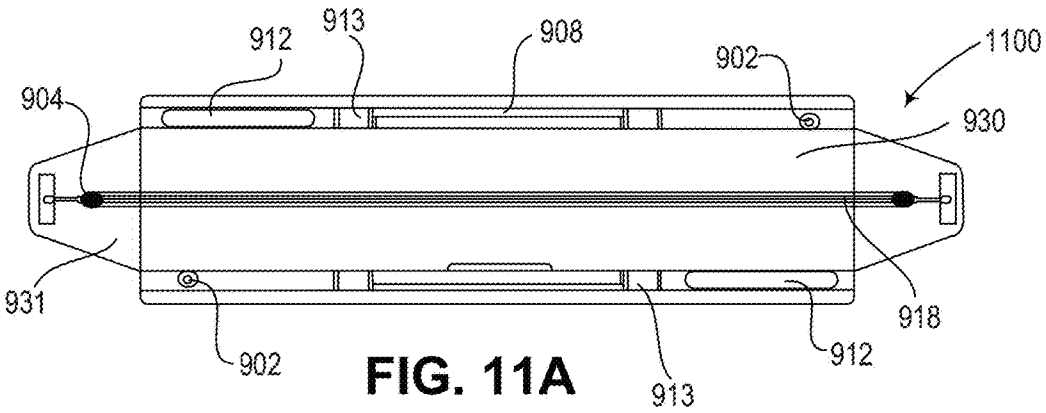
FIG. 11A shows a top-down view of a fourth inflatable cooler embodiment.
Figure 11B:
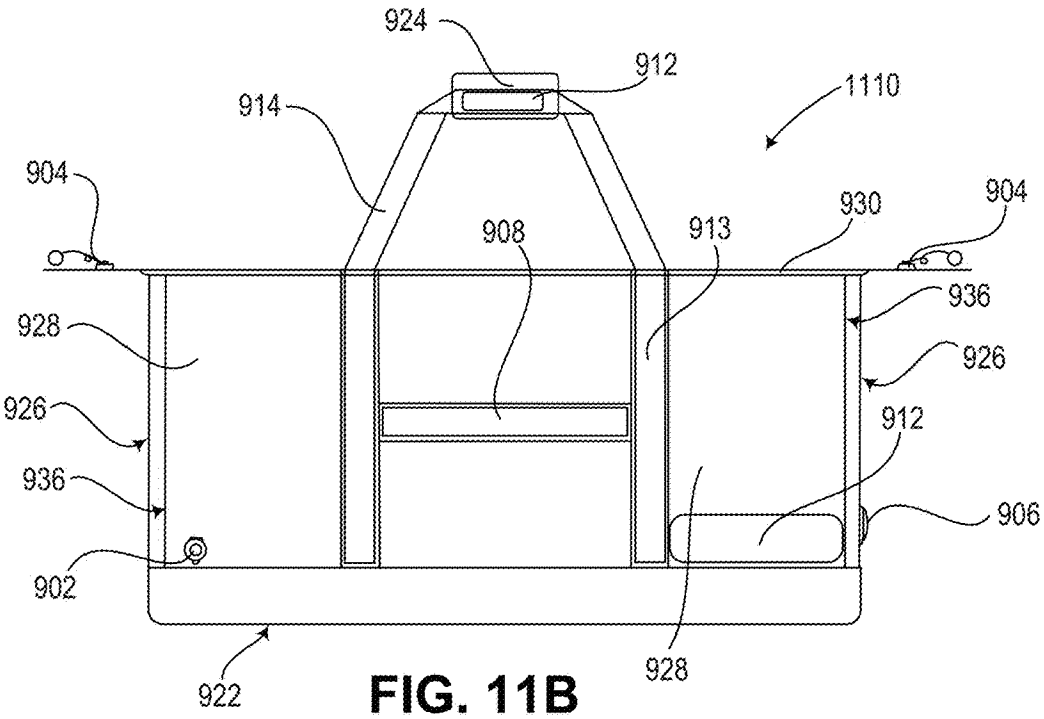
FIG. 11B shows a front profile view of a fourth inflatable cooler embodiment.
Figure 11C:
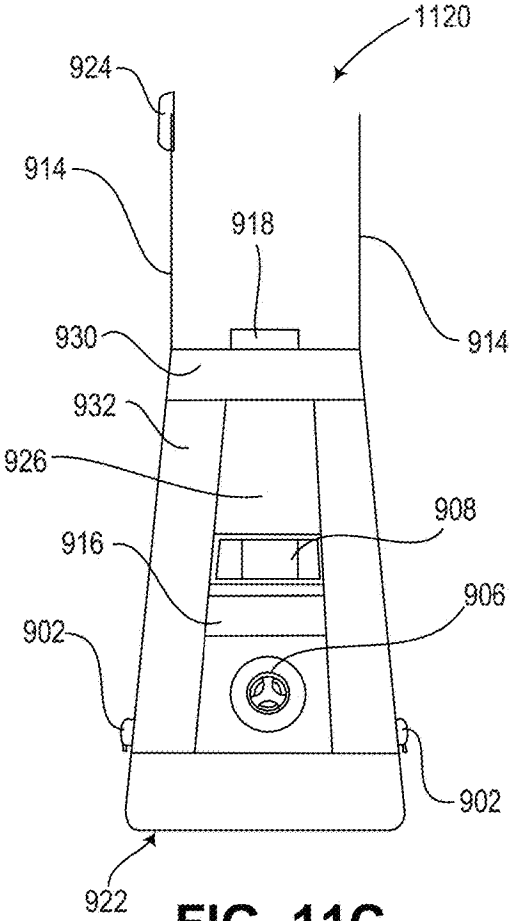
FIG. 11C shows a side profile view of a fourth inflatable cooler embodiment.

FIGS. 11A-C show various views of the additional example embodiment of a collapsible drop-stitch inflatable cooler discussed briefly above. Again, the common features of the various embodiments provided herein are represented by using the same reference characters throughout the figures and specification. The embodiment displayed in these figures may exhibit a substantially less trapezoidal profile shape with respect to the embodiments presented in FIGS. 9C and 10C. The difference in shape of the side profile view 1120 may be due to reduced dimensions of the cooler with respect to the overall length, width and height of the cooler. For instance, the cooler embodiments discussed above with reference to FIGS. 9 and 10, may form their substantially trapezoidal profile shape due to increased dimensions of the embodiment. In this way, an embodiment with a narrower base for example, may form a less trapezoidal profile simply because there may be less distance between the two most longitudinal sides of the cooler body. View 1100 of an additional example cooler embodiment shows a top-down view of a collapsible drop-stitch inflatable cooler that may have a slightly thinner profile than that of the third example embodiment 400. Again, the thinner profile of this embodiment may be resultant from reduced overall dimensions of the cooler body, and common features of the various embodiments are represented via the same reference character.

Similar to the earlier provided embodiments, a plurality of logos 912, drains 902, web handles 908, and loop straps 914 may be affixed onto the exterior fabric of the cooler. The components such as the loop straps and web handles may be affixed to the exterior surface of the cooler such that they do not cross into the storage cavity of the cooler and may be in direct contact with only the external layer. Components such as the drains and air valve 906 may however fully traverse one or more layers of the exterior surface of the cooler or the cooler body defined by the inflatable chamber so as to not interfere with the usability of the cooler. Specifically, the drains may fully traverse the external layer of the cooler and the foam lining 1002 of the side external layers, while the air valve 906 may fully traverse the exterior fabric layer but may only traverse the first outer layer 202 of the drop-stitch inflatable chamber.

Figure 12C:
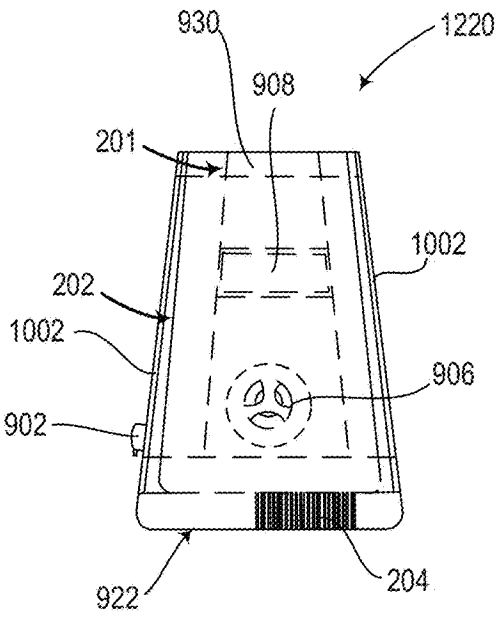
FIG. 12C shows a side profile view of a cutaway section of a fourth inflatable cooler embodiment.
Figure 12A:
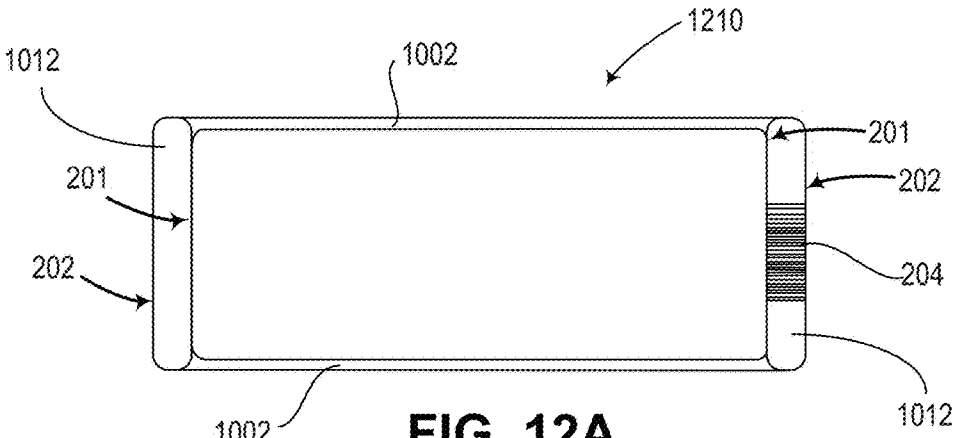
FIG. 12A shows a top-down view of a cutaway section of a fourth inflatable cooler embodiment.
Figure 12B:
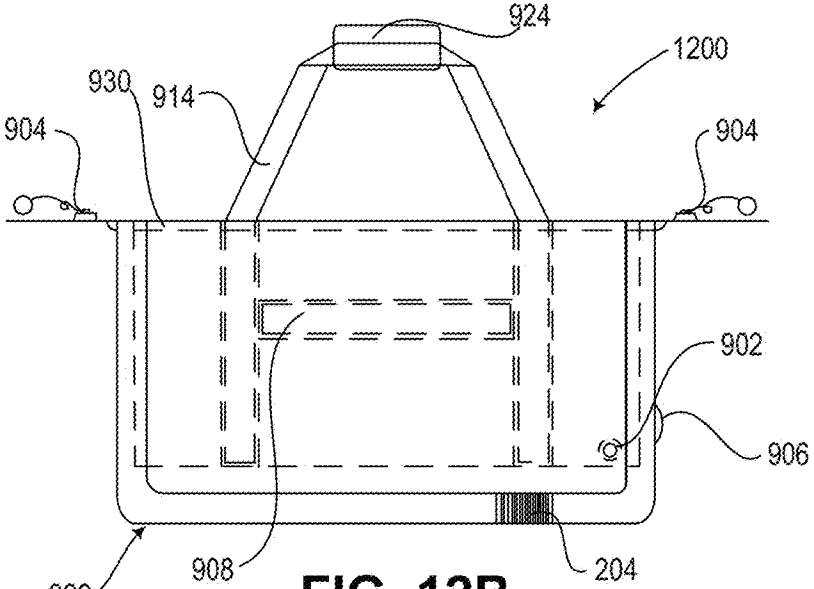
FIG. 12B shows a front profile view of a cutaway section of a fourth inflatable cooler embodiment.
Figure 13A:
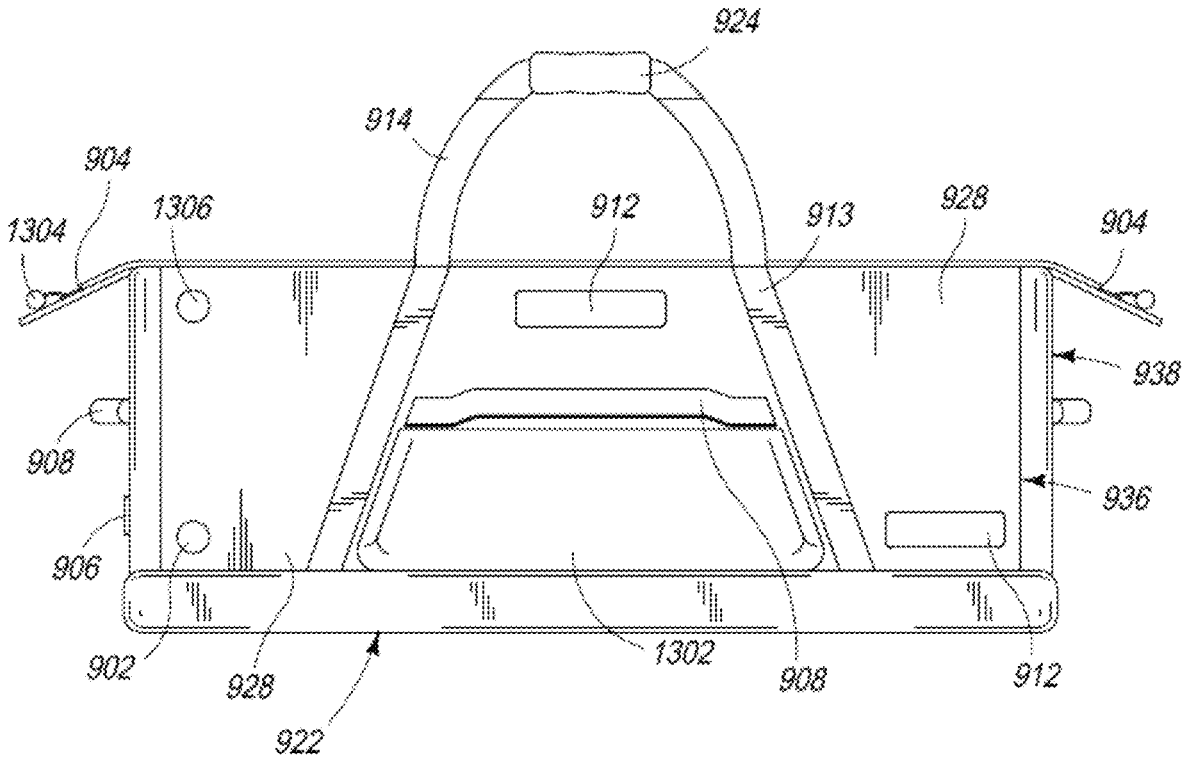
FIG. 13A shows a front profile view of a fifth inflatable cooler embodiment.
Figure 13B:
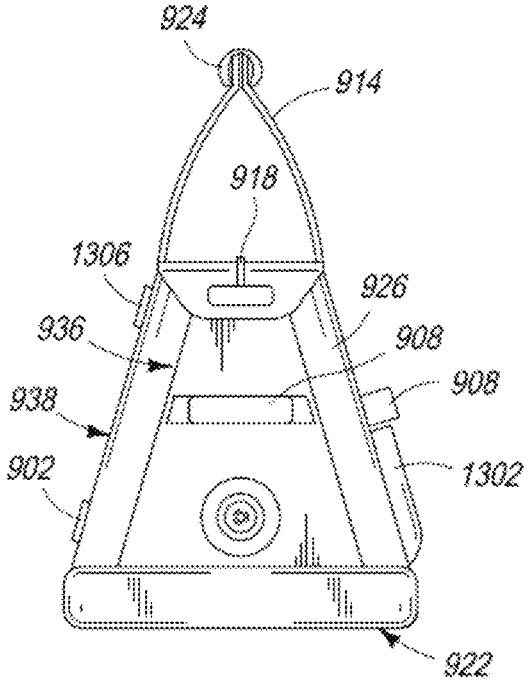
FIG. 13B shows a side profile view of a fifth inflatable cooler embodiment.
Figure 13C:
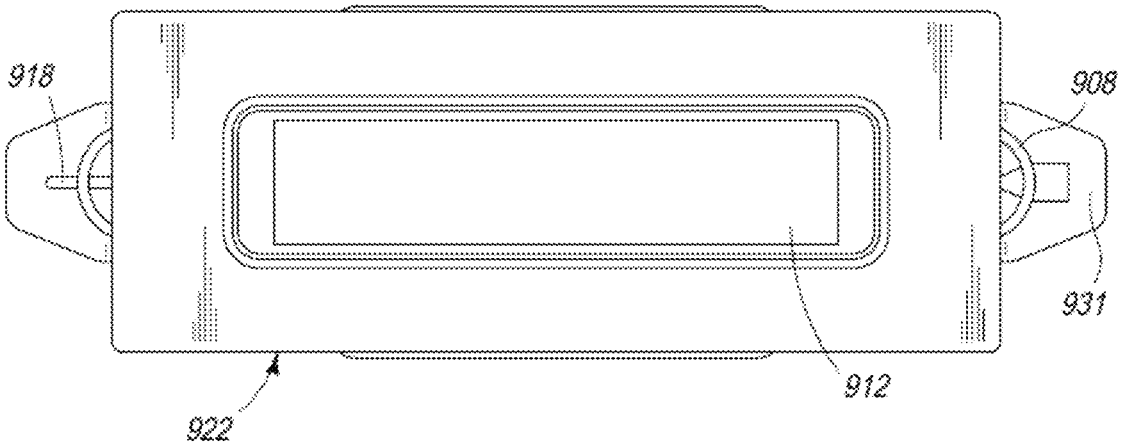
FIG. 13C shows a bottom view of a fifth inflatable cooler embodiment.

The additional example embodiment views described above and provided in FIGS. 11A-C are shown in a cutout manner in FIGS. 12A-C. The cutouts of the second provided example embodiment display the nature of the single inflatable chamber that may form the cooler body extending along the bottom surface 922 of the cooler and including the two sides along the lesser extent of the rectangular profile produced by the inflatable cooler design. It will be understood that the common features and components of the various example embodiments provided herein may be applied to this and further embodiments of collapsible inflatable drop-stitch inflatable coolers and common features may be indicated as such with common reference characters. Again, this additional example embodiment may have an interior storage space or cavity that may be formed by joining the bottom edge 207 of the inflatable chamber that defines the cooler body with an interior bottom section 1004, such that the storage cavity may be defined by and contained within each of the three sections of the inflatable chamber. The inflatable chamber thereby, may form a frame for the cooler, providing a rigid structure that may fully support the external surfaces of the cooler when in an inflated state. In this way, it may also be advantageous to have a single inflatable chamber design when the cooler is in a deflated state for at least the reason that the cooler body may be fully collapsible and may be substantially thinner relative to a cooler in a fully inflated state. While the overall size and shape of the cooler body may vary, the applicability and usefulness of the embodiments provided herein are not to be viewed in a limiting fashion. For example, the advantages of constructing a cooler with a single inflatable chamber may be applied to other embodiments not limited to those listed and described herein.

In embodiments including flexible front and rear edges, the flexible edges may be comprised of a material other than drop stitch fabric. For example, the bottom interior section 1004 of the cooler body may be coupled to the side walls 1012 via a method of scoring and sealing as described above. Since the bottom interior surface and the two least longitudinal ends of the cooler body may be coupled forming a single inflatable chamber, the cooler body may define a substantially u-shaped profile when viewed from the front or rear. The two most longitudinal ends of the cooler body however may not be constructed from a drop stitch fabric such that when fully inflated, the cooler may still retain a level of flexibility while exhibiting a substantially rigid body.

Yet another example inflatable drop-stitch bag style cooler comprising an exterior layer that is not constructed from a drop-stitch fabric as described above with reference to FIGS. 1-3, and a storage space defined by the inflatable drop-stitch chamber is provided in FIGS. 13A-C. Similarly to other previously described embodiments, this example embodiment of a cooler may form a substantially rectangular profile when viewed from the front or rear with respect to the cooler body, and may additionally form a substantially trapezoidal shape when viewed from either of the two lesser sides as shown in FIG. 13A and FIG. 13B respectively. The exterior layer may comprise a top layer 930, a front exterior face 940, a rear exterior face 938, corner sections 932, top exterior flaps 931, a double-layered bottom section 922, and upper front and rear faces 928 of the cooler body's exterior. Labels and logos 912 may be affixed to the exterior layer such that their placement does not affect or hinder the usefulness of other exterior features such as the drain plugs 902 or the loop strap 914. For example, a label 912 may be affixed onto a front surface of the cooler's exterior layer below the zipper assembly 918 and above a padded handle 908 such that the logo is clearly visible, and the handle 908 and zipper assembly 918 may still be used to transport or open and close the storage compartment respectively. Further, the embodiment provided in FIGS. 13A-C may have additional exterior features and components such as a mesh pocket 1302, a hose plug 1306, and a t-shaped attachment 1304 that may be used in conjunction with zipper pulls 904 to open and close the storage compartment of the cooler more easily. An exterior bottom surface 922 of this example embodiment may additionally be constructed at least partially of a transparent material such as TPU such that a logo 912 affixed to the bottom surface may be visible. For example, a logo 912 may be placed between the layers of a double layered bottom surface 922 where an outermost layer is a transparent material such as TPU. In this way, the sturdiness of the cooler may be maintained or improved while not detracting from the overall visual aesthetics of the cooler.

A drain plug may be affixed to an upper corner of the cooler's exterior such that it fully traverses both the cooler's external layer and the foam lining 1002 of the side walls not constructed from a drop-stitch fabric. In this way, the drain plug 1306 may serve as a way to fill the cooler body with water as well as provide overflow protection if the cooler were to become overfilled with liquid. The drain plug 1306 may provide additional capabilities to the cooler not afforded by those of prior art. For example, filling the cooler with water may allow for filling the cooler with water in order to use the cooler as a portable tank to house live bait. Further, the drain 902 and hose plug 1306 may allow for the water within the cooler to be removed and replaced with fresher water to prolong the cooler's functionality as a bait tank. Additionally, the hose plug may be used to flush and rinse the storage compartment of the cooler when it is to be cleaned. Another exterior feature provided in this example embodiment is a mesh layer which may serve as a pocket 1302 and may be affixed onto the outermost exterior surface of an upper front face 928 of the cooler via adhesives, heat fusion, stitching, and/or a combination thereof.

Figure 14A:
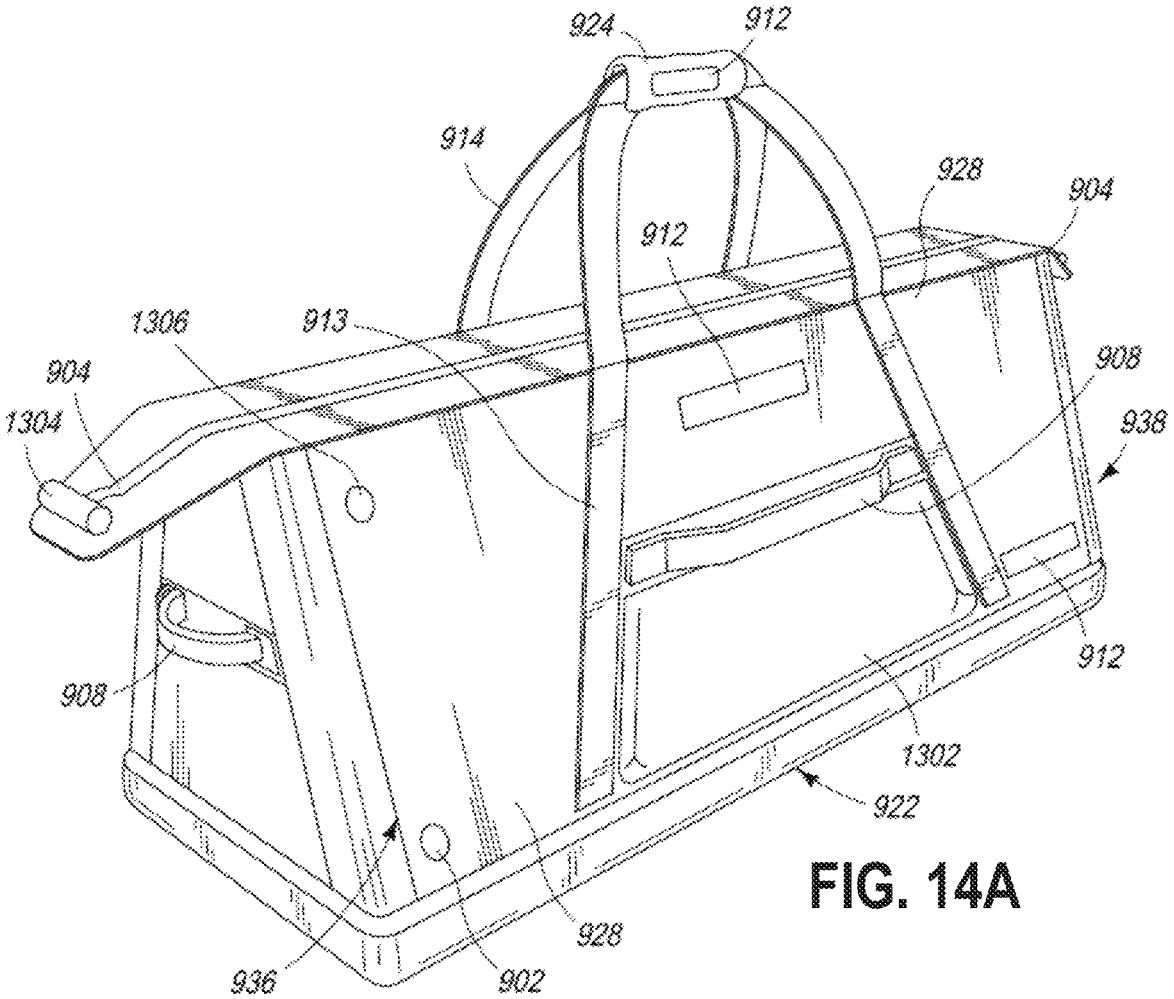
FIG. 14A shows a left, front, isometric view of a sixth inflatable cooler embodiment.
Figure 14B:
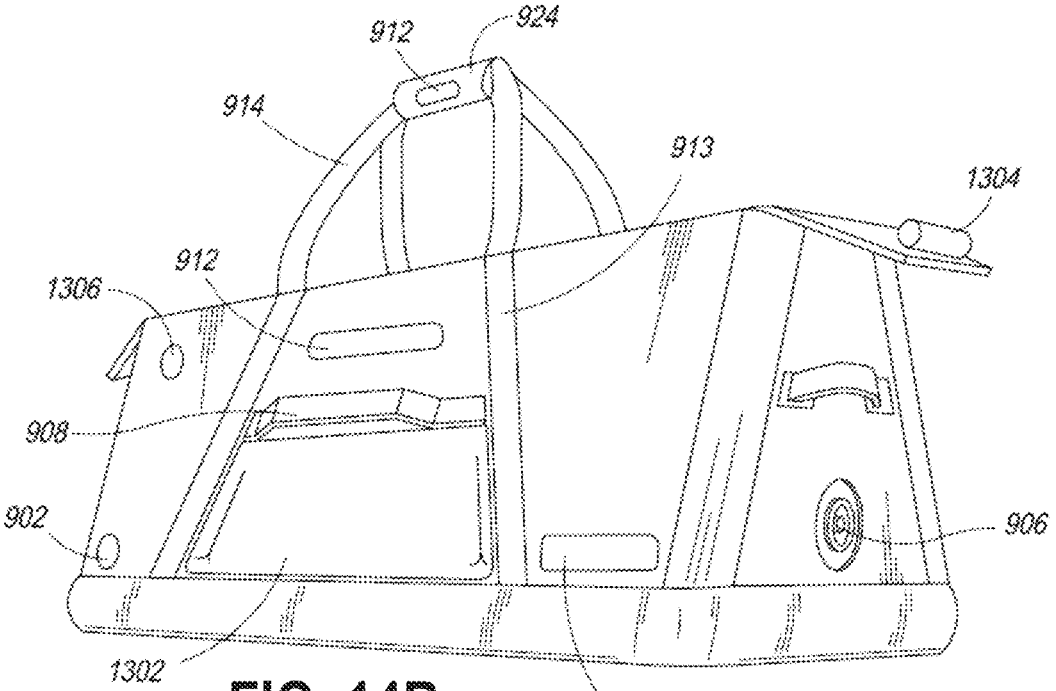
FIG. 14B shows a right, front, isometric view of a sixth inflatable cooler embodiment.
Figure 14C:
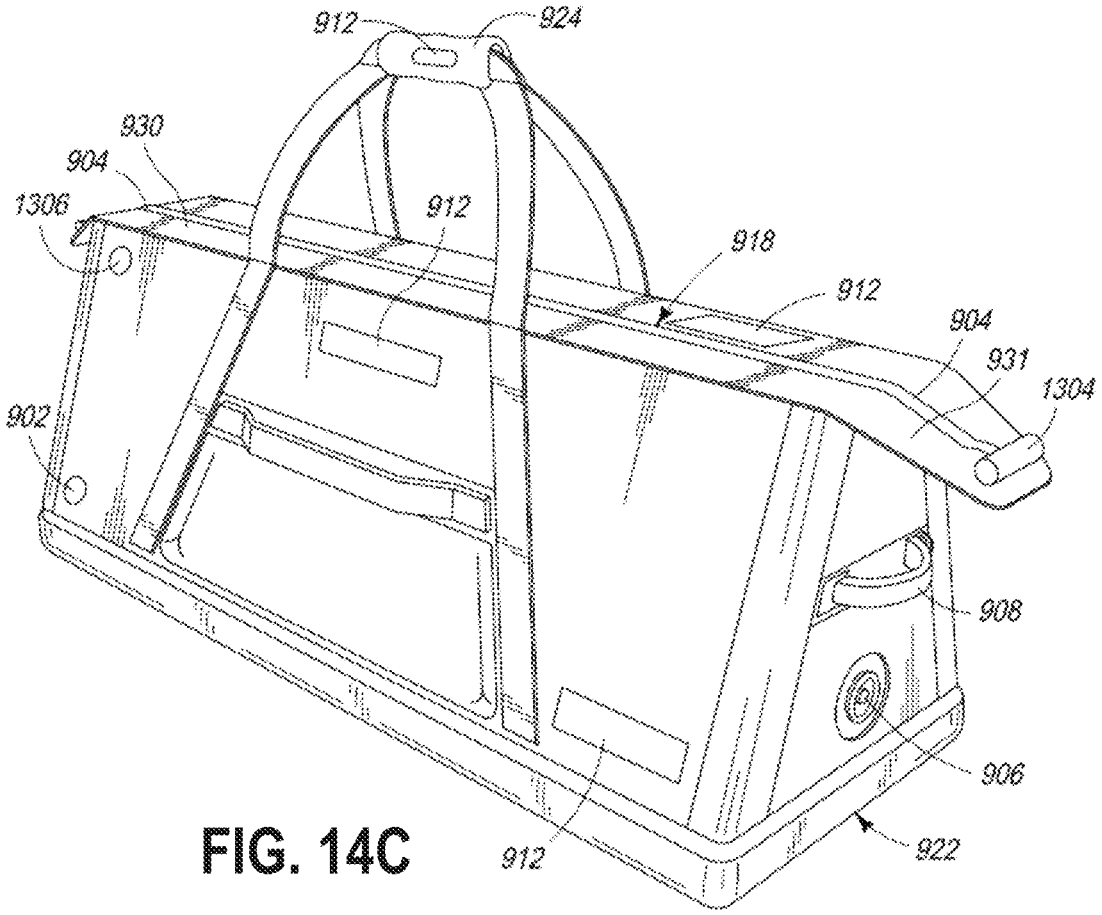
FIG. 14C shows a top-down, right, front, isometric view of a sixth inflatable cooler embodiment.

Turning now to FIG. 14A, a sixth inflatable cooler embodiment is provided. Again, this example embodiment may form a substantially rectangular profile when viewed from the front or rear with respect to the cooler body, and may additionally form a substantially trapezoidal shape when viewed from either of the two lesser sides as shown in FIGS. 13A and 13B. The exterior layer may comprise a top layer 930, a front exterior face 940, a rear exterior face 938, corner sections 932, top exterior flaps 931, a double-layered bottom section 922, and upper front and rear faces 928 of the cooler body's exterior.

Additionally, labels and logos 912 may be affixed to the exterior layer such that their placement does not affect or hinder the usefulness of other exterior features such as the drain plugs 902 or the loop strap 914. For example, a label 912 may be affixed onto a front surface of the cooler's exterior layer below the zipper assembly 918 and above a padded handle 908 such that the logo is clearly visible, and the handle 908 and zipper assembly 918 may still be used to transport or open and close the storage compartment respectively. Further, the embodiment provided in FIGS. 14A-C may have additional exterior features and components such as a mesh pocket 1302, a hose plug 1306, and a t-shaped attachment 1304 that may be used in conjunction with zipper pulls 904 to open and close the storage compartment of the cooler more easily. An exterior bottom surface 922 of this example embodiment may additionally be constructed at least partially of a transparent material such as TPU such that a logo 912 affixed to the bottom surface may be visible. For example, a logo 912 may be placed between the layers of a double layered bottom surface 922 where an outermost layer is a transparent material such as TPU. In this way, the sturdiness of the cooler may be maintained or improved while not detracting from the overall visual aesthetics of the cooler.

A drain plug may be affixed to an upper corner of the cooler's exterior such that it fully traverses both the cooler's external layer and the foam lining 1002 of the side walls not constructed from a drop-stitch fabric. In this way, the drain plug 1306 may serve as a way to fill the cooler body with water as well as provide overflow protection if the cooler were to become overfilled with liquid. The drain plug 1306 may provide additional capabilities to the cooler not afforded by those of prior art. For example, filling the cooler with water may allow for filling the cooler with water in order to use the cooler as a portable tank to house live bait. Further, the drain 902 and hose plug 1306 may allow for the water within the cooler to be removed and replaced with fresher water to prolong the cooler's functionality as a bait tank. Additionally, the hose plug may be used to flush and rinse the storage compartment of the cooler when it is to be cleaned. Another exterior feature provided in this example embodiment is a mesh layer which may serve as a pocket 1302 and may be affixed onto the outermost exterior surface of an upper front face 928 of the cooler via adhesives, heat fusion, stitching, and/or a combination thereof.

In one embodiment, the inflatable cooler may comprise an insulation layer comprising an aluminum foil bubble material that may be disposed between PVC layers along each long side of the cooler. For example, in at least one embodiment, the foam lined layer 1002 of the cooler may be replaced with an aluminum foil bubble material. In this way, the storage compartment may be further insulated from exterior conditions and the reflective nature of the aluminum foil may reduce radiant thermal transfer.

In at least one embodiment, the zipper assembly 918 may comprise a No. 10 large tooth all plastic zipper. In some examples, the zipper assembly 918 may further comprise t shaped pull handles that may be constructed from plastic or other suitable lightweight and resilient materials.

An example technical effect of constructing the cooler with a single inflatable chamber is that the speed and ease of inflation and deflation may be improved because there may be a single air valve as opposed to one for each section of the inflatable chamber. This may allow for quickly deflating and collapsing the cooler to be stored when not in use, as well as quickly inflating the cooler prior to its use. Further, when the cooler is deflated, it may collapse into a substantially thinner profile than that of the fully inflated cooler body and may be further compressed since the drop-stitch fabric used in the chamber construction may be flexible when not inflated. In this way, the portability of the cooler may be greatly supplemented. An example technical effect of positioning the inflation air valve 906 on the exterior surface of the cooler may be to allow for quick and easily accessible inflation and deflation of the cooler body. With the air valve placed on the exterior, the cooler may not have to be opened or closed prior to inflation or deflation of the chamber.

Figure 15B:
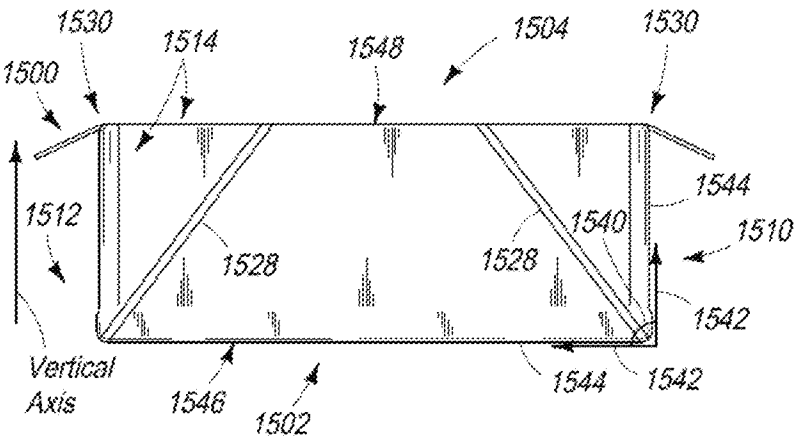
FIG. 15B shows a side view of a seventh inflatable cooler embodiment in the expanded configuration.
Figure 15D:
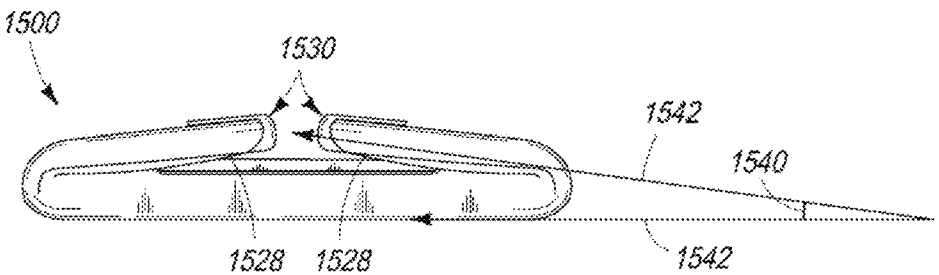
FIG. 15D shows a side view of a seventh inflatable cooler embodiment in the condensed configuration.
Figure 15A:
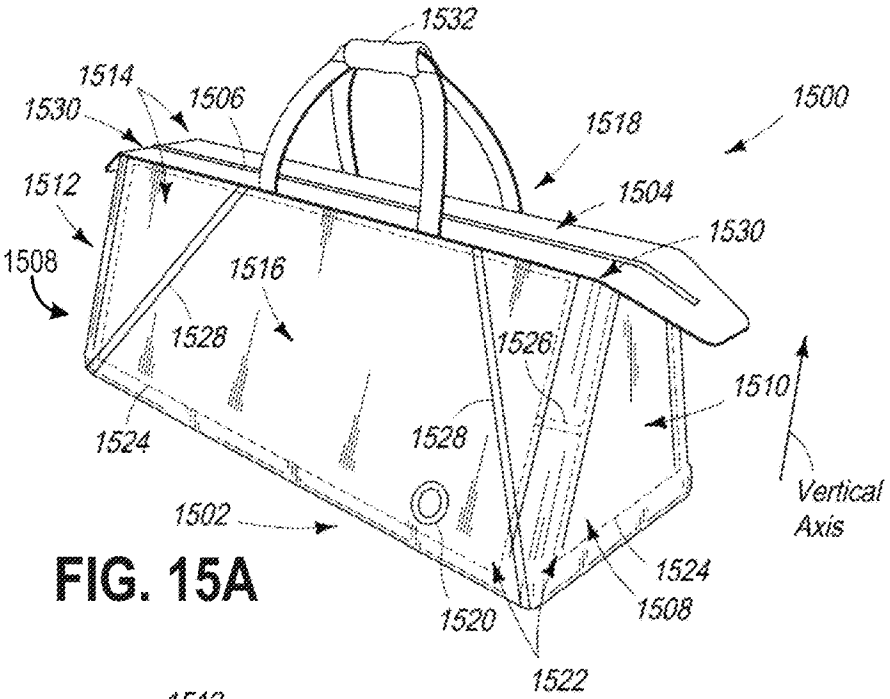
FIG. 15A shows a perspective view of a seventh inflatable cooler embodiment in an expanded configuration.
Figure 15C:
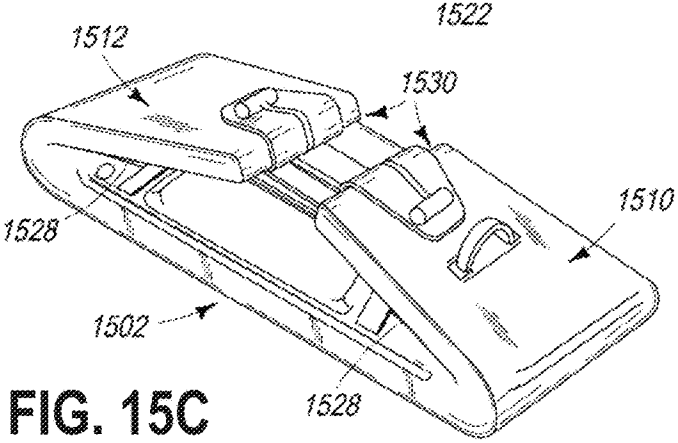
FIG. 15C shows a perspective view of a seventh inflatable cooler embodiment in a condensed configuration.
Figure 16:
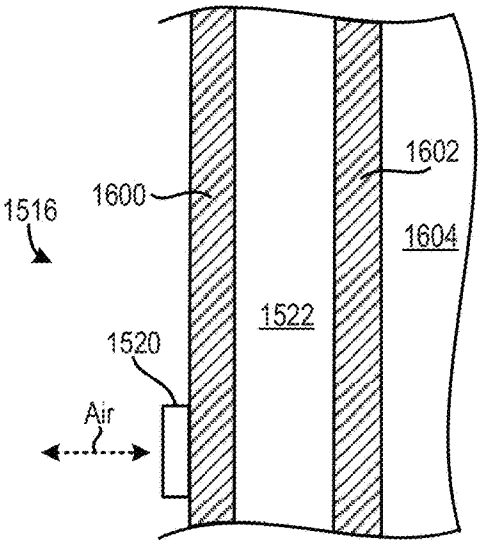
FIG. 16 shows a cut-away view of a layer of the inflatable cooler shown in FIGS. 15A-15D.

Turning now to FIGS. 15A-15C, a seventh inflatable cooler embodiment is provided. The inflatable cooler 1500 includes a bottom portion 1502 and a top portion 1504. As shown, the top portion 1504 includes a sealing mechanism 1506 such as zipper or other suitable sealing mechanism. In one example, the sealing mechanism may be substantially watertight and/or airtight to reduce the likelihood of cooler leakage and improve insulation characteristics. However, numerous suitable sealing mechanisms have been contemplated. The sealing mechanism 1506 enable a user to open or close the cooler to access or seal goods stored within such a food, beverages, and/or other items. The bottom portion 1502 may include foot elements, as previously described herein.

The inflatable cooler 1500 also includes a plurality of sides. Each of the sides extends between the top portion 1504 and the bottom portion 1502. The sides and the top and bottom portions form boundaries of an interior storage compartment, such as the storage compartments described with regard to the other cooler embodiments. The sides can be conceptual divided into pairs and in the depicted embodiment the inflatable cooler 1500 includes four sides. However, other inflatable cooler 1500 layouts have been contemplated such as cooler having less or more than four sides, such as a cooler with three sides or six sides, for instance. The inflatable cooler 1500 therefore includes a first pair of sides 1508 with a first side 1510 and a second side 1512. The inflatable cooler 1500 additionally includes a second pair of sides 1514 with a third side 1516 and a fourth side 1518. The first side 1510 and the second side 1512 are positioned to oppose one another. Likewise, the third side 1516 and the fourth side 1518 are positioned to oppose one another. The inflatable cooler 1500 has a trapezoidal shape in the depicted embodiment. However, other cooler shapes have been contemplated. In the depicted example, the first side 1510 and the second side 1512 have a similar boundary profile. That is to say the shape of the peripheral regions of the first and second sides of the cooler may be substantially identical. Likewise in the depicted example, the third side 1516 and the fourth side 1518 have a similar boundary profile. It will be appreciated that in some instances each side may include different accessories such as pockets, attachment features, valves, etc., and that sides with varying geometries have also been contemplated.

The inflatable cooler 1500 may be set in an expanded or condensed configuration based on a user's predilection. In FIGS. 15A-15D the inflatable cooler 1500 is shown in different configurations. Specifically, FIGS. 15A and 15B shows the inflatable cooler 1500 in an expanded configuration and FIGS. 15C and 15D show the inflatable cooler 1500 in a condensed configuration. As such, the cooler can be compacted to enable easy storage, transportation, etc., when user of the cooler for storage of contents is not desired. For instance, a user may want to store their cooler in a compact manner when not in use. As such, the cooler may be arranged in the condensed configuration during storage, transport, etc., and then subsequent arranged into the expanded configuration when use of an interior storage compartment is desired. For instance, a user may store the cooler in a compacted form in the trunk of a car until contents such as ice, food, beverages, etc., are procured by the user. The cooler may then be quickly inflated and the items may be placed inside an interior storage compartment. In this way, the cooler's configuration can be altered, thereby increasing the adaptability and convenience of the cooler. In other examples, the cooler may be commercially shipped in the condensed configuration to reduce shipping costs. Retailers can also store the coolers in a condensed configuration to reduce the amount of space needed for cooler storage. Furthermore, the inflatable cooler 1500 configured for collapsibility may be particularly useful in any circumstance where space is at a premium such as small planes, boats, etc.

Now specifically referring to FIG. 15A, the inflatable cooler 1500 includes an inflation valve 1520 configured to enable inflation and deflation of an inflation chamber 1522 include in the inflatable cooler 1500. Thus, the inflation valve 1520 may be configured to accept a pump, in one example. The inflation chamber 1522 may include sections 1524 positioned in different sides of the cooler. In such an example, the sections may have fluidic communication (i.e., air can flow between the sections) via a connection section 1526. However, in other examples each section of the inflation chamber 1522 may have an associated inflation valve or a first set of inflation chamber sections may be in fluidic communication with a first inflation valve and a second set of inflation chamber sections may be in fluidic communication with a second set of inflation chamber sections. In such an example, the sections of the inflation chambers may be included in adjacent sides, in one instance, or on opposing sides, in another instance.

In another example, the inflation chamber 1522 may be included in the first pair of sides 1508 and the second pair of sides 1514. In yet another example, the inflation chamber 1522 may only be included in the second pair of sides 1514. In such an example, the first pair of sides may include foam or other forms of insulation material. Inflating the inflation chamber 1522 may move the inflatable cooler 1500 include the expanded configuration, shown in FIGS. 15A and 15. On the other hand, deflation of the inflation chamber 1522 may move the inflatable cooler 1500 into the condensed configuration, shown in FIGS. 15C and 15D. In other example, additional input from the user may be needed to urge the cooler into the different configurations such as extending/retracting straps, pushing/pulling the first pair of sides 1508, etc.

The first pair of sides 1508 includes a plurality of foldable sections 1528 that enable the sides of the cooler to be arranged in the expanded configuration shown in FIG. 15A and the different condensed configurations shown in FIGS. 15B and 15C. Although only the foldable sections 1528 on the third side 1516 are depicted in FIG. 15A it will be appreciated that the fourth side 1518 also has similar foldable sections 1528. The foldable sections 1528 extend toward one another, in the illustrated example. Additionally in the illustrated example, the foldable sections 1528 extend in a vertical direction. However in other examples, the foldable sections may have alternate contours. When folded the foldable sections 1528 may crease to enable first side 1510 and the second side 1512 to be folded down toward the bottom portion 1502.

Continuing with FIG. 15A, in the expanded configuration distal ends 1530 of the first side 1510 and the second side 1512 of the inflatable cooler 1500 are further away from the bottom portion 1502 when compared to the distal ends 1530 of the first side 1510 and the second side 1512 in the condensed configuration shown in FIGS. 15C and 15D. FIG. 15A also shows the inflatable cooler 1500 with a handle 1532 enabling a user to easily carry the cooler in the expanded configuration.

FIG. 15B shows an angle 1540 that is formed between the first side 1510 and the bottom portion 1502 of the inflatable cooler 1500. It will be appreciated that the second side 1512 may also form a similar angle with the bottom portion 1502. As shown, the angle 1540 is measured from lines 1542 parallel to and/or extending through outer surfaces 1544 of the first side 1510 and the bottom portion 1502. When the outer surfaces are curved tangent lines may be used to measure the angle. The angle 1540 quantifies an angular position between the first side 1510 and the bottom portion 1502. The angle 1540 is substantially 90 degrees in the embodiment depicted in FIG. 15A. In this orientation the first side 1510 and the second side 1512 may be arranged in a vertical orientation, when the cooler is on a level surface. However, it will be appreciated that the inflatable cooler 1500 maybe be configured such that the angle may be adjusted. The adjustment may be achieved by at least partially deflating the inflation chamber 1522, shown in FIG. 15A, and folding the sides of the cooler along the foldable sections 1528. As such, users can place the cooler in a desired configuration. The angle 1540 can range from 0-90 degrees, in one example. In other examples, the angle 1540 may range from 0-80 degrees or from 15-75 degrees. However other angular ranges have been contemplated. The thickness of the sides and bottom portion as well as other design factors may affect the angular range. It will be appreciated that the second side 1512 may be folded in a similar manner to the first side 1510.

Additionally, in FIG. 15B the foldable sections 1528 extend between an intersection 1546 between the bottom portion 1502 and the second pair of sides 1514 and an intersection 1548 between the top portion 1504 and the second pair of sides 1514. The placement of the foldable sections in this way enables the compact configuration to be achieved.

FIGS. 15C and 15D show the inflatable cooler 1500 in the condensed configuration. As shown, in FIG. 15C the first side 1510 and the second side 1512 are folded down towards the bottom portion 1502. As described above, the foldability of the cooler enables the configuration adjustment. The foldable sections 1528 are shown creased in FIGS. 15C and 15D.

FIG. 15D shows the angle 1540 between the first side 1510 and the bottom portion 1502. It will be appreciated that the angle 1540 is decreased when the cooler is placed in the condensed configuration from the expanded configuration. In the condensed configuration the angle 1540 may be 30 degrees, 15 degrees, 0 degrees, etc. The magnitude of the angle may depend on the thickness of the cooler sides as well as other factors. It will be appreciated that when the angle 1540 is small, in the condensed configuration, a more compact cooler profile to be achieved to enable the inflatable cooler to be easily handled, transported, stored, etc.

FIG. 16 shows a cross-section of the third side 1516 of the inflatable cooler 1500 in the expanded configuration, shown in FIGS. 15A-15B. The inflation valve 1520 is illustrated in FIG. 16. The inflation valve 1520 is in fluidic communication with the inflation chamber 1522 and therefore enables the chamber to be inflated/deflated. An external layer 1600 and interior layer 1602 define at least a portion of the boundary of the inflation chamber 1522. The external layer 1600 and the interior layer 1602 may be constructed out of an air tight material such as PVC, TPU, Hypalon, etc. These materials enable the cooler's durability to be enhanced. An interior storage compartment 1604 is also shown in FIG. 16. As shown, the interior layer 1602 also defines at least a portion of the boundary of the interior storage compartment 1604. It will be appreciated that the volumetric size of the interior storage compartment may be larger in the expanded configuration than the condensed configuration to accommodate the decrease in cooler's profile.

In one example, the inflatable cooler may be more generally referred to as an article of manufacture and may have other uses beyond storing contents at a low temperature, such protecting interior contents or other conceivable uses. The inflatable cooler 1500 shown in FIGS. 15A-15D and 16 enables the cooler to be compacted when desired. As such, the cooler is highly modular enabling a vast number of benefits such as easy storage, transport, etc.

FIG. 17 shows a method 1700 for constructing an inflatable cooler. The method may be used to manufacture any of the embodiments or combination of the embodiments described above with regard to FIGS. 1-17 or may be used to manufacture another suitable inflatable cooler or more generally an article of manufacture. At 1702 the method includes constructing an inflatable cooler including a first pair of sides extending from a bottom portion, a plurality of foldable sections extending through a second pair of sides, the foldable sections enabling an angular position, with respect to the bottom portion, of each of the sides in the first pair of sides to be adjusted, and an inflation valve connected to an inflation chamber positioned between an interior storage compartment and an external layer, the inflation chamber positioned in one or more sides in the first pair of sides and the second pair of sides.

In one example, the first pair of sides may include a first side opposing a second side and the second pair of sides includes a third side opposing a fourth side and where the inflation chamber is included in the first and second pairs of sides. In another example, when the first pair of sides is in the condensed configuration, the inflation chamber may be at least partially deflated and the plurality of foldable sections is creased. In yet another example, when the first pair of sides is in the expanded configuration, the first pair of sides may be substantially vertically oriented.

FIGS. 18A-18D shows an eighth embodiment of an inflatable cooler 1800. A bottom portion 1802 and a top portion 1804 of the inflatable cooler 1800 are illustrated. It will be appreciated that the eighth embodiment of the inflatable cooler may include features of any of the previously described embodiments including specifically the seventh embodiment.

Figure 18B:
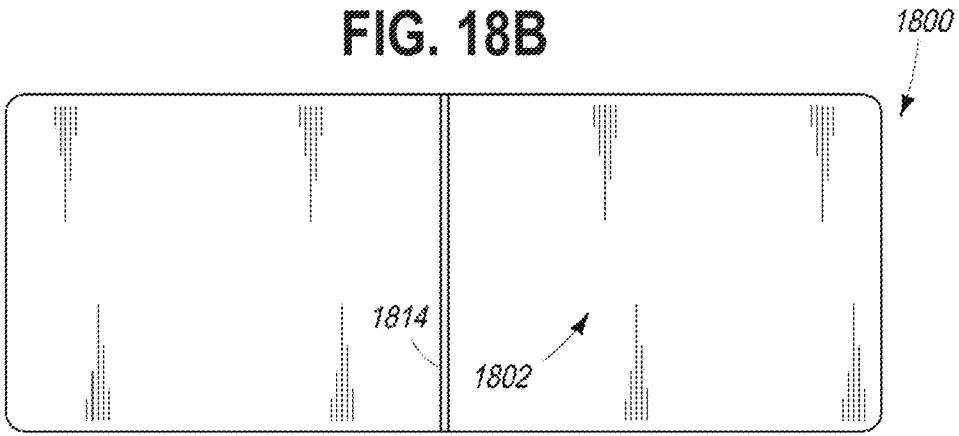
FIGS. 18A-18D show an eighth inflatable cooler embodiment in expended and condensed configurations.
Figure 18D:
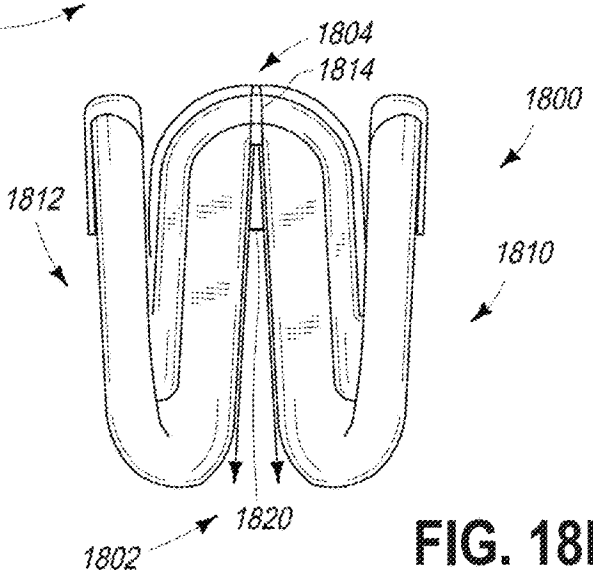
Figure 18A:
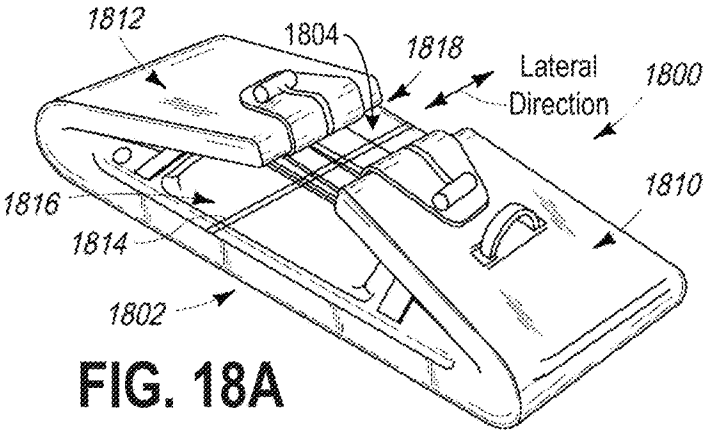

FIG. 18A shows the inflatable cooler 1800 in a first condensed configuration, similar to the condensed configuration of the inflatable cooler 1500 shown in FIGS. 15C and 15D. It will be appreciated that the inflatable cooler 1800 folds about foldable sections, obstructed from view in FIGS. 18A, similar to the foldable sections 1528, shown in FIGS. 15A and 15B. In the first condensed configuration of the inflatable cooler 1800 shown in FIG. 18A a first side 1810 and a second side 1812 of the inflatable cooler are folded down toward the bottom portion 1802. Specifically, the foldable sections in the cooler creased to facilitate this type of folding. The inflatable cooler 1800 shown in FIG. 18A includes a foldable section 1814 extending laterally across a third side 1816, a fourth side 1818, and the top portion 1804. The lateral direction is indicated in FIG. 18A, for reference. It will be appreciated that the foldable section 1814 is configured to crease along its length to enable the cooler to be folded into a more compact configuration (i.e., a second condensed configuration) than the first condensed configuration.

FIG. 18B shows a bottom view of the inflatable cooler 1800. As shown in FIG. 18B the foldable section 1814 extends laterally across the bottom portion 1802. Thus, the foldable section 1814 extends across the bottom portion 1802 as well as the top portion 1804, third side 1816, and fourth side 1818, shown in FIG. 18A, in some examples.

Figure 18C:
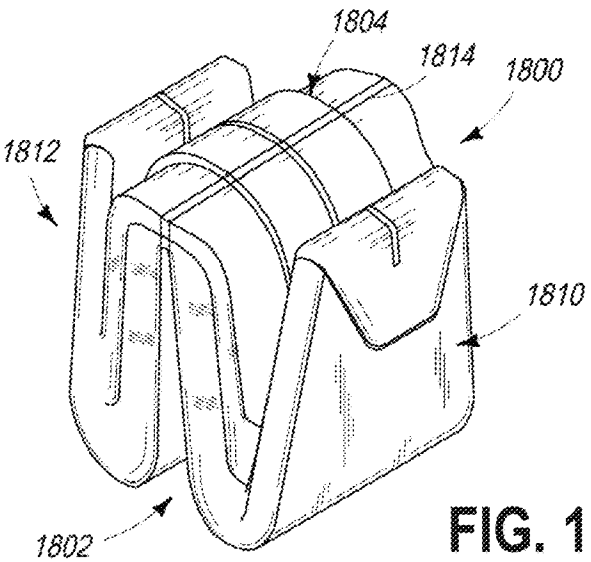

FIGS. 18C and 18D depict the inflatable cooler 1800 in a second compacted configuration where the inflatable cooler 1800 is folded about the foldable section 1814. In the second configuration the first side 1810 and the second side 1812 move even closer to each other, further increasing the compactness of the cooler. As such, additional space saving benefits can be achieved when the inflatable cooler 1800 is constructed in this manner.

FIG. 18D shows an angle 1820 formed at the apex of the fold of the bottom section 1802. In one example, the angle 1820 may be less than 45, 30, 15, or 5 degrees. It will be appreciated that the smaller the angle 1820 the inflatable cooler 1800 can achieve a more compact arrangement. As a result, the collapsibility benefits, such as easy storage and transportation, can be further improved.

FIGS. 1-18D show example configurations with relative positioning of the various components therein. If shown directly in contact with each other, or directly coupled, then such elements may be referred to as directly contacting or directly coupled, at least in one example. Similarly, elements shown contiguous or adjacent to one another may be contiguous or adjacent to each other in at least one example. As an example, layers in face-sharing contact with each other may be referred to as in face-sharing contact. As a further example, components positioned apart from each other with only a space there between and no other components in between, may be referred to as such in at least one example. As another example, areas identified as open space may be completely filled by an open space in at least one example.

It will be appreciated that the configurations and methods disclosed herein are exemplary in nature, and that theses specific embodiments are not to be considered in a limiting sense, due to the possibility of numerous variations. For example, the above technology may be applied to various shapes, other coolers, or to other storage devices. The subject matter of the present disclosure includes all novel and non-obvious combinations and sub-combinations of the various methods and configurations and other features, functions, and/or properties disclosed herein.

FIGS. 1-18D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. One example aspect of the present application includes an article of manufacture, comprising an inflatable cooler having at least a portion formed with a drop-stitch construction. One or more of this aspect or others may include the inflatable cooler comprising a length formed generally rectangular with the length longer than a height, where only portions of the length are formed with the drop-stitch construction. Any one or subset of the above aspects may comprise a trapezoidal side profile narrower at a top than a bottom, where only portions of the side profiles are formed with the drop-stitch construction. Any one or subset of the above aspects may comprise a top of the cooler having a flexible linear opening formed between tops of the lengths of the sides, and the inflatable cooler comprises a trapezoidal side profile narrower at a top than a bottom, where only portions of the side profiles are formed with the drop-stitch construction. Any one or subset of the above aspects may comprise the inflatable cooler having a trapezoidal side profile narrower at a top than a bottom, where side and bottom legs of the trapezoid are formed with the drop-stitch construction. Any one or subset of the above aspects may comprise there being only a single inflatable portion provided, with only a single valve, and no other inflatable portions. Any one or subset of the above aspects may comprise an internal storage compartment is lined with an insulating material different from the drop-stitch fabric. Any one or subset of the above aspects may comprise the inflatable cooler including a plurality of foot guards.

In another aspect, an inflatable cooler may comprise one or more of a first cooler body face comprising drop-stitch material, a second cooler body face comprising drop-stitch material, and a storage compartment defined by the first and second cooler body faces. In this or any of the above aspects or subcombinations thereof, the first cooler body face and second cooler body face are nonreleasably coupled to each other at a bottom. In this or any of the above aspects or subcombinations thereof, the first cooler body face and second cooler body face are releasably coupled via a zipper at a top. In this or any of the above aspects or subcombinations thereof, the first cooler body face is defined by a portion of a first inflatable chamber, and the second cooler body face is defined by another portion of the first inflatable chamber. In this or any of the above aspects or subcombinations thereof, the first cooler body face and the second cooler body face are defined by a single, common inflatable chamber. In this or any of the above aspects or subcombinations thereof, inflatable cooler further comprises a flexible set of handles.

In another aspect, an inflatable and deflatable cooler may comprise one or more of a first section comprising at least four vertical walls forming a trapezoidal-end-sided and rectangular-side-sided interior chamber, where each wall only partially comprises drip-stitch construction and having a common inflatable chamber; and a bottom section, the bottom section having an interior fluidically connected with the common inflatable chamber, where drop stitches are positioned in the bottom section, the drop stitches vertically positioned; and a layer wrapping together the first section and the bottom section. In any of the above aspects or subcombinations thereof, the cooler further comprises a zipper closure to fully close the interior chamber and/or only a portion of the bottom section comprises drop-stitch construction. In any of the above aspects, the portions having drop-stitching may form a structural frame for the cooler, with remaining surfaces and/or walls without drip-stitching may be supported by the frame elements to form the overall cooler. In any of the above aspects, an internal thermally reflective liner may be provided to fully cover one or more or each of the internal surfaces, both over areas with and without drop-stitching.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for manufacture, comprising:

constructing an inflatable cooler including:

a first pair of sides extending from a bottom portion;

a plurality of foldable sections extending through a second pair of sides, the foldable sections enabling an angular position, with respect to the bottom portion, of each of the sides in the first pair of sides to be adjusted; and an inflation valve connected to an inflation chamber positioned between an interior storage compartment and an external layer, the inflation chamber positioned in one or more sides in the first pair of sides and the second pair of sides, wherein the inflatable cooler only partially comprises drop-stitch construction and multiple walls have a common inflation chamber;

wherein drop-stitch fabric portions are cut into individual pieces that correspond to the first and second pairs of sides and the bottom portion, wherein the fabric portions are coupled to corresponding portions via a method of scoring and sealing.

2. The method of claim 1, where the first pair of sides includes a first side opposing a second side and the second pair of sides includes a third side opposing a fourth side and where the inflation chamber is included in the first and second pairs of sides.

3. The method of claim 1, where, when the first pair of sides is in a condensed configuration, the inflation chamber is at least partially deflated and the plurality of foldable sections is creased.

4. The method of claim 1, where, when the first pair of sides is in an expanded configuration, the first pair of sides is substantially vertically oriented.

5. The method of claim 1, where the first and second pairs of sides comprise at least four vertical walls forming a trapezoidal-end-sided and rectangular-side-sided interior chamber.

6. The method of claim 5, wherein the bottom portion has an interior fluidically connected with the inflation chamber, wherein drop stitches are positioned in the bottom portion, the drop stitches vertically positioned.

7. The method of claim 1, wherein corner seals extend at least from an end of a first edge seal to an adjacent end of a second edge seal, and wherein inner seals and outer seals span the entire vertical extent of the first and second pairs of sides.

8. The method of claim 7, wherein the corner seals overlap at least a portion of the edge seals.

9. A method for manufacture, comprising:

constructing an inflatable cooler including:

a first pair of sides extending from a bottom portion;

a plurality of foldable sections extending through a second pair of sides, the foldable sections enabling an angular position, with respect to the bottom portion, of each of the sides in the first pair of sides to be adjusted; and an inflation valve connected to an inflation chamber positioned between an interior storage compartment and an external layer, the inflation chamber positioned in one or more sides in the first pair of sides and the second pair of sides, wherein the inflatable cooler only partially comprises drop-stitch construction and multiple walls have a common inflation chamber, wherein the first pair of sides and the bottom portion are formed from a continuous chamber with drop-stitching, and wherein the second pair of sides does not have drop-stitching.

* * * * *